US006939651B2

(12) United States Patent
Li et al.

(10) Patent No.: US 6,939,651 B2
(45) Date of Patent: Sep. 6, 2005

(54) ELECTROPHOTOGRAPHIC PHOTOCONDUCTOR, AND PROCESS CARTRIDGE AND ELECTROPHOTOGRAPHIC APPARATUS USING THE SAME

(75) Inventors: Hongguo Li, Shizuoka (JP); Kazukiyo Nagai, Shizuoka (JP); Masaomi Sasaki, Shizuoka (JP); Shinichi Kawamura, Kanagawa (JP); Yasuo Suzuki, Shizuoka (JP); Nozomu Tamoto, Shizuoka (JP); Kawori Tanaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 56 days.

(21) Appl. No.: 10/175,799

(22) Filed: Jun. 21, 2002

(65) Prior Publication Data

US 2003/0059695 A1 Mar. 27, 2003

(30) Foreign Application Priority Data

| | | |
|---|---|---|
| Jun. 21, 2001 | (JP) | 2001-187869 |
| Sep. 21, 2001 | (JP) | 2001-289117 |
| Sep. 25, 2001 | (JP) | 2001-290358 |
| Oct. 26, 2001 | (JP) | 2001-328629 |
| Jun. 17, 2002 | (JP) | 2002-175616 |

(51) Int. Cl.[7] ..... G03G 5/043; G03G 5/147

(52) U.S. Cl. ..... 430/66; 430/56; 430/58.2; 430/58.7; 430/67; 399/116; 399/159

(58) Field of Search ..... 430/58.2, 58.7, 430/66, 67, 56; 399/116, 159

(56) References Cited

U.S. PATENT DOCUMENTS

| | | | | |
|---|---|---|---|---|
| 5,028,502 A | | 7/1991 | Yuh et al. | 430/31 |
| 5,100,453 A | | 3/1992 | Richards | 65/27 |
| 5,286,588 A | | 2/1994 | Suzuki | |
| 5,561,016 A | | 10/1996 | Suzuki et al. | 430/96 |
| 5,578,405 A | | 11/1996 | Ikegami et al. | 430/76 |
| 5,665,500 A | | 9/1997 | Suzuki | 430/66 |
| 5,677,096 A | | 10/1997 | Suzuki | 430/60 |
| 5,723,243 A | | 3/1998 | Sasaki et al. | |
| 5,747,204 A | | 5/1998 | Anzai et al. | |
| 5,789,128 A | | 8/1998 | Adachi et al. | |
| 5,834,145 A | | 11/1998 | Yoshinaga et al. | 430/31 |
| 5,835,838 A | * | 11/1998 | Yu | 399/350 |
| 5,840,454 A | | 11/1998 | Nagai et al. | |
| 5,846,680 A | | 12/1998 | Adachi et al. | |
| 5,910,561 A | | 6/1999 | Adachi et al. | 430/73 |
| 5,928,828 A | | 7/1999 | Suzuki | 430/126 |
| 5,942,363 A | | 8/1999 | Tanaka et al. | |
| 5,976,746 A | | 11/1999 | Tamaka et al. | |
| 5,999,773 A | | 12/1999 | Yasutomi et al. | 399/148 |
| 6,026,262 A | | 2/2000 | Kinoshita et al. | |
| 6,027,846 A | | 2/2000 | Shimada et al. | |
| 6,030,736 A | | 2/2000 | Ikegami et al. | |
| 6,045,959 A | | 4/2000 | Katayama et al. | |
| 6,066,428 A | | 5/2000 | Katayama et al. | |
| 6,069,224 A | | 5/2000 | Adachi et al. | 528/198 |
| 6,093,784 A | | 7/2000 | Tamura et al. | |
| 6,117,603 A | * | 9/2000 | Yu et al. | 430/66 |
| 6,136,483 A | | 10/2000 | Suzuki et al. | |
| 6,187,492 B1 | * | 2/2001 | Ri et al. | 430/73 |
| 6,187,494 B1 | | 2/2001 | Kawamura et al. | |
| 6,191,249 B1 | | 2/2001 | Tanaka et al. | 528/196 |
| 6,210,848 B1 | | 4/2001 | Nagai et al. | |
| 6,249,304 B1 | | 6/2001 | Sawayama et al. | 347/228 |
| 6,322,940 B1 | | 11/2001 | Nishigaki et al. | 430/58.65 |
| 6,326,112 B1 | | 12/2001 | Tamura et al. | |
| 6,366,751 B1 | | 4/2002 | Shakuto et al. | 399/159 |
| 6,432,596 B2 | | 8/2002 | Ikuno et al. | 430/58.05 |
| 6,444,387 B2 | | 9/2002 | Ri et al. | |
| 2002/0147278 A1 | * | 10/2002 | Sasaki et al. | 525/132 |

OTHER PUBLICATIONS

U.S. Appl. No. 10/856,962, filed Jun. 1, 2004, Ikegami et al.
U.S. Appl. No. 10/792,607, filed Mar. 4, 2004, Ikegami et al.
U.S. Appl. No. 10/769,855, filed Feb. 3, 2004, Watanabe et al.
U.S. Appl. No. 10/784,872, filed Feb. 24, 2004, Shimada et al.
U.S. Appl. No. 10/804,030, filed Mar. 19, 2004, Suzuki et al.
U.S. Appl. No. 10/804,043, filed Mar. 19, 2004, Suzuki et al.
U.S. Appl. No. 10/612,146, filed Jul. 3, 2003, Miura et al.
U.S. Appl. No. 10/405,843, filed Apr. 3, 2003, Tamoto et al.
U.S. Appl. No. 10/460,152, filed Jun. 13, 2003, Suzuki et al.
U.S. Appl. No. 10,384,701, filed Mar. 11, 2003, Nohsho et al.
U.S. Appl. No. 10/349,960, filed Jan. 24, 2003, Yasutomi et al.
U.S. Appl. No. 10/268,830, filed Oct. 11, 2002, pending.
U.S. Appl. No. 10/244,444, filed Sep. 17, 2002, pending.
U.S. Appl. No. 09/679,480, filed Oct. 5, 2000, pending.
U.S. Appl. No. 08/550,808, filed Oct. 31, 1995, pending.
U.S. Appl. No. 10/090,745, filed Mar. 6, 2002, pending.
U.S. Appl. No. 09/846,244, filed May 2, 2001, pending.
U.S. Appl. No. 09/873,246, filed Jun. 5, 2001, pending.
U.S. Appl. No. 10/102,875, filed Mar. 22, 2002, pending.
U.S. Appl. No. 09/708,659, filed Nov. 9, 2000, pending.
U.S. Appl. No. 09/545,454, filed Apr. 7, 2000, allowed.
U.S. Appl. No. 09/796,470, filed Mar. 2, 2001, allowed.
U.S. Appl. No. 09/942,574, filed Aug. 31, 2001, allowed.

(Continued)

*Primary Examiner*—Janis L. Dote
(74) *Attorney, Agent, or Firm*—Oblon, Spivak, McClelland, Maier & Neustadt, P.C.

(57) ABSTRACT

An electrophotographic photoconductor comprising at least an electroconductive support and a photoconductive layer which is formed on said electroconductive support, the outermost layer of the photoconductor contains particles comprising a polyorganosiloxane-containing phase which contains polyorganosiloxane and an organic polymer-containing phase which contains organic polymer without silicon and has a polyorganosiloxane content which is less than the polyorganosiloxane-containing phase, each phase being exposed at the top surface of the photoconductor.

22 Claims, 6 Drawing Sheets

OTHER PUBLICATIONS

U.S. Appl. No. 09/903,718, filed Jul. 13, 2001, allowed.
U.S. Appl. No. 10/104,078, filed Mar. 25, 2002, pending.
U.S. Appl. No. 10/077,756, filed Feb. 20, 2002, pending.
U.S. Appl. No. 10/020,925, filed Dec. 19, 2001, pending.
U.S. Appl. No. 10/102,867, filed Mar. 22, 2002, pending.
U.S. Appl. No. 10/178,685, filed Jun. 25, 2002, pending.
U.S. Appl. No. 10/176,578, filed Jun. 24, 2002, pending.
U.S. Appl. No. 10/180,316, filed Jun. 27, 2002, pending.
U.S. Appl. No. 10/275,413, filed Jul. 26, 2002, pending.
U.S. Appl. No. 10/235,961, filed Sep. 6, 2002, pending.
U.S. Appl. No. 10/272,824, filed Oct. 18, 2002, pending.
U.S. Appl. No. 10/260,275, filed Oct. 1, 2002, pending.
U.S. Appl. No. 09/897,924, filed Jul. 5, 2001, pending.
U.S. Appl. No. 09/817,151, filed Mar. 27, 2001, allowed.
U.S. Appl. No. 10/051,230, filed Jan. 22, 2002, pending.
U.S. Appl. No. 09/635,127, filed Aug. 9, 2000, pending.
U.S. Appl. No. 09/814,722, filed Mar. 23, 2001, pending.
U.S. Appl. No. 09/985,348, filed Nov. 2, 2001, pending.
U.S. Appl. No. 09/985,375, filed Nov. 2, 2001, pending.
U.S. Appl. No. 09/985,347, filed Nov. 2, 2001, pending.
U.S. Appl. No. 09/985,368, filed Nov. 2, 2001, pending.
U.S. Appl. No. 10/000,082, filed Dec. 4, 2001, pending.
U.S. Appl. No. 10/103,791, filed Mar. 25, 2002, pending.
U.S. Appl. No. 10/135,548, filed May, 1, 2002, pending.

* cited by examiner

ELECTROPHOTOGRAPHIC PHOTOCONDUCTOR, AND PROCESS CARTRIDGE AND ELECTROPHOTOGRAPHIC APPARATUS USING THE SAME

BACKGROUND OF THE INVENTION

1. Field of the Invention

The present invention relates to an electrophotographic photoconductor which has a high sensitivity and excellent durability, and is capable of producing stable images without deterioration of the image quality under use for a long period of time, and a process cartridge and electrophotographic apparatus using the same.

2. Description of the Related Art

The electrophotographic method which utilize an electrophotographic photoconductor has been applied to copying machine, facsimile machine, laser printer, direct digital platemaking machine, and the like. According to this electrophotographic method, the electrophotographic is charged, exposed to light, developed to form a toner image which is transferred on an image support (transfer paper, etc.), followed by fixation. Additionally, a cleaning process of the electrophotographic photoconductor may be performed.

As a conventional electrophotographic photoconductor used in the electrophotographic method, there are known, for example, an electrophotographic photoconductor provided with a photoconductive layer mainly comprising selenium or selenium alloy on an electroconductive support, an electrophotographic photoconductor comprising an inorganic photoconductive material such as zinc oxide•cadmium sulfide in a binder and an electrophotographic photoconductor using an amorphous silicone type material. However, recently, from the standpoint of achieving low cost, freedom of design of a photoconductor, and free of pollutant, an electrophotographic photoconductor made of organic material is widely used.

As the organic electrophotographic photoconductor, there are known, for example, an electrophotographic photoconductor using a photoconductive resin such as polyvinylcarbazole(PVK), an electrophotographic photoconductor using a charge transport complex type material such as PVK-TNF(2,4,7-trinitrofluorenone), an electrophotographic photoconductor using a pigment dispersed material such as phthalocyanine-binder, and a function-separation type electrophotographic photoconductor using a combination of a charge generation material and a charge transport material. Among them, the function-separation type electrophotographic photoconductor is becoming the focus of public attention.

The mechanism for forming electrostatic latent images using the function-separation type electrophotographic photoconductor is as follows. Firstly, the surface of the function-separation layered photoconductor is charged and thereafter exposed to light images. The light passes through the charge transport layer and is absorbed by a charge generation material for use in the charge generation layer. Upon absorbing light, the charge generation material produces a charge carrier. The charge carrier is injected into the charge transport layer and travels along an electric field generated by the charging step to neutralize the surface charge of the photoconductor. As a result, latent electrostatic images are formed on the surface of the photoconductor. There have been known and are currently used function-separation layered photoconductors employing a combination of a charge generation material which exhibits absorption within the UV region with a charge transport material which exhibits absorption mainly within the visible light region.

Most charge transport materials of the organic electrophotographic photoconductor developed for use in the electrophotographic method are low-molecular compounds. Since the low-molecular compounds alone cannot form a film, they are mixed with or dispersed in an inactive polymer.

However, the charge transport layer composed of a low-molecular charge transport material and inactive polymers is so flexible that there can be film abrasion due to the mechanical load to the photoconductor surface by a development system or cleaning system during repeated uses. As the film abrasion progresses, the electrostatic potential of the electrophotographic photoconductor is reduced, sensitivity is deteriorated, or image deterioration such as greasing and reduced image density by scratch on the electrophotographic photoconductor surface may occur. Further, in recent, due to minimization of the electrophotographic photoconductor as the electrophotographic apparatuses become faster and smaller, high durability of the electrophotographic photoconductor is an important issue.

In order to realize the high durability electrophotographic photoconductor, a protective layer is provided on the top surface layer of the photoconductor, and the protective layer is lubricated or cured, or a filler is added to the protective layer. In particular, the addition of the filler to protective layer is effective to enhance the durability of the electrophotographic photoconductor, improving wear resistance and mechanical durability. However, for a so-called electrophotographic method, electrical durabilities such as electrostatic potential or stable potential of a light exposure part as well as the mechanical durabilities due to repeated charging and light exposing processes are important. Though the mechanical durabilities are improved, reducing film abrasion, if the electrostatic potential is reduced or the potential of the light exposure parts is increased, sufficient electrostatic contrast cannot be obtained, causing deterioration of image quality.

Also, since there is a limit of charge movement in the charge transport layer, the electrophotographic process has difficulties in high speed operation and simplification. This is because the charge transport material of a low-molecular compound is used in a low content (usually 50 wt % or less). Thus, if the amount of the low-molecular charge transport material, the charge movement can be improved. However, this may impair film formability and wear resistance of the photoconductive layer.

As approaches to improve properties of the organic electrophotographic photoconductor, a technique ameliorating a binder resin of the organic photoconductor (for Example, Japanese Patent Laid-Open No. 5-216250) or techniques using a charge transporting polymer (for example, Japanese Patent Laid-Open No. 51-73888, Japanese Patent Laid-Open No. 54-8527, Japanese Patent Laid-Open No. 54-11737, Japanese Patent Laid-Open No. 56-150749, Japanese Patent Laid-Open No. 57-78402, Japanese Patent Laid-Open No. 63-285552, Japanese Patent Laid-Open No. 64-1728, Japanese Patent Laid-Open No. 64-13061, Japanese Patent Laid-Open No. 64-19049, Japanese Patent Laid-Open No. 3-50555, Japanese Patent Laid-Open No. 4-175337, Japanese Patent Laid-Open No. 4-225014, Japanese Patent Laid-Open No. 4-230767, Japanese Patent Laid-Open No. 5-232727, and Japanese Patent Laid-Open No. 5-310904) were disclosed.

However, the technique ameliorating the binder resin of the organic photoconductor has a problem in that significant improvement of wear resistance cannot be acquired due to compositional ration of low molecular charge transport material. The technique using the charge transporting polymer achieve success in improvement of wear resistance of film by employing high molecular material as the charge transport layer component. However, the photoconductor prepared by this technique is not sufficiently satisfactory as a permanent part without need for changing until the life span of a mother machine.

Meanwhile, the cleaning characteristics of the electrophotographic photoconductor are very important in terms of maintenance of the high image quality. This is because when impurities are adhered to the surface of the electrophotographic photoconductor surface, many image defects may occur, shortening the life span. Particularly, in case of the method for inhibiting the mechanical abrasion by adding a filler to the protective layer, it is necessary to have an excellent cleaning characteristics. Also, as the demand for high quality images increases recently, the size of toner particles used in the electrphotographic is smaller. When a smaller size toner is used, the cleaning characteristics of the electrophotographic photoconductor are worse. Further, in connection with a small size toner, spherical toners are studied. However, the spherical toners have cleaning characteristics poorer than the conventional crushed toners.

In Japanese Patent Laid-Open No. 07-295248, Japanese Patent Laid-Open No. 07-301936 and Japanese Patent Laid-Open No. 08-082940, it is disclosed a method of improving wear resistance of the photoconductor surface by adding fluorine-modified silicone oil to the surface layer to improve cleaning characteristics.

However, the fluorine-modified silicone oil tends to migrate to the surroundings of the surface during the formation of the surface layer and gathered then. As a result, the effects cannot last by the abrasion of the surface layer due to repeated uses.

Also, in order to improve wear resistance, various techniques to add finely-divided particle are attempted. For example, there are techniques of addition of silicone resin particles, fluorine-containing resin (Japanese Patent Laid-Open No. 63-65449), melamine resin particles (Japanese Patent Laid-Open No. 60-177349). Particularly, according to Japanese Patent Laid-Open No. 02-143257, polyethylene powders are added to the surface layer to reduce the frictional coefficient of the top surface and improve the cleaning characteristics, thereby improving the wear resistance of an electrophotographic photoconductor. According to Japanese Patent Laid-Open No. 02-144550, fluorine-containing resin powders are added to the surface layer to reduce the frictional coefficient of the top surface and improve the cleaning characteristics, thereby improving the wear resistance of an electrophotographic photoconductor. According to Japanese Patent Laid-Open No. 07-128872, Japanese Patent Laid-Open No. 10-254160, finely-divided particles of silicone are added to the surface layer to reduce the frictional coefficient of the top surface and improve the cleaning characteristics, thereby improving the wear resistance of an photoconductor According to Japanese Patent Laid-Open No. 2000-010322 and U.S. Pat. No. 5,998,072, cross-liked organic particles are added to the surface layer to reduce the frictional coefficient of the top surface and improve the cleaning characteristics, thereby improving the wear resistance of an photoconductor. According to Japanese Patent Laid-Open No. 08-190213, finely-divided particles of a methylsiloxane resin are added to the surface layer to reduce the frictional coefficient of the top surface and improve the cleaning characteristics, thereby improving the wear resistance of an electrophotographic photoconductor. In these publications, the high durability was sought through reduction of frictional coefficient and surface energy at the surface of an electrophotographic photoconductor. However, these methods have the following problems.

That is, when resin powders or finely-divided particles are added to the surface layer of an electrophotographic photoconductor to improve the wear resistance of the surface of an photoconductive layer, the resin powders or particles have difficulties in being dispersed since they have a poor compatibility to the binder resin, generating defects which would be shown as black or white spots, whereby the residual potential increases during repeated uses. Also, the light transmission of the photoconductive layer may be impeded, and thus, there occurred problems such as reduction of sensitivity and charge transport performance and non-uniform image density.

SUMMARY OF THE INVENTION

Accordingly, in order to solve the problems involved in the prior art, it is an object of the present invention to provide an electrophotographic photoconductor capable of maintaining high sensitivity, sufficient durability, and forming images having excellent image quality without image deterioration even after used for a long period of time, and process cartridge and electrophotographic apparatus using the electrophotographic photoconductor.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
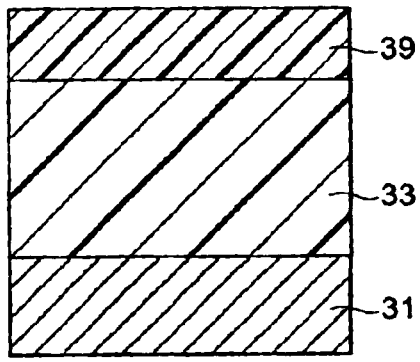
FIG. 1 is a schematic cross-sectional view of an embodiment of an electrophotographic photoconductor according to the present invention.

Now the present invention will be described in detail.

[Electrophotographic Photoconductor]

The electrophotographic photoconductor according to the present invention includes a photoconductive layer on an electroconductive support and other structures as needed.

Photoconductive Layer

The photoconductive layer contains particles, and other components as needed at the to layer thereof.

Particle

According to the present invention, the particle comprises a polyorganosiloxane-containing phase and an organic polymer-containing phase exposed to the surface. The polyorganosiloxane-containing phase comprises polyorganosiloxane. The organic polymer-containing phase comprises an organic polymer which has a polyorganosiloxane contents lower than the polyorganosiloxane-containing phase and does not contain silicon.

The particle comprises both a polyorganosiloxane structure and a organic polymer structure without containing silicon. Each structure part of the particle coheres to separately form a part with a high polyorganosiloxane content (a polyorganosiloxane-containing phase) and a part with a high organic polymer content (a organic polymer-containing phase, where the polyorganosiloxane content is lower than that of the polyorganosiloxane-containing phase), each being exposed to at one or more parts of the surface.

According to the present invention, the particles having such format are contained in the top surface layer of the photoconductive layer. As a result, there can be provided an electrophotographic photoconductor, in which even upon applying electrical, chemical or mechanical buzzards, low frictional properties can be continuously maintained and high sensitivity and excellent durability are obtained. Also, image deterioration due to a long term use is inhibited, whereby it is possible to form images with stable image quality.

The exposure of the phases of the particle, that is phase separation of the particle can be examined by observing a thin sectional segment of the photoconductor by mapping of silicon element using a transmission electron microscopy (TEM) with an energy filter.

For example, a photoconductive layer including the top surface layer of the electrophotographic photoconductor is peeled and embedded with an epoxy resin. An excess of the epoxy resin is removed, cooled using liquid nitrogen and trimmed to a thickness of 2000 nm using a cutter at −125° C. Also, at the same temperature another sectional segment sample of the surface layer with a thickness of 90 nm is manufactured. Using a platinum loop, the segment samples are collected from a sucrose solution, and fixed on a colloidal film addition mesh, followed by drying. The resulting sample was observed under a transmission electron microscopy (TEM) with an energy filter. A Zero loss image, Pre-C image under a condition where carbon element part is shown to be the darkest and mapping image by silicon element are examined. The phase separation of the particle can be confirmed by contrast in the particle.

Figure 14:
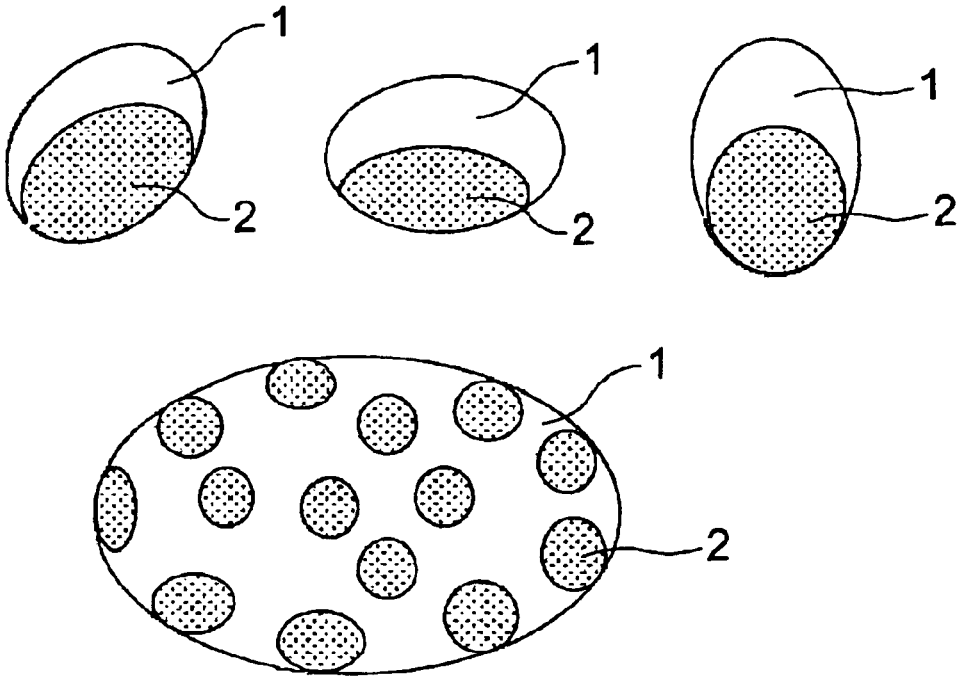
FIG. 14 is a view illustrating surfaces of the particles used according to the present invention.

FIG. 14 shows the concept of the particle. As shown in FIG. 14, in the section of the particle, a polyorganosiloxane-containing phase 1 which contains a polyorganosiloxane and a organic polymer-containing phase 2 which contains a organic polymer without silicon having a polyorganosiloxane content lower than the polyorganosiloxane-containing phase are exposed to the surface.

Specifically, on the mapping of silicon element, the polyorganosiloxane-containing phase is observed as white contrast and the organic polymer-containing phase is observed as a black or gray contrast. Whether each part is exposed at the surface is judged by the contrast boundary within the particle extends to the periphery on the section of the particle.

As the polyorganosiloxane, polymers connected by a siloxane binding and represented by the following formula (I) may be used. The examples of the organic polymer include any known polymers connected by a carbon-carbon binding, carbon-oxygen binding, carbon-nitrogen binding and carbon-sulfur binding or a any combination thereof.

Also, the low frictional properties can be examined by for example, taper abrasion, contact angle of water, coefficient of friction, electrical properties and the like.

Examples of the organic polymers include vinyl polymers such as vinylchloride-vinylacetate copolymers, polystyrenes, styrene-butadiene copolymers, polyethylenes, (meth)acrylic polymers, styrene-(meth)acrylic copolymers, styrene-acrylonitrile copolymers, styrene-maleic anhydride copolymers, epoxy polymers, acetal polymers, phenoxy polymers, polyesters, polycarbonates, polyuretanes and polyamides.

These organic polymer may be connected to the polyorganosiloxane by a binding group as needed, forming a composition of the particle. As the binding group, radical reactive groups are preferred. For example, a polymer having an acryl polymerizable group at its end can be connected to the polyorganosiloxane by reacting the acryl polymerizable group with radical reactive group or SH group in the polyorganosiloxane. As such organic polymer, particularly, polymers having an acrylic polymerizable group are preferred, including for example, (meth)acrylic acid esters represented by the formula (II), monomers copolymerizable with the (meth)acrylic acid esters and mixtures thereof.

The mixing ratio of the polyorganosiloxane to the organic polymer (w/w, polyorganosiloxane/organic polymer) is preferably in a range of 30:70 to 90:10 because of the following reasons.

That is, it is preferred that the particles are made of the polyorganosiloxane and the organic polymer and the contents of the polyorganosiloxane in the particles is at least 30 wt % and up to 90 wt %.

If the content of polyorganosiloxane is less than 30 wt %, effects of reducing and sustaining the friction coefficient are lowered. If the content exceeds 90 wt %, the dispersability is deteriorated and hence, segregation in the membrane becomes conspicuous. Consequently, the friction coefficient can not be sustained any more. Further, the mechanical strength of the membrane is lowered, producing problems of abnormal abrasion.

The mixing ratio of polyorganosiloxane to organic polymer (w/w) is more preferably 35:65 to 85:15.

Preferably, the particles are dispersed in a spherical or egg shape in the photoconductive layer in order to provide a high sensitivity and excellent durability, and to produce stable images without the deterioration of the image quality due to use for a long period of time. That is, it is preferred that the particles are dispersed in the photoconductive layer with a section of circle or oval. Also, the particles are preferably dispersed in a micro gel type for the purpose of improving their properties associated with slideness and removal of impurities, and durability of such properties.

Preferably, the particles are organic modified polyorganosiloxane graft copolymers having a graft chain which comprise a main chain of polyorganosiloxane and a organic polymer without containing silicon in order to provide a high sensitivity and excellent durability, and to produce stable images without the deterioration of the image quality due to use for a long period of time. The organic modified polyorganosiloxane grafted copolymer having a graft chain is a compound having reactive group in the unit of the polyorganosiloxane, by which the organic polymer without containing silicon is connected to the compound. The main chain and the side chain can be clearly distinguishable, in which the main chain has a plurality of connecting sites and the side chain has only one connecting site.

As the organically modified polyorganosiloxane graft copolymer, acryl-modified polyorganosiloxane is particularly preferred. The acryl-modified polyorganosiloxane may be dispersed as a particle phase and the average particle diameter of the acryl-modified polyorganosiloxane particles (volume average particle diameter($D_{50}$)) is in the range of 0.1 to 0.6 $\mu$m. The acryl-modified polyorganosiloxane is subjected to a high pressure with at least one of a solvent and a binder and crushed and dispersed by liquid impact under elevated pressure, so as to be dispersed as a particle phase and the average particle diameter of the acryl-modified polyorganosiloxane particles (volume average particle diameter($D_{50}$)) is in the range of 0.1 to 0.6 $\mu$m.

The acryl-modified polyorganosiloxane exhibits slideness caused by a siloxane structure and impurity removal resulting from a low surface energy. Preferably, for such properties, the acryl-modified polyorganosiloxane has a longer dimethyl silicone chain. However, a conventional silicone oil or a silicone resin does not show satisfactory effects. It is believed that this is because they are not homogeneously dispersed in the film or are segregated on the surface, whereby they are readily separated from the film during operation of an electrophotographic apparatus without supplement from the inside of the film, which makes it impossible to maintain good slideness and impurity removal. The acryl-modified polyorganosiloxane compounds according to the present invention have acryl polymer parts and the acryl polymer parts should be homogeneously incorporated in the structure to increase compatibility to a medium. Therefore, it is advantageous that the acryl polymers are grafted at many sites in longer silicone chains. Since such a acryl-modified polyorganosiloxane compound shows a high compatibility to components of the photoconductive layer, it is expected to maintain the effects of the present invention for a long period of time. According to the present invention, the acryl-modified polyorganosiloxane may be preferably prepared by emulsion graft copolymerizing a polyorganosiloxane compound represented by the following formula (I) and a (meth)acrylic acid ester represented by the following formula (II) or a mixture of the (meth)acrylic acid ester or a monomer copolymerizable with the (meth)acrylic acid ester via emulsion graft copolymerization.

(I)

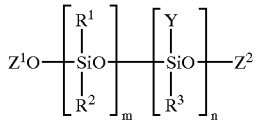

In the formula (I), $R_1$, $R_2$ and $R_3$ is a hydrocarbon group having 1 to 20 carbon atoms and $R_1$, $R_2$ and $R_3$ may be identical or different, or be halogenated;

Y is an organic group containing either a radical reactive group or SH group or both of them;

$Z_1$ and $Z_2$ is a hydrogen atom, lower alkyl group and any one represented by the following formula (n) and may be identical or different;

m is a plus integer up to 10,000; and n is an integer at least 1.

Formula (n)

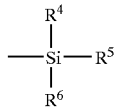

In the formula (n), $R_4$ and $R_5$ is a hydrocarbon group having 1 to 20 carbon atoms and $R_4$ and $R_5$ may be identical or different, or be halogenated; and $R_6$ is a hydrocarbon group having 1 to 20 carbon atoms, a halogenated hydrocarbon group, an organic group containing either a radical reactive group or SH group or both of them.

(II)

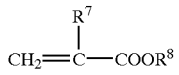

In the formula (II), $R_7$ is a hydrogen atom or methyl group; and $R_8$ is at least any one of an alkyl group, alkoxy-substituted alkyl group, cyclo alkyl group and aryl group.

In the formula (I), $R_1$, $R_2$ and $R_3$ are any hydrocarbon having 1 to 20 carbon atoms, for example, alkyl group such methyl group, ethyl group, propyl group, butyl group, etc., and aryl group such as phenyl group, tolyl group, xylyl group, naphtyl group, etc. At least one carbon atom in the hydrocarbon group may have at least one substituent of a halogen atom. $R_1$, $R_2$ and $R_3$ may be identical or different.

In the formula (I), the Y is an organic group containing either a radical reactive group or SH group, or both of them without specific limitation. Examples of the radical reactive group include vinyl group, allyl group, γ-acryloxy propyl group, γ-methacryloxy propyl group and γ-mercaptopyropyl group and the like. Examples of $Z_1$ and $Z_2$ include a hydrogen atom, a lower alkyl group such as methyl group, ethyl group, propyl group, butyl group, etc. or triorganosilyl group represented by the formula (n). In the formula (n), $R_4$, $R_5$ and $R_6$ are a hydrocarbon group having 1 to 20 carbon atoms, halogenated hydrocarbon group, an organic group containing either a radical reactive group or SH group or both of them.

In the formula (n), m is a plus integer of 10,000 or less, preferably 500 to 8,000; n is an integer of at least 1, preferably an integer of 1 to 500.

The polyorganosiloxane represented by the formula (I) can be prepared by using for example, cyclic polyorganosiloxane, liquid polydimethylsiloxane with both ends of the molecule blocked with hydroxy groups, liquid polydimethylsiloxane with both ends of the molecule blocked with hydroxy groups, polydimethylsiloxane with both ends of the molecule blocked with trimethylsilyl groups and the like, silanes or hydrolysis products thereof to introduce either a radical reactive group or SH group, or both of them and the like, more desirably, trifunctional trialkoxysilane and hydrolysis products thereof in an amount that does not adversely affect the purpose of the present invention.

Alternatively, the polyorganosiloxane represented by the formula (I) can be prepared by the following two methods.

Firstly, cyclic low-molecular siloxane such as octamethylcyclotetrasiloxane is reacted with a dialkoxysilane compound having at least one of a radical reactive group or SH group and hydrolysis product thereof in the presence of strong acid or strong alkali catalyst to form a high molecular polyorganosiloxane. The high molecular polyorganosiloxane is then dispersed in an aqueous medium in the presence of a proper emulsifying agent for the subsequent emulsion graft copolymerization.

Secondly, for example, a low-molecular polyorganosiloxane is emulsion copolymerized with a dialkoxysilane compound having either a radical reactive group or SH group, or both of them and hydrolysis product thereof in an aqueous medium in the presence of sulfonic acid surfactant or sulfate surfactant. This emulsion copolymerization also may be performed by emulsion dispersed the above compound with cationic surfactant such as alkyltrimethyl ammonium chloride or alkylbenzyl ammonium chloride, followed by addition of a strong alkali compound such as potassium hydroxide or sodium hydroxide.

The polyorganosiloxane represented by the formula (I) which can be prepared by the above-described methods has preferably a greater molecular weight. When the molecular weight is small, it is impossible to provide constant slideness, wear resistance, etc. to a molded body from the composition. Therefore, in the first method, a polyorganosiloxane of a high molecular is used as a raw material and emulsion dispersed for polymerization. Also, in the second method, during the curing process after the emulsion polymerization, a low curing temperature is used to increase a molecular weight of a polyorganosiloxane. The curing temperature is advantageously 30° C. or less, preferably 15° C. or less.

As the (meth)acrylic acid ester represented by the formula (II), for example, alkyl(meth)acrylates such as methyl(meth)acrylate, ethyl(meth)acrylate, propyl(meth)acrylate, butyl(meth)acrylate, isobutyl(meth)acrylate, pentyl(meth)acrylate, hexyl(meth)acrylate, octyl(meth)acrylate, 2-ethylhexyl(meth)acrylate, lauryl(meth)acrylate and stearyl(meth)acrylate; alkoxyalkyl(meth)acrylates such as methoxyethyl(meth)acrylate, and butoxyethyl(meth)acrylate; cyclohexyl(meth)acrylate, phenyl(meth)acrylate, benzyl(meth)acrylate and the like. These (meth)acrylic acid esters can be used alone or in a combination of two or more.

As the monomer copolymerizable with (meth)acrylic acid ester, for example, multifunctional monomers, and ethylenic unsaturated monomers.

Examples of the multifunctional monomers include ethylenic unsaturated amide such as (meth)acrylamide, diacetone(meth)acrylamide, N-methylol(meth)acrylamide, N-butoxymethyl(meth)acrylamide and N-methoxymethyl(meth)acrylamide, and alkyol or alkoxyalkyl compound of the ethylenic unsaturated amide, oxilane group-containing unsaturated monomers such as glycidyl(meth)acrylate and glycidylallylether, hydroxyl group-containing unsaturated monomers such as 2-hydroxyethyl(meth)acrylate and 2-hydroxypropyl(meth)acrylate, (meth)acrylic acid, maleic anhydride, ethylenic carboxyl group-containing unsaturated monomers crotonic acid and itaconic acid, amino group-containing unsaturated monomers such as N-dimethylaminoethyl(meth)acrylate and N-diethylaminoethyl(meth)acrylate, polyalkylene oxide group-containing unsaturated monomers such as addition products of (meth)acrylic acid and ethyleneoxide or propyleneoxide, complete esters of polyols such as ethylene glycoldi(meth)acrylate, diethylene glycoldi(meth)acrylate and tri methylolpropanetri(meth)acrylate with (meth)acrylic acid, further allyl(meth)acrylate, divinylbenzene and the like. These monomers can be used alone or in a combination of two or more.

These multifunction monomers participate in the cross-linking between polymers in the acryl-modified polyorganosiloxane to provide various properties such as resilient, durability, thermal resistance to the molded articles.

Examples of the ethylenic unsaturated monomers include styrene, α-methylstyrene, vinyltoluene, acrylonitril, vinyl chloride, vinylidene chloride, vinyl acetate, vinyl vinylpropionate, vinyl basetate and the like. These can be used alone or in a combination of two or more. Also, at least one of these monomers can be used in combined with at lease one functional monomers.

The added amount of a monomer copolymerizable with the (meth)acrylic acid ester is desirably up to 90 wt % preferably 30 wt % based on the total weight including (meth)acrylic acid ester. When the amount exceeds 90 wt %, the produced acryl-modified polyorganosiloxane has a poor compatibility to the binder resin.

Also, the added amount of a polyorganosiloxane represented by the formula (I) is preferably larger than the sum of the monomers copolymerizable with the (meth)acrylic acid ester represented by the formula (II) and the (meth)acrylic acid ester considering the slideness and impurity removal of the photoconductor.

According to the present invention, The (meth)acrylic acid ester represented by the formula (II), or a mixture of the (meth)acrylic acid ester or a monomer copolymerizable with the (meth)acrylic acid ester has a glass transition temperature of at least 20° C., preferably at least 30° C. so that the molded article from the composition may have superior slideness and wear resistance.

In the acryl-modified polyorganosiloxane, the weight ratio of a polyorganosiloxane represented by the formula (I) to a (meth)acrylic acid ester represented by the formula (II), or a mixture of the (meth)acrylic acid ester and a monomer copolymerizable with the (meth)acrylic acid ester (polyorganosiloxane represented by the formula (I) to a (meth)acrylic acid ester represented by the formula (II), or a mixture of the (meth)acrylic acid ester and a monomer copolymerizable with the (meth)acrylic acid ester) is 5/95 to 95/5, preferably 51/49 to 95/5, more preferably 65/35 to 95/5. Also, the acryl-modified polyorganosiloxane is preferably prepared by graft copolymerization of the above-described components.

When the used amount of the polyorganosiloxane represented by the formula (I) is out of the foregoing range, the polyorganosiloxane can not sufficiently exhibit its effects in the produced acryl-modified polyorganosiloxane. Also, viscosity which is a peculiar property of an acrylic polymer is increased. When it exceeds the upper limit, the compatibility of the acryl-modified polyorganosiloxane to the binder resin becomes poor, bleeding may occur on the molded article and slideness and wear resistance are deteriorated over time.

The graft copolymerization of the polyorganosiloxane can be carried out using an aqueous emulsion of the polyorganosiloxane in the presence of a conventional initiating agent by a known emulsion polymerization method.

The preparation method of the acryl-modified polyorganosiloxane is also presented in detail in for example, Japanese Patent Publication No. 7-5808 issued to Nissan chemicals Ind., Ltd.

In the preparation of the acryl-modified polyorganosiloxane, impurities such as the lubricant and coagulation agent used during a polymerization process may remain, resulting in image deletion. Particularly, they may impair electrical properties of an electrophotographic photoconductor. Therefore, it is preferred to purify the acryl-modified polyorganosiloxane when needed. By using the purified acryl-modified polyorganosiloxane, the electrophotographic photoconductor becomes excellent in its electrical stability, particularly when repeatedly used. The purification method includes for example, agitation cleaning with aqueous acid and alkali solution, water and alcohol and solid-liquid extraction by a Soxhlet extractor.

A preferable purification method is a agitation cleaning with an alcohol. The cleaning with alcohol is useful to remove ionic components of an acryl-modified polyorganosiloxane by a lubricant and coagulation agent. Examples of alcohols which can be used include methanol, ethanol, isopropanol, etc., methanol being preferred. It is preferred that the cleaning operation is performed at least two times. After cleaning with an alcohol, the acryl-modified polyorganosiloxane is washed with ion exchange water and lyophilized.

Preferably, the acryl-modified polyorganosiloxane purified by the above-described method has a sodium (Na) ion content of 500 ppm or less and a sulfur containing ion content of 800 ppm or less.

In the present invention, the agitation cleaning with hot water, solid-liquid extraction by a Soxhlet extractor and extraction using a fluid in a subcritical to supercritical state may be used for purification of the acryl-modified polyorganosiloxane. However, the present invention does not limited to the above-described methods.

The content of the acryl-modified polyorganosiloxane in the photoconductive layer according to the present invention is preferably up to 30 wt %, more preferably up to 20 wt %, further preferably up to 10 wt %.

When the content exceeds 30 wt %, the surface smoothness of the photoconductor is deteriorate and the residual potential is increased.

Also, in case an inorganic filler or a high molecular charge transport material is contained, the content of the acryl-modified polyorganosiloxane in the photoconductive layer is preferably up to 40 wt %, more preferably up to 20 wt %. When the content exceeds 40 wt %, the surface smoothness of the photoconductor is deteriorate and the residual potential is increased.

The method of adding the acryl-modified polyorganosiloxane into a resin includes for example, agitation in a commonly used solvent, ball milling, vibration milling, high-pressure liquid collision, and sonication. Also, there is a method of mechanically mixing the components using a known mixing apparatus such as Banbury mixer, roll mill, twin screw extruder to form pellets. The pellets formed by extrusion are molded at a temperature in a wide range. For molding, a conventional injection molding apparatus may be used. The pelletized modified polyorganosiloxane and resin may be further subjected to the above-described dispersion methods. Among them, preferred is the high-pressure liquid collision method in which particles of the acryl-modified polyorganosiloxane is subjected to a high pressure with at least one of a solvent and a binder and crushed and dispersed by liquid impact under the elevated pressure, thereby being dispersed as a particle phase in the solvent and/or binder. By this method, the acryl-modified polyorganosiloxane particles are simultaneously divided into a smaller size and homogeneously dispersed, resulting in increase of the added amount. Further, it is possible to attain the continuous low frictional properties. According to the high-pressure liquid collision method, fluid is transported into a micro tubing by a high pressure. In the micro tubing, the high-pressure fluid collision crushes and disperses an object to be dispersed. An apparatus provided with a high-pressure pump, a zig having a plurality of orifices with a micro diameter and another zig adapted to collide the fluids ejected out from the respective orifices with each other can be used. Here, the "high-pressure" is determined considering the ejection amount of the high-pressure pump, ejection pressure, system and length of the orifices and viscosity of the subject to be dispersed and is preferably 10 to 300 Mpa, more preferably 50 to 150 Mpa.

The condition of the dispersed particles may be examined by the surface roughness of the photoconductive layer Representative examples of the commercially available acryl-modified polyorganosiloxane which can be used in the present invention include for example, CHALINE R-170 S, R-170, NR-150, NR-130, R-120, etc., produced by NISSIN CHEMICAL INDUSTRY CO., LTD and X-22-8084, X-22-8171 produced by SHIN-ETSU CHEMICAL CO., LTD.

Other Components

Other components which can be contained in the photoconductive layer include for example, a charge generation material, a charge transport material, a high molecular charge transport material, and an inorganic filler.

In particular, according to the present invention, the inorganic filler is contained at the top surface layer of the photoconductive layer to prevent the photoconductive layer from being worn and to increase the hardness of the photoconductive layer. Typically, when the inorganic filler is added, generation of residual potential by charge trapping and increase in light portion potential during are caused, particularly during repeated use. If a resin or finely-divided particles as an additive is added, more increase in the potential may be caused, resulting in a photoconductor with a little potential contrast, and consequently, abnormal images are formed. However, the acryl-modified polyorganosiloxane according to the present invention does not increase the potential even when added in a large amount. Therefore, it can provide an organic photoconductor with stable in electrical properties. Further, since the high molecular charge transport material is contained in the top surface layer of the photoconductive layer, fingerprint resistance can be improved.

It is believed that this is because of the following reasons, though it is not clear. That is, abrasion of the electrophotographic photoconductor is determined the interaction between supplement of the inorganic filler with a high hardness and mechanical strength of the media support the filler. Therefore, the wear resistance of the entire film can be enhanced when the mechanical strength of the high molecular charge transport material per se, the adhesion of the high molecular charge transport material with an inorganic filler, the mechanical strength of the inorganic filler per se, the adhesion of the acryl-modified polyorganosiloxane particles and the high molecular charge transport material are balanced as a whole. Also, since the organosiloxane structure in the acryl-modified polyorganosiloxane is partially exposed at the surface of the photoconductor, attachment of impurities is inhibited as well as improvement of slideness and reduction of surface energy.

Therefore, by using these material according to the present invention, wear resistance of the photoconductor is improved and cleaning characteristics can be maintained even after repetitive use. Accordingly, there can be provided an electrophotographic photoconductor which has a good fingerprint resistance and is capable of producing high quality images with without image abnormality due to filming or defective cleaning, decrease of the electrostatic potential and increase of the residual potential.

As the high molecular charge transport material, any material known from the prior art can be used. For example, materials described in Japanese Patent Laid-Open No. 51-73888, Japanese Patent Laid-Open No. 54-8527, Japanese Patent Laid-Open No. 54-11737, Japanese Patent Laid-Open No. 56-150749, Japanese Patent Laid-Open No. 57-78402, Japanese Patent Laid-Open No. 63-285552, Japanese Patent Laid-Open No. 64-1728, Japanese Patent Laid-Open No. 64-13061, Japanese Patent Laid-Open No. 64-19049, Japanese Patent Laid-Open No. 3-50555, Japanese Patent Laid-Open No. 4-225014, Japanese Patent Laid-Open No. 4-230767, Japanese Patent Laid-Open No. 5-232727, Japanese Patent Laid-Open No. 5-310904 can be used.

Also, as the high molecular charge transport material, any known charge transporting polymer having a triarylamine structure can be used. Examples of such polymers include for example, acetophenone derivatives (Japanese Patent Laid-Open No. 8-269183), distyryl benzene derivatives (Japanese Patent Laid-Open No. 9-71642), diphenetyl benzene derivatives (Japanese Patent Laid-Open No. 9-104746), α-phenylstilbene derivatives (Japanese Patent Laid-Open No. 9-272735 and Japanese Patent Laid-Open 2000-314973), butadiene derivatives (Japanese Patent Laid-Open No. 9-235367), hydrogenated butadiene derivatives (Japanese Patent Laid-Open No. 9-87376), diphenylcyclohexane derivatives (Japanese Patent Laid-Open No. 9-110976), distyryltriphenylamine derivatives (Japanese Patent Laid-Open No. 9-268226), distyryldiamine derivatives (Japanese Patent Laid-Open No. 11-60718), diphenyldistyrylbenzene derivatives (Japanese Patent Laid-Open No. 9-221544 and Japanese Patent Laid-Open No. 9-227669), stilbene derivatives (Japanese Patent Laid-Open No. 9-157378 and Japanese Patent Laid-Open No. 11-71453), m-phenylenediamine derivatives (Japanese Patent Laid-Open No. 9-302084 and Japanese Patent Laid-Open No. 9-302085), resorcin derivatives (Japanese Patent Laid-Open No. 9-328539), fluorene derivatives (Japanese Patent Laid-Open No. 11-5836) and phenoxystilbene derivatives (Japanese Patent Laid-Open No. 11-71453).

Also, as the high molecular charge transport material, polycarbonate resins having a triarylamine structure can be used. For example, resins described in specifications of U.S. Pat. Nos. 4,801,517, 4,806,443, 4,806,444, 4,937,165, 4,959,288, 5,030,532, 5,034,296, 5,080,989, and Japanese Patent Laid-Open No. 64-9964, Japanese Patent Laid-Open No. 3-221522, Japanese Patent Laid-Open No. 2-304456, Japanese Patent Laid-Open No. 4-11627, Japanese Patent Laid-Open No. 4-175337, Japanese Patent Laid-Open No. 4-18371, Japanese Patent Laid-Open No. 4-31404 and Japanese Patent Laid-Open No. 4-133065 can be used. Among them, preferred examples are compounds having the following formulae.

(i) High molecular charge transport materials comprising a unit represented by the following formula (D) and a unit represented by the following formula (B), in which the compositional ratio (k) of the unit represented by the formula (D) and the compositional ratio (j) of the unit represented by the formula (B) satisfy $0<k/(k+j)\leqq 1$.

Formula (D)

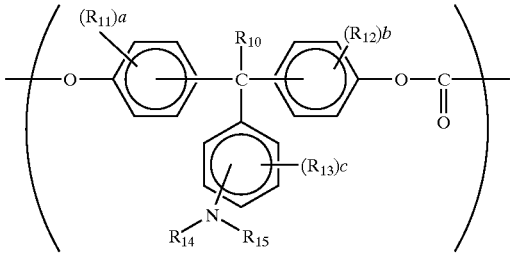

In the formula (D):

$R_{10}$ is a hydrogen atom or a substituted or unsubstituted alkyl group having 1 to 6 carbon atoms;

$R_{11}$, $R_{12}$ and $R_{13}$ are a halogen atom or a substituted or unsubstituted alkyl group having 1 to 6 carbon atoms, provided that $R_{11}$, $R_{12}$ and $R_{13}$ may be identical or different, when they are present in many numbers;

$R_{14}$ and $R_{15}$ are a substituted or unsubstituted aryl group; and a, b and c is independently a integer of 0 to 4.

Formula (B)

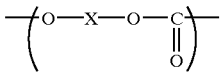

In the formula (B): X is a substituted or unsubstituted divalent aliphatic hydrocarbon group having 2 to 20 carbon atoms, a substituted or unsubstituted divalent cycloaliphatic hydrocarbon group, a substituted or unsubstituted divalent aromatic hydrocarbon group having 6 to 20 carbon atoms, a divalent group combined with the forgoing groups combined or at least any one represented by the formulae (a) to (c).

Formula (a)

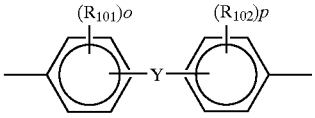

Formula (b)

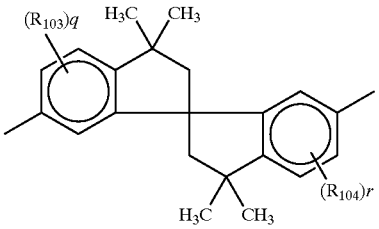

-continued

Formula (c)

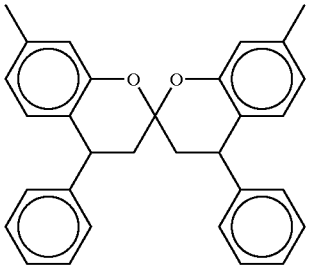

In the formulae (a) to (c):

$R_{101}$, $R_{102}$, $R_{103}$ and $R_{104}$ are a halogen atom, a substituted or unsubstituted alkyl group having 1 to 6 carbon atoms or a substituted or unsubstituted aryl group, provided that $R_{101}$, $R_{102}$, $R_{103}$ and $R_{104}$ may be identical or different when they are present in may numbers;

o and p are independently an integer of 0 to 4;

q and r are independently an integer of 0 to 3; and

Y is a single bond, a straight-chained alkylene group having 2 to 12 carbon atoms, a branched substituted or unsubstituted alkylene group having 3 to 12 carbon atoms, at least one alkylene group having 1 to 10 carbon atoms, a divalent group containing at least one oxygen atom and sulfur atom, —O—, —S—, —SO—, —$SO_2$—, —CO—, —COO— or a divalent group represented by at least any one of the following formulae (d) to (m).

Formula (d)

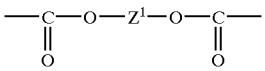

Formula (e)

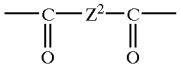

Formula (f)

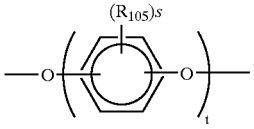

Formula (g)

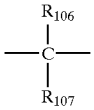

Formula (h)

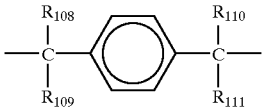

Formula (i)

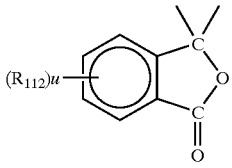

Formula (j)

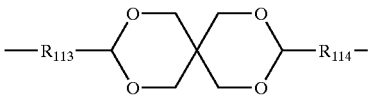

-continued

Formula (k)

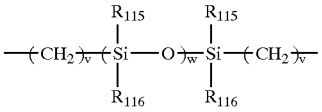

Formula (l)

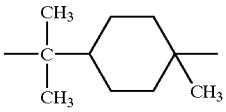

Formula (m)

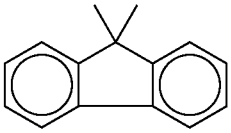

In the formula (d) to (m)

$Z_1$ and $Z_2$ are a substituted or unsubstituted divalent aliphatic hydrocarbon group having 2 to 20 carbon atoms or a substituted or unsubstituted arylene group, provided that $Z_1$ and $Z_2$ may be identical or different;

$R_{105}$ is a halogen atom, a substituted or unsubstituted alkyl group having 1 to 6 carbon atoms, a substituted or unsubstituted alkoxy group having 1 to 6 carbon atoms or a substituted or unsubstituted aryl group;

$R_{106}$ and $R_{107}$ are a hydrogen atom, a halogen atom, a substituted or unsubstituted alkyl group having 1 to 6 carbon atoms, a substituted or unsubstituted alkoxy group having 1 to 6 carbon atoms or a substituted or unsubstituted aryl group, or $R_{106}$ and $R_{107}$ may bond together to from a cyclic carbon having 5 to 12 carbon atoms;

$R_{108}$, $R_{109}$, $R_{110}$ and $R_{111}$ are a hydrogen atom, a halogen atom, a substituted or unsubstituted alkyl group having 1 to 6 carbon atoms, a substituted or unsubstituted alkoxy group having 1 to 6 carbon atoms or a substituted or unsubstituted aryl group;

$R_{112}$ is a halogen atom, a substituted or unsubstituted alkyl group having 1 to 6 carbon atoms, a substituted or unsubstituted alkoxy group having 1 to 6 carbon atoms or a substituted or unsubstituted aryl group;

$R_{113}$ and $R_{114}$ are a single bond or an alkylene group having 1 to 4 carbon atoms;

$R_{115}$ and $R_{116}$ are independently, a substituted or unsubstituted alkyl group having 1 to 6 carbon atoms or a substituted or unsubstituted aryl group;

s is an integer of 0 to 4;

t is an integer of 1 or 2;

u is an integer of 0 to 4;

v is an integer of 0 to 20; and w is an integer of 0 to 2000.

Specific examples of respective substituents are described below. Unless indicated otherwise, the same symbol has the same definition in a different formula.

In the formula (D), as a substituent $R_{10}$, the substituted or unsubstituted alkyl group having 1 to 6 carbon atoms includes straight-chained, branched or cyclic alkyl groups in which the alkyl group may be substituted a fluorine atom, cyano group, phenyl group or a phenyl group substituted with a halogen atom or straight-chained, branched or cyclic alkyl groups having 1 to 6 carbon atoms.

Specifically, it includes methyl group, ethyl group, n-propyl group, i-propyl group, t-butyl group, s-butyl group, n-butyl group, i-butyl group, trifluoromethyl group, 2-cyanoethyl group, benzyl group, 4-chlorobenzyl group, 4-methylbenzyl group, cyclopentyl group, cyclohexyl group and the like.

The halogen atom, as the substituents $R_{11}$, $R_{12}$ and $R_{13}$ includes fluorine atom, chlorine atom, bromine atom and iodine atom.

Specific examples of the substituted or unsubstituted aryl group (aromatic hydrocarbon group and unsaturated heterocyclic group), as the substituent of $R_{14}$ and $R_{15}$ which may be identical or different, are as follows; aromatic hydrocarbon groups such as phenyl group; condensed polycyclic groups such as naphthyl group, naphtyl group, pyrenyl group, 2-fluorenyl group, 9,9-dimethyl-2-fluorenyl group, azulenyl group, anthryl group, triphenylenyl group, glycenyl group, fluorenylidene phenyl group and 5H-dibenzo[a,d] cycloheptenylidene phenyl group; non-condensed polycyclic group such as biphenyl group, terphenyl group; and divalent groups represented by the formula (o).

Formula (o)

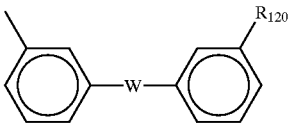

In the formula (o), W is selected from —O—, —S—, —SO—, —SO_—, —CO—, and divalent groups represented by the following formula (p).

Formula (p)

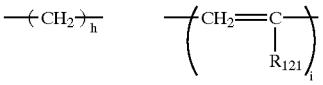

In the formula (o), $R_{120}$ is a hydrogen atom, a substituted or unsubstituted alkyl group having 1 to 6 carbon atoms, a substituted or unsubstituted alkoxy group having 1 to 6 carbon atoms, a halogen atom, a substituted or unsubstituted aryl group, a substituted or unsubstituted arylamino group, nitro group, or cyano group.

In the formula (p), $R_{121}$ is a hydrogen atom, a substituted or unsubstituted alkyl group having 1 to 6 carbon atoms, or a substituted or unsubstituted aryl group; h is an integer of 1 to 12; and i is an integer of 1 to 3.

The unsaturated heterocyclic group includes thienyl group, benzothienyl group, furyl group, benzofuranyl group, carbazolyl group and the like. The aryl group may be substituted with a group described in the following (1) to (7).

(1) halogen atom, trifluoromethyl group, cyano group, nitro group.

(2) substituted or unsubstituted alkyl groups having 1 to 6 carbon atoms.

(3) substituted or unsubstituted alkoxy groups having 1 to 6 carbon atoms (substituted or unsubstituted alkoxy group having 1 to 6 carbon atoms includes those described for alkyl group but the alkyl group in the definition is changed into alkoxy group, that is, methoxy group, ethoxy group, n-propoxy group, i-propoxy group, n-butoxy group, i-butoxy group, s-butoxy group, t-butoxy group, 2-hydroxyethoxy group, 2-cyanoethoxy group, benzyloxy group, 4-methylbenzyloxy group, trifluoromethoxy group and the like).

(4) aryloxy groups such as those having an aryl group including phenyl group, naphtyl group and the like and which may be substituted with a substituted or unsubstituted alkyl group having 1 to 6 carbon atoms, a substituted or unsubstituted alkoxy group having 1 to 6 carbon atoms, or a halogen atom. Specific examples include phenoxy group, 1-naphtyloxy group, 2-naphtyloxy group, 4-methylphenoxy group, 4-methoxy phenoxy group, 4-chlorophenoxy group, 6-methyl-2-naphtyloxy group and the like.

(5) substituted mercapto group or arylmercapto group. Specific examples include methylthio group, ethylthio group, phenylthio group, p-methylphenylthio group and the like.

(6) alkyl substituted amino group. Specific examples diethylamino group, N-methyl-N-phenylamino group, N,N-diphenylamino group, N,N-di(p-tolyl)amino group, dibenzyl amino group, piperidino group, morphorino group, julolidzl group and the like.

(7) acyl group. Specific examples include acetyl group, propionyl group, butyryl group, malonyl group, benzoyl group and the like.

Also, as the substituent X in the formula (B), the substituted or unsubstituted divalent aliphatic hydrocarbon group having 2 to 20 carbon atoms and substituted or unsubstituted divalent cycloaliphatic hydrocarbon group includes for example, divalent groups of ethylene glycol, diethylene glycol, triethylene glycol, poly ethylene glycol, poly tetramethylene glycol, 1,3-propanediol, 1,4-butanediol, 1,5-pentanediol, 3-methyl-1,5-pentanediol, 1,6-hexanediol, 1,5-hexanediol, 1,7-heptanediol, 1,8-octanediol, 1,9-nonane diol, 1,10-decanediol, 1,11-undecanediol, 1,12-dodecanediol, neopentyl glycol, 2-ethyl-1,6-hexanediol, 2-methyl-1,3-propanediol, 2-ethyl-1,3-propanediol, 2,2-dimethyl-1,3-propanediol, 1,3-cyclohexanediol, 1,4-cyclohexanediol, cyclohexane-1,4-dimethaneol, 2,2-bis(4-hydroxycyclohexyl)propane, xylenediol, 1,4-bis(2-hydroxyethyl)benzene, 1,4-bis(3-hydroxypropyl)benzene, 1,4-bis(4-hydroxybutyl)benzene, 1,4-bis(5-hydroxypentyl) benzene, 1,4-bis(6-hydroxyhexyl)benzene, isoporonediol and the like, in which two hydroxy groups are eliminated.

As the substituent X in the formula (B), the substituted or unsubstituted divalent aromatic group having 6 to 20 carbon atoms includes divalent groups derived from the above substituted or unsubstituted aryl groups and the substituted or unsubstituted alkylene group includes divalent groups derived from the above substituted or unsubstituted alkyl groups.

As the substituent Y in the formula (a), the divalent group comprising at least one alkylene groups having 1 to 10 carbon atoms and at least one oxygen atoms and sulfur atoms includes for example, $OCHCH_2O$, $OCH_2CH_2OCH_2CH_2O$, $OCH_2CH_2O$ $CH_2CH_2OCH_2CH_2O$, $OCH_2CH_2CH_2O$, $OCH_2CH_2CH_2CH_2$, $OCH_2CH_2CH_2CH_2CH_2CH_2O$, $OCH_2CH_2CH_2CH_2CH_2CH_2CH_2O$, $CH_2O$, $CH_2CH_2O$, CHEtOCHEtO, $CHCH_3O$, $SCH_2OCH_2S$, $CH_2OCH_2$, $OCH_2OCH_2O$, $SCH_2CH_2OCH_2OCH_2CH_2S$, $OCH_2CHCH_3OCH_2CHCH_3O$, $SCH_2S$, $SCH_2CH_2S$, $SCH_2CH_2CH_2S$, $SCH_2CH_2CH_2CH_2S$, $SCH_2CH_2CH_2CH_2CH_2CH_2S$, $SCH_2CH_2SCH_2CH_2S$, $SCH_2CH_2OCH_2CH_2OCH_2CH_2S$ and the like, but is not limited thereto.

The branched alkylene group having 3 to 12 carbon atoms may a substituted or unsubstituted aryl group, a halogen atom and the like.

As the substituents $Z_1$ and $Z_2$ in the formulae (g) and (h), the substituted or unsubstituted divalent aliphatic group includes the aliphatic divalent groups of X and divalent group derived from diol via elimination of two hydroxy groups as divalent cycloaliphatic groups Also, as the substituents $Z_1$ and $Z_2$, the substituted or unsubstituted allylene group includes divalent groups derived from the substituted or unsubstituted aryl groups.

Preferably, in the formula (B), X is aromatic divalent group. Preferred examples include divalent groups derived from diols such as bis(4-hydroxyphenyl)methane, bis(2-methyl-4-hydroxyphenyl)methane, bis(3-methyl-4-hydroxyphenyl)methane, 1,1-bis <4-hydroxyphenyl> ethane, 1,2-bis(4-hydroxyphenyl)ethane, bis(4-hydroxyphenyl)phenylmethane, bis(4-hydroxyphenyl) diphenylmethane, 1,1-bis(4-hydroxyphenyl)-1-phenylthane, 1,3-bis(4-hydroxyphenyl)-1,1-dimethylpropane, 2,2-bis(4-hydroxyphenyl)propane, 2-(4-hydroxyphenyl)-2-(3-hydroxyphenyl)propane, 1,1-bis(4-hydroxyphenyl)-2-methylpropane, 2,2-bis(4-hydroxyphenyl)butane, 1,1-bis(4-hydroxyphenyl)-3-methylbutane, 2,2-bis(4-hydroxyphenyl) pentane, 2,2-bis(4-hydroxyphenyl)-4-methylpentane, 2,2-bis(4-hydroxyphenyl)hexane, 4,4-bis(4-hydroxyphenyl) heptane, 2,2-bis(4-hydroxyphenyl)noane, bis (3,5-dimethyl-4-hydroxyphenyl)methane, 2,2-bis(3-methyl-4-hydroxyphenyl)propane, 2,2-bis(3-propyl-4-hydroxyphenyl)propane, 2,2-bis(3-sec-butyl-4-hydroxyphenyl)propane, 2,2-bis(3-tert-butyl-4-hydroxyphenyl)propane, 2,2-bis(3-cyclohexyl-4-hydroxyphenyl)propane, 2,2-bis(3-allyl-4-hydroxyphenyl) propane, 2,2-bis(3-phenyl-4-hydroxyphenyl)propane, 2,2-bis(3,5-dimethyl-4-hydroxyphenyl)propane, 2,2-bis(3-chloro-4-hydroxyphenyl)propane, 2,2-bis(3,5-dichloro-4-hydroxyphenyl)propane, 2,2-bis(3-bromo-4-hydroxyphenyl)propane, 2,2-bis(3,5-bromo-4-hydroxyphenyl)propane, 2,2-bis(4-hydroxyphenyl) hexafluoropropane, 1,1-bis(4-hydroxyphenyl)cyclopentane, 1,1-bis(4-hydroxyphenyl)cyclohexane, 1,1-bis(3-methyl-4-hydroxyphenyl)cyclohexane, 1,1-bis(3,5-dimethyl-4-hydroxyphenyl)cyclohexane, 1,1-bis(3,5-dichloro-4-hydroxyphenyl)cyclohexane, 1,1-bis(4-hydroxyphenyl)-3,3,5-trimethylcyclohexane, 1,1-bis(4-hydroxyphenyl) cycloheptane, 2,2-bis(4-hydroxyphenyl)norbornane, 2,2-bis (4-hydroxyphenyl)adamantane, 4,4'-dihydroxydiphenylether, 4,4'-dihydroxy-3,3'-dimethyldiphenylether, ethylene glycolbis(4-hydroxyphenyl)ether, 1,3-bis(4-hydroxyphenoxy)benzene, 1,4-bis (3-hydroxyphenoxy) benzene, 4,4'-dihydroxydiphenylsulfide, 3,3'-dimethyl-4,4'-dihydroxydiphenylsulfide, 3,3',5,5'-tetramethyl-4,4'-dihydroxydiphenylsulfide, 4,4'-dihydroxydiphenylsulfoxide, 3,3'-dimethyl-4,4'-dihydroxydiphenylsulfoxide, 4,4'-dihydroxydiphenylsulfone, 3,3'-dimethyl-4,4'-dihydroxydiphenylsulfone, 3,3'-diphenyl-4,4'-dihydroxydiphenylsulfone, 3,3'-dichloro-4,4'-dihydroxydiphenylsulfone, bis(4-hydroxyphenyl)ketone, bis(3-methyl-4-hydroxyphenyl)ketone, 3,3,3',3'-tetramethyl-6,6'-dihydroxyspiro(bis)indane, 3,3',4,4'-tetrahydro-4,4,4',4'-tetramethyl-2,2'-spirobi(spirobi)(2H-1-benzopyran)-7,7'-diol, trans-2,3-bis(4-hydroxyphenyl)-2-butene, 9,9-bis(4-hydroxyphenyl)fluorene, 9,9-bis(4-hydroxyphenyl)xantene, 1,6-bis(4-hydroxyphenyl)-1,6-hexanedione, α,α,α',α'-tetramethyl-α,α'-bis(4-hydroxyphenyl)-p-xylene, α,α,α',α'-tetramethyl-α,α'-bis(4-hydroxyphenyl)-m-xylene, 2,6-dihydroxydibenzo-p-dioxine, 2,6-dihydroxythianthrene, 2,7-dihydroxyphenoxathiin, 9,10-dimethyl-2,7-dihydroxyphenazine, 3,6-dihydroxydibenzofuran, 3,6-dihydroxydibenzothiophene, 4,4'-dihydroxybiphenyl, 1,4-dihydroxynaphtalene, 2,7-dihydroxypyrene, hydroquinone, resorcin, 4-hydroxyphenyl-4-hydroxybenzoate, ethylene glycol-bis(4-hydroxybenzoate), diethylene glycol-bis(4-hydroxybenzoate), triethylene glycol-bis(4-hydroxybenzoate), p-phenylene-bis(4-hydroxybenzoate), 1,6-bis(4-hydroxybenzoyloxy)-1H,1H,6H,6H-fluorohexane, 1,4-bis(4-hydroxybenzoyloxy)-1H,1H,4H,4H-perfluorobutane, 1,3-bis(4-hydroxyphenyl) tetramethyldisiloxane by eliminating two hydroxy groups.

(ii) High molecular charge transport materials comprising a unit represented by the following formula (A) and a unit represented by the following formula (B), in which the compositional ratio (k) of the unit represented by the formula (A) and the compositional ratio (j) of the unit represented by the formula (B) satisfy $0<k/(k+j)\leqq 1$.

Formula (A)

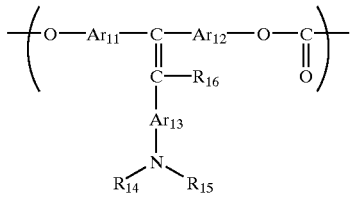

In the formula (A):

$R_{16}$ is a hydrogen atom, a substituted or unsubstituted alkyl group having 1 to 6 carbon atoms or a substituted or unsubstituted aryl group;

$Ar_{11}$, $Ar_{12}$ and $Ar_{13}$ are a substituted or unsubstituted arylene group; and $R_{14}$ and $R_{15}$ are a substituted or unsubstituted aryl group.

(iii) High molecular charge transport materials comprising a unit represented by the following formula (E) and a unit represented by the aforementioned formula (B), in which the compositional ratio (k) of the unit represented by the formula (E) and the compositional ratio (j) of the unit represented by the formula (B) satisfy $0<k/(k+j)\leqq 1$.

Formula (E)

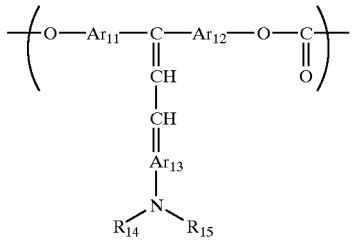

In the formula (E), $R_{14}$, $R_{15}$, $Ar_{11}$, $Ar_{12}$ and $Ar_{13}$ are the same as defined above.

(iv) High molecular charge transport materials comprising a unit represented by the following formula (F) and a unit represented by the aforementioned formula (B), in which the compositional ratio (k) of the unit represented by the formula (F) and the compositional ratio (j) of the unit represented by the formula (B) satisfy $0<k/(k+j)\leqq 1$.

Formula (F)

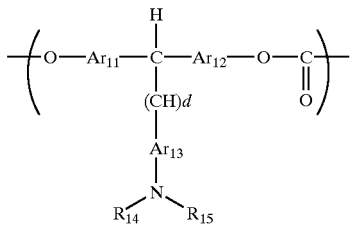

In the formula (F), d is an integer of 1 to 5, and $R_{14}$, $R_{15}$, $Ar_{11}$, $Ar_{12}$ and $Ar_{13}$ are the same as defined above.

(v) High molecular charge transport materials comprising a unit represented by the following formula (G) and a unit represented by the aforementioned formula (B), in which the compositional ratio (k) of the unit represented by the formula (G) and the compositional ratio (j) of the unit represented by the formula (B) satisfy $0<k/(k+j)\leqq 1$.

Formula (G)

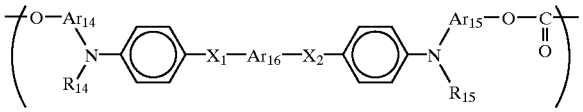

In the formula (G), Ar11, Ar12 and Ar13 are a substituted or unsubstituted arylene group, X1 and X2 are substituted or unsubstituted vinylene group and R14 and R15 are the same as defined above.

(vi) High molecular charge transport materials comprising a unit represented by the following formula (H) and a unit represented by the aforementioned formula (B), in which the compositional ratio (k) of the unit represented by the formula (H) and the compositional ratio (j) of the unit represented by the formula (B) satisfy $0<k/(k+j)\leqq 1$.

Formula (H)

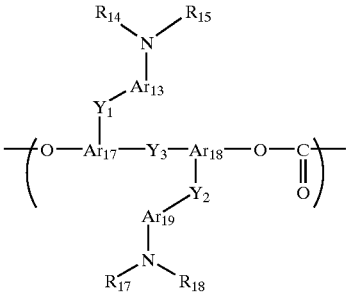

In the formula (H), R17 and R18 are a substituted or unsubstituted allylene group, Y1, Y2 and Y3 are a single bond, a substituted or unsubstituted alkylene group, a substituted or unsubstituted cycloalkylene group, a substituted or unsubstituted alkylenether group, an oxygene atom, sulfur atom, vinylene group and may be identical or different, and R14, R15 and Ar13 are the same as defined above.

(vii) High molecular charge transport materials comprising a unit represented by the following formula (I) and a unit represented by the aforementioned formula (B), in which the compositional ratio (k) of the unit represented by the formula (I) and the compositional ratio (j) of the unit represented by the formula (B) satisfy $0<k/(k+j)\leqq 1$.

Formula (I)

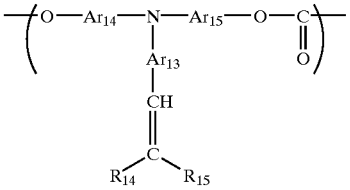

In the formula (I), $R_{14}$, $R_{15}$, $Ar_{11}$, $Ar_{12}$ and $Ar_{13}$ are the same as defined above.

(viii) High molecular charge transport materials comprising a unit represented by the following formula (J) and a unit represented by the aforementioned formula (B), in which the compositional ratio (k) of the unit represented by the formula (J) and the compositional ratio (j) of the unit represented by the formula (B) satisfy $0<k/(k+j)\leqq 1$.

Formula (J)

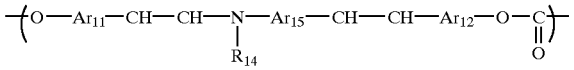

In the formula (J), and $R_{14}$, $Ar_{21}$, $Ar_{22}$, $Ar_{24}$ and $Ar_{25}$ are the same as defined above.

(ix) High molecular charge transport materials comprising a unit represented by the following formula (K) and a unit represented by the aforementioned formula (B), in which the compositional ratio (k) of the unit represented by the formula (K) and the compositional ratio (j) of the unit represented by the formula (B) satisfy $0<k/(k+j)\leqq 1$.

Formula (K)

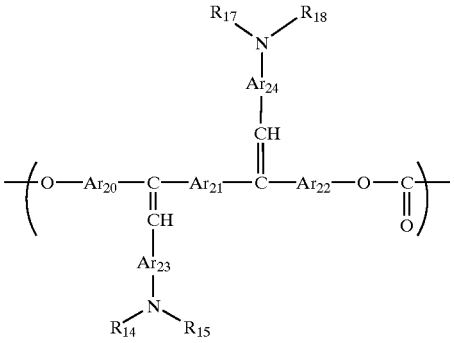

In the formula (K), Ar20, Ar21, Ar22, Ar23 and Ar24 are substituted or unsubstituted alkylene group and $R_{14}$, $R_{15}$, $R_{16}$ and $R_{17}$ are the same as defined above.

(x) High molecular charge transport materials comprising a unit represented by the following formula (L) and a unit represented by the aforementioned formula (B), in which the compositional ratio (k) of the unit represented by the formula (L) and the compositional ratio (j) of the unit represented by the formula (B) satisfy $0<k/(k+j)\leqq 1$.

Formula (L)

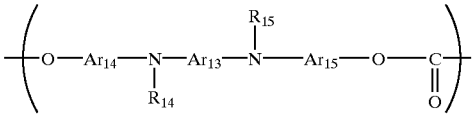

In the formula (F), $R_{14}$, $R_{15}$, $Ar_{13}$, $Ar_{14}$ and $Ar_{15}$ are the same as defined above.

(xi) High molecular charge transport materials comprising a unit represented by the following formula (M) and a unit represented by the aforementioned formula (B), in which the compositional ratio (k) of the unit represented by the formula (M) and the compositional ratio (j) of the unit represented by the formula (B) satisfy $0<k/(k+j)\leqq 1$.

Formula (M)

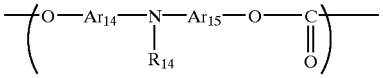

In the formula (M), $R_{14}$, $Ar_{14}$ and $Ar_{15}$ are the same as defined above.

(xii) High molecular charge transport materials comprising a unit represented by the following formula (N) and a unit represented by the aforementioned formula (B), in which the compositional ratio (k) of the unit represented by the formula (N) and the compositional ratio (j) of the unit represented by the formula (B) satisfy $0<k/(k+j)\leqq 1$.

Formula (N)

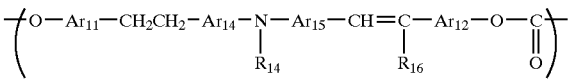

In the formula (N), R14, R16, Ar11, Ar12, Ar14 and Ar15 are the same as defined above.

(xiii) High molecular charge transport materials comprising a unit represented by the following formula (C) and a unit represented by the aforementioned formula (B), in which the compositional ratio (k) of the unit represented by the formula (C) and the compositional ratio (j) of the unit represented by the formula (B) satisfy $0<k/(k+j)\leqq 1$.

Formula (C)

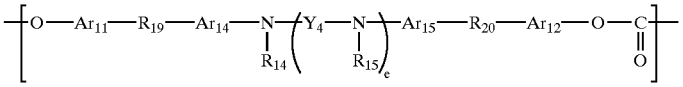

In the formula (C), $R_{19}$ and $R_{20}$ are a straight-chained or branched alkylene group, $Y_4$ is a substituted or unsubstituted arylene group or —$Ar_{25}$—$Y_5$—$Ar_{25}$—, in which $Ar_{14}$, $Ar_{15}$ and $Ar_{25}$ are a substituted or unsubstituted arylene group and $Y_5$ is O, S or a substituted or unsubstituted arylene group, and e is 0 or 1, $R_{14}$, $R_{15}$, $Ar_{11}$, and $Ar_{12}$ are the same as defined above.

Among the foregoing, the high molecular charge transport material comprising a unit represented by the formula (A) and a unit represented by the formula (C) is particularly preferred. The unit component represented by the formula (A) is excellent in its mechanical strength and charge transport properties and can balance interactions between the components in the dispersion of the inorganic filler and acryl-modified polyorganosiloxane particles. Accordingly, it can provide a electrophotographic photoconductor which has superior electrophotographic properties such as a high wear resistance and good slideness without generation of residual potential and reduction of sensitivity.

Also, the high molecular charge transport material comprising a unit represented by the formula (C) is particularly excellent in its mechanical strength and balancing with charge transport properties and can keep a balance of interactions between the components in the dispersion of the inorganic filler and acryl-modified polyorganosiloxane particles. Accordingly, it can provide a electrophotographic photoconductor which has superior electrophotographic properties such as a high wear resistance and good slideness without generation of residual potential and reduction of sensitivity.

As such high molecular charge transport material, material having a weight average molecular weight converted into polystyrene of at least 50,000 is preferred considering the several properties.

The inorganic filler used according to the present invention includes for example, metal powders such as copper, tin, aluminum, indium and the like; metal oxides such silica, tin oxide, zinc oxide, titanium oxide alumina, zirconium oxide, indium oxide, antimony oxide, bismuth oxide, calcium oxide, tin oxide doped with antimony, indium oxide doped with tin and the like; metal fluorides such tin fluoride, calcium fluoride, aluminum fluoride and the like; potassium titanate, boron nitride, and the like. Among them, in terms of filler's hardness, the inorganic fillers of inorganic pigments are advantageously used.

Also, these fillers may be surface-treated with at least one surface-treating agent, which is preferable in terms of dispersion properties of the inorganic filler. Poor dispersion properties of the inorganic filler cause decreased transparency of coated film and formation of film defects as well as increase of residual potential. Furthermore, it may deteriorate wear resistance of the coated film and thus develop into serious problems impeding high durability or image quality.

As the surface-treating agent, though any one commonly used in the prior art can be used, a surface-treating agent which can maintain the insulation of the inorganic filler is preferred. For example, the inorganic filler may be preferably treated with titanate type coupling agents, aluminum type coupling agents, zircoaluminate type coupling agents, high molecular fatty acid or a combination thereof with a silane coupling agents, $Al_2O_3$, $TiO_2$, $ZrO_2$, silicone, aluminum stearate or a combination thereof in terms of dispersibility of the inorganic filler and haziness of image.

The treatment with silane coupling agents alone may increase haziness of image. However, such effect can be avoided by carrying out the treatment with a combination of a silane coupling agent and another foregoing coupling agents. The used amount of the surface treating agent is preferably 3 to 30 wt %, more preferably 5 to 20 wt %, though it varies depending on the average primary particle size of used inorganic filler. When the amount of the surface treating agent is less than the forgoing range, the dispersibility of the inorganic filler is poor. When it exceeds the forgoing range, residual potential increases significantly.

Solvents which can be used according to the present invention are tetrahydrofuran, dioxane, toluene, dichloromethane, monochlorobenzene, dichloroethane, cyclohexanone, methylethylketone, acetone, etc, including any one which can be used in the charge transport layer described later. However, for dispersion, a solvent with a high viscosity is preferred and for coating, a solvent with a high volatility is preferred. If there is no solvent satisfying such requirements, two or more solvents each of which satisfies such requirements may be mixed together so as to favorably affect dispersibility of the inorganic filler and residual potential.

The dispersion of the inorganic filler can be carried out by using ball mil, attractor, sand mill, sonification methods known to the art. Among them, the ball mill dispersion is particularly preferred since impurities are seldom introduced from the outside. As a medium, any one conventionally used such as zirconia, alumina, mano, etc. can be used.

The average primary particle size of the inorganic filler is preferably 0.01 to 0.6 $\mu$m in terms of light transmission and wear resistance of the photoconductive layer.

When the average primary particle size of the inorganic filler is less than 0.01 $\mu$m, the wear resistance and dispersibility of the filler are lowered. When it exceeds 0.6 $\mu$m, the filler may have an increased tendency to settle down or filming of toner may occur.

The photoconductive layer may further comprises an organic filler in addition to the acryl-modified polyorganosiloxane and the inorganic filler. The organic filler which can be used includes for example, fluorine-containing resin powders such as polytetrafluoroethylene, silicone resin powders, a-carbon powders, etc.

Further, in the photoconductive layer, a leveling agent such as silicone oil, antioxidant, filler dispersing agent, etc., as described below, may be added. The antioxidant which can be used is any known material. For example, a compound having both hindered amine structure and hindered phenol structure, represented by the following formula (q).

Formula (q)

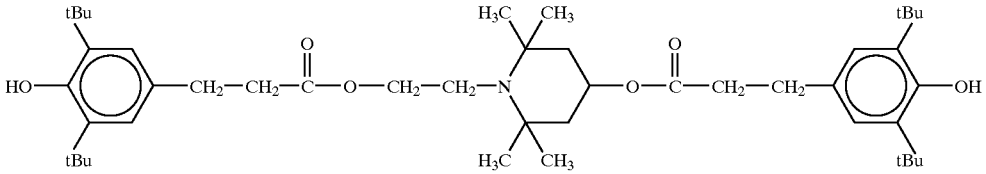

The filler dispersing agent which can be used is any known material, preferably, an organic compound having a structure in which at least one carboxyl group is contained in the polymer or copolymer, particularly preferably polycarboxylic acid derivative. In the dispersing agent, the carboxylic acid part plays very important role of providing acidity and increasing dispersibility. Hydrophilic inorganic filler typically has a low affinity to organic solvents or high molecular charge transport materials and is thus hardly dispersed in such solvents and material them by any dispersing means.

However, since the dispersing agent includes the carboxylic acid part showing a high affinity to the inorganic filler and other polymer parts showing a high affinity to high molecular charge transport material or organic solvents it is possible to disperse inorganic fillers in organic solvents with the high molecular charge transport material.

The acidity of suitable dispersing agents is preferably 10 to 400 mgKOH/g, more preferably 30 to 200 mgKOH/g. An unduly high acidity may adversely affect produced images, such as reduction of resolution. If the acidity of the dispersing agent is too low, it should be added in a large amount, which may cause deterioration of electrical properties.

[Electroconductive Support]

As the electroconductive support according to the present invention, the following electroconductive support may be suitably used.

<Construction of Photoconductive Layer in Electrophotographic Photoconductor>

Figure 2:
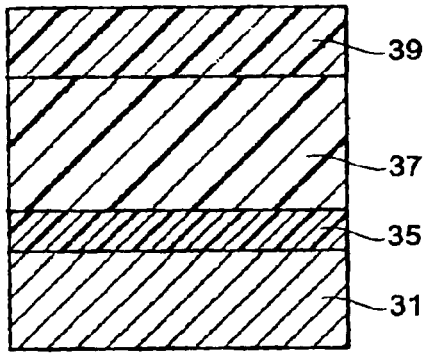
FIG. 2 is a schematic cross-sectional view of anther embodiment of an electrophotographic photoconductor according to the present invention.
Figure 3:
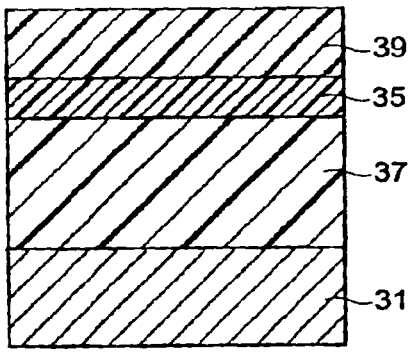
FIG. 3 is a schematic cross-sectional view of anther embodiment of an electrophotographic photoconductor according to the present invention.

The construction of the electrophotographic photoconductor according to the present invention is now explained referring to FIG. 1 to FIG. 3. The electrophotographic photoconductor according to the present invention comprises acryl-modified polyorganosiloxane compounds powders at the top of the in the photoconductive layer. The photoconductive layer may be a sing layer structure or a laminate structure having two or more layers.

The electrophotographic photoconductor shown in FIG. 1 includes a photoconductive layer 33 mainly comprising a charge generation material and a charge transport material on an electroconductive support 31. On the photoconductive layer 33, a protective layer 39 is formed. Here, the protective layer 39 comprises a high molecular charge transport material and an acryl-modified polyorganosiloxane compound and an inorganic filler.

In FIG. 2, a photoconductive layer has a structure comprising a charge generation layer 35 of a charge generation material and a charge transport layer 37 of a charge transport material successively overlaid on an electroconductive support 31 in this order. On the photoconductive layer 33, a protective layer 39 is also formed. Here, the protective layer 39 comprises a high molecular charge transport material and an acryl-modified polyorganosiloxane compound and an inorganic filler.

In FIG. 3, a photoconductive layer has a structure comprising a charge transport layer 37 of a charge transport material and a charge generation layer 35 of a charge generation material successively overlaid on an electroconductive support 31 in this order. On the photoconductive layer 33, a protective layer 39 is also formed. Here, the protective layer 39 comprises a high molecular charge transport material and an acryl-modified polyorganosiloxane compound and an inorganic filler.

The protective layer is shown to have an apparent boundary with lower layers in FIG. 1, FIG. 2 and FIG. 3. However, since individual layers are formed of compositions mainly comprising common components and the interfaces between adjacent two layers may be fused by dissolution during the coating operation, apparent boundaries cannot be fixed. The embodiments shown in FIG. 1, FIG. 2 and FIG. 3 include the circumstances.

Also, in FIG. 2, by using a charge transport layer comprising components needed for a protective layer, a separate protective layer can be omitted.

Now, the structure embodiments of the photoconductive layer in the electrophotographic photoconductor according to the present invention, including effects and specific examples of a charge generation material and a charge transport material, will be explained in detail referring to FIG. 4 to FIG. 10.

Figure 4:
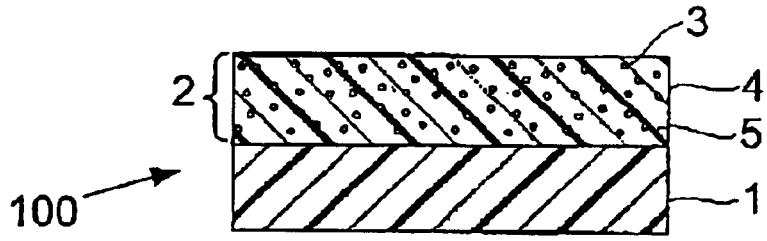
FIG. 4 is a schematic cross-sectional view of anther embodiment of an electrophotographic photoconductor according to the present invention.

Referring to FIG. 4, an electrophotographic photoconductor 100 has a single layer structure of a photoconductive layer 2 comprising a charge generation material 5 and acryl-modified polyorganosiloxane particles 3 dispersed in a charge transport medium 4 formed of a resin capable of transporting electric charges alone or in combination with a binder on a electroconductive support 1. The charge transport medium 4 can be formed of the resin capable of transporting charge alone or in combination with a binder and charge generation material 5 such as inorganic or organic pigments generates charge carriers. Here, the charge transport medium 4 receives the charge carrier generated by the charge generation material 5 and transports them. In this structure, it is basically necessary that the light-absorption wavelength regions of the charge generation material 5 and the resin capable of transporting electric charges not overlap in the visible light range. This is because, in order that the charge generation material 5 produce charge carriers efficiently, it is necessary that light pass through the charge transport medium 4 and reach the surface of the charge generation material 3. Meanwhile, in the charge transport medium 4, a low-molecular charge transport material may be added. Also, a charge transport layer medium comprising low-molecular charge transport material and a binder can be used.

Examples of the charge generation material which can be used include inorganic materials such as selenium, selenium-tellurium, cadmium sulfide, cadmium sulfide-selenium, α-silicone and the like, and organic materials for example, azo pigments, such as C.I. Pigment Blue 25 (Color Index 21180), C.I. Pigment Red 41 (C.I. 21200), C.I. Acid Red 52 (C.I. 45100), C.I. Basic Red 3 (C.I. 45210), an azo pigment having a carbazole skeleton (Japanese Patent Laid-Open No. 53-95033), an azo pigment having a distyryl benzene skeleton (Japanese Patent Laid-Open No. 53-133445), an azo pigment having a triphenylamine skeleton (Japanese Patent Laid-Open No. 53-132347), an azo pigment having a dibenzothiophene skeleton (Japanese Patent Laid-Open No. 54-21728), an azo pigment having an oxadiazole skeleton (Japanese Patent Laid-Open No. 54-12742), an azo pigment having a fluorenone skeleton (Japanese Patent Laid-Open No. 54-22834), an azo pigment having a bisstilbene skeleton (Japanese Patent Laid-Open No. 54-17733), an azo pigment having a distyryl oxadiazole skeleton (Japanese Patent Laid-Open No. 54-2129), and an azo pigment having a distyryl carbazole skeleton (Japanese Patent Laid-Open No. 54-14967); indigo pigments such as C.I. Vat Brown 5 (C.I. 73410) and C.I. Vat Dye (C.I. 73030); and perylene pigments such as Algol Scarlet B and Indanthrene Scarlet R (made by Bayer Co., Ltd.). Also, a phthalocyanine pigment represented by the following structure formula is useful as a charge generation material. In the formula, M (central atom) is a metallic or non-metallic (hydrogen) element.

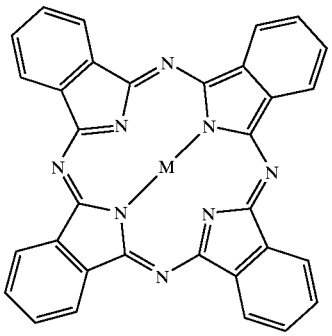

As the ceteral atom M, H, Li, Be, Na, Mg, Al, Si, K, Ca, Sc, Ti, V, Cr, Mn, Fe, Co, Ni, Cu, Zn, Ga, Ge, Y, Zr, Nb, Mo, Tc, Ru, Rh, Pd, Ag, Cd, In, Sn, Sb, Ba, Hf, Ta, W, Re, Os, Ir, Pt, Au, Hg, Tl, La, Ce, Pr, Nd, Pm, Sm, Eu, Gd, Tb, Dy, Ho, Er, Tm, Yb, Lu, Th, Pa, U, Np, and Am; and the combination of atoms forming an oxide, chloride, fluoride, hydroxide, or bromide may be used. The central atom is not limited to the above-mentioned atoms. The above-mentioned charge generation material with a phthalocyanine skeleton for use in the present invention may have at least the basic structure as indicated by the above-mentioned formula. Therefore, the charge generation material may have a dimer structure or trimer structure, and further, a polymeric structure. Further, the above-mentioned basic structure of the above formula may have a substituent.

Of such phthalocyanine compounds, an oxotitanium phthalocyanine compound which has the central atom (M) of TiO in the above-mentioned formula, and a metal-free phthalocyanine compound which has a hydrogen atom as the central atom (M) are particularly preferred in light of the photoconductive properties of the obtained photoconductor. In addition, it is known that each phthalocyanine compound has a variety of crystal systems. For example, the above-mentioned oxotitanium phthalocyanine has crystal systems of α-type, β-type, γ-type, m-type, and y-type. In the case of copper phthalocyanine, there are crystal systems of α-type, β-type and γ-type. The properties of the phthalocyanine compound vary depending on the crystal system thereof although the central metal atom is the same. According to "Electrophotography—the Society Journal—Vol. 29, No. 4 (1990)", it is reported that the properties of the photoconductor vary depending on the crystal system of a phthalocyanine contained in the photoconductor. It is therefore preferable to select the optimal crystal system of each phthalocyanine compound to obtain the desired photoconductive properties. The oxotitanium phthalocyanine with the y-type crystal system is particularly advantageous. These charge generation materials may be used alone or in combination.

The charge transport material is divided into two groups, a positive hole transporting material and an electron transporting material.

Examples of the electron transport material include electron receiving materials for example, chloranyl, bromanyl, tetracyanoethylene, tetracyanoquinodimethane, 2,4,7-trinitro-9-fluorenone, 2,4,5,7-tetranitro-9-fluorenone, 2,4,5,7-tetranitroxantone, 2,4,8-trinitrothioxantone, 2,6,8-trinitro-4H-indeno [1,2-b]thiophene-4-one, 1,3,7-trinitrodibenzothiophene-5,5-dioxide, benzoquinone derivatives, etc.

Examples of the positive hole transport material include poly-N-vinylcarbazole and derivatives thereof, poly-γ-carbazolylethyl glutamate and derivatives thereof, pyrene-formaldehyde condensation product and derivatives thereof, polyvinyl pyrene, polyvinyl phenanthrene, polysilane, oxazole derivatives, oxadiazole derivative, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, enamine derivatives and the like, which are known in the art. These charge transport materials may be used alone or in combination.

Figure 5:
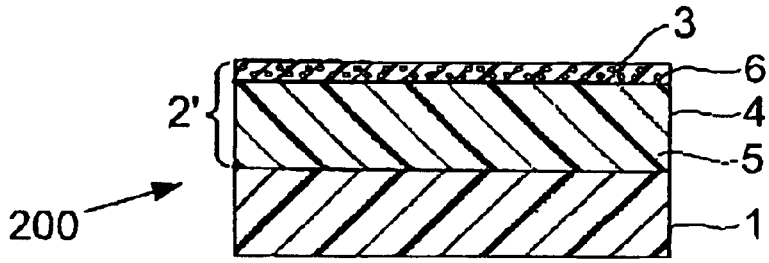
FIG. 5 is a schematic cross-sectional view of anther embodiment of an electrophotographic photoconductor according to the present invention.

Referring to FIG. 5, in this electrophotographic photoconductor 200, a protective layer 6 is formed on a first charge transport layer 4 so as to form a photoconductive layer 2'. In this electrophotographic photoconductor 200, on the charge transport layer 4 a protective layer 6 is formed, which comprises acryl-modified polyorganosiloxane particles contained in a resin capable of transporting electric charges, optionally in combined with a binder. The protective layer may comprise a low-molecular charge transport material, a binder and acryl-modified polyorganosiloxafle particles. Also, the protective layer may comprise a binder and acryl-modified polyorganosiloxane particles without a charge transport material.

The charge transport layer 4 is formed by dissolving or dispersing a charge transport material and a binder resin in a suitable solvent and coating the solution, followed by drying. As needed, at least one plasticizers, leveling agents, antioxidants may be added to the charge transport layer 4. The charge transport material includes the positive hole transporting material or electron transporting material as described above.

Examples of the binder resin includes thermoplastic or thermosetting resins such as polystyrene, styrene-acrylonitrile copolymer, styrene—butadiene copolymer, styrene-maleic anhydride copolymer, polyester, poly(vinyl chloride), vinyl chloride-vinyl acetate copolymer, poly (vinyl acetate), poly(vinylidene chloride), polyallylate, phenoxy resin, polycarbonate resin, cellulose acetate resin, ethyl cellulose resin, poly(vinyl butyral), poly(vinyl formal), poly (vinyltoluene), poly-N-vinylcarbazole, acrylic resin, silicone resin, epoxy resin, melamine resin, urethane resin, phenolic resin, and alkyd resin.

The amount of the charge transport material is suitably 20 to 300 weight parts, preferably 40 to 150 weight parts, based on 100 weight parts of the resin. The thickness of the charge transport layer is preferably up to 25 $\mu$m in terms of resolution and response. The lower limit is preferably at least 5 $\mu$m, although it varies depending on a used system (particularly charging potential).

Solvents which can be used herein are tetrahydrofuran, dioxane, toluene, dichloromethane, monochlorobenzene, dichloroethane, cyclohexanone, methylethylketone, acetone, etc. These solvents may be used alone or in combination Referring to FIG. 6, in an electrophotographic photoconductor 300, there is formed on an electroconductive support 1 a two-layered photoconductive layer 2" comprising a charge generation layer 7 mainly containing a charge generation material 5, and a charge transport layer 4 comprising a resin capable of transporting electric charges and acryl-modified polyorganosiloxane particles 3. In this photoconductor, light which has passed through the charge transport layer 4 reaches the charge generation layer 7, and charge carriers are generated within the charge generation layer 7. The charge transport layer 4 serve for accepting and transporting the charge carriers. The charge carriers which are necessary for light decay are generated by the charge generation material 5, and accepted and transported by the charge transport layer 4. This mechanisms is the same as described for the electrophotographic photoconductor 100 shown in FIG. 4. The charge transport medium 4 comprises a resin capable of transporting electric charges, optionally in combination with a binder. Also, in order to improve charge generation efficiency, a resin capable of transporting electric charges or a low-molecular charge transport material may bed added. For the same purpose, in the photoconductive layer 2", a low-molecular charge transport material may be contained. Further, it is possible to use a charge transport material comprising a low-molecular charge transport material and a binder. It would be applicable to the photoconductive layers described below.

The charge generation layer 7 contains mainly a charge generation material. In charge generation layer 7, any known charge generation materials can be used in addition to the above-described examples. Representative examples include monoazo pigments, disazo pigments, trisazo pigments, perylene pigments, perylnone pigments, quinacridone pigments, quinone condensed polycyclic compounds, squaric acid dyes, other phthalocyanine pigments, naphtahlocyanine pigments, azulenium salt dyes, etc. These charge generation material may be used alone or in combination.

The charge generation layer 7 is formed by dispersing a charge generation material, along with a binder resin if needed, in a proper solvents using a ball mill, attritor, sand mill, or ultrasonic dispersion mill and coating the dispersion on a electroconductive support, followed by drying Examples of the binder resin which is used in the charge generation layer 7, if needed include polyamide, polyurethane, epoxy resin, polyketone, polycarbonate, silicone resin, acryl resin, polyvinylbutyral, polyvinylformal, polyvinylketone, polystyrene, polysulfone, poly-N-vinylcarbazole, polyacrylamide, polyvinylbenzal, polyester, phenoxy resin, vinyl chloride-vinyl acetate copolymer, polyvinyl acetate, polyphenyleneoxide, polyamide, polyvinylpyridine, cellulose resin, casein, polyvinylalcohol, polyvinylpyrrolidone, etc. The added amount of the binder resin is suitably 0 to 500 weight parts, preferably 10 to 300 weight parts, based on the 100 weight parts of the charge generation material. The binder resin may be added before or after dispersing the charge generation material Solvents which can be used herein include isopropanol, acetone, methylethylketone, cyclohexanone, tetrahydrofuran, dioxane, ethylcellulose, ethylacetate, methylacetate, dichloromethane, dichloroethane, monochlorobenzene, cyclohexane, toluene, xylene, ligroin, etc. Particularly preferred solvents are ketone type solvents, ester type solvents and ether type solvents. These solvents may be used alone or in combination.

The charge generation layer 7 comprises mainly a charge generation material, solvents and a binder resin. Also, in the charge generation layer 7, a sensitizer, dispersing agent, surfactant, silicone oil can be added.

The coating of the coating solution may be carried out by dip coating, spray coating, bead coating, nozzle coating, spinner coating, ring coating, etc.

The film thickness of the charge generation layer 7 is suitably about 0.01 to 5 $\mu$m, preferably 0.1 to 2 $\mu$m.

Figure 7:
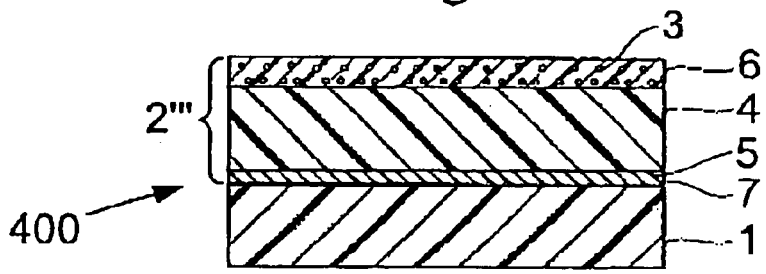
FIG. 7 is a schematic cross-sectional view of anther embodiment of an electrophotographic photoconductor according to the present invention.

Referring to FIG. 7, there is shown an electrophotographic photoconductor 400. In the electrophotographic photoconductor 400, a protective layer 6 is formed on a photoconductive layer 2''' comprising charge generation material 5 without containing acryl-modified polyorganosiloxane particles, as described for FIG. 5. In the charge transport layer, acryl-modified polyorganosiloxane particles may be contained.

Figure 8:
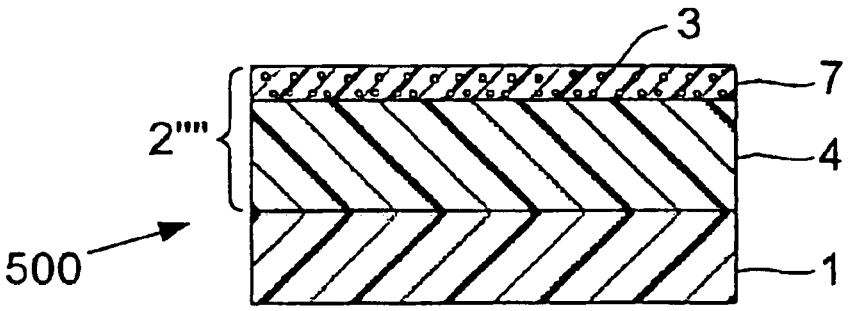
FIG. 8 is a schematic cross-sectional view of anther embodiment of an electrophotographic photoconductor according to the present invention.

Referring to FIG. 8, there is shown an electro photographic photoconductor 500 containing an electroconductive support 1 and a photoconductive layer 2'''' thereon. In this figure, the overlaying order of the charge generation layer 7 containing an acryl-modified polyorganosiloxane particles 3 and the charge transport layer 4 comprising a resin capable of transporting electric charges or a combination of a low-molecular charge transport material and a binder is reversed in view of the electrophotographic photoconductor shown in FIG. 6.

Figure 9:
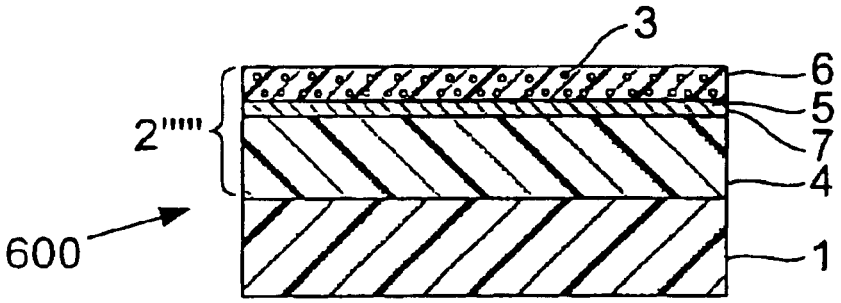
FIG. 9 is a schematic cross-sectional view of anther embodiment of an electrophotographic photoconductor according to the present invention.

Referring to FIG. 9, there is shown an electrophotographic photoconductor 600. In this electrophotographic photoconductor, a protective layer 6 is formed on a photoconductive layer 2''''' comprising a charge generation material 5 without containing acryl-modified polyorganosiloxane particles, as described for FIG. 5. In the charge generation layer, acryl-modified polyorganosiloxane particles may be contained.

Figure 10:
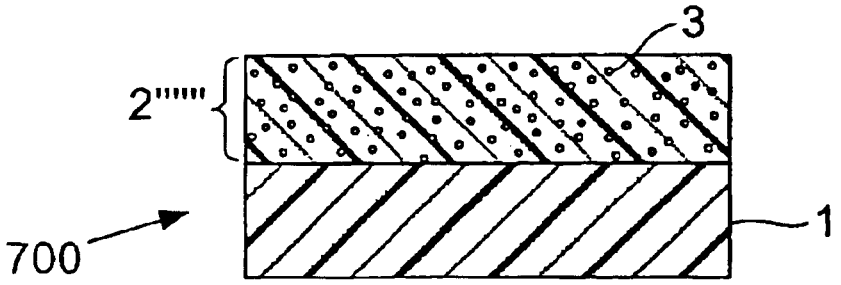
FIG. 10 is a schematic cross-sectional view of anther embodiment of an electrophotographic photoconductor according to the present invention.

Referring to FIG. 10, there is shown an electrophotographic photoconductor 700. In this electrophotographic photoconductor 700, a photoconductive layer(2''''') comprising acryl-modified polyorganosiloxane particles, a sensitizing dye and a resin capable of transporting electric charges, optionally combined with a binder, or a low-molecular charge transport material and a binder is formed on an electroconductive support 1. Here, the resin capable of transporting electric charges or the low-molecular charge transport material serves as a photoconductive material. That is, they generate and transport the charge carriers necessary for light decay. However, since the resin capable of transporting electric charges or the low-molecular charge transport material does not exhibit an absorption peak within the visible light region, it is necessary to add a thickening dye which exhibits an absorption peak within the visible light region for the purpose to form an visible image.

In order to prepare the electrophotographic photoconductor 100 of a single-layered structure shown in FIG. 4, the acryl-modified polyorganosiloxane particle 3 and finely-divided particles of the charge generation material 3 are dispersed into a solution where one or two or more resin(s) capable of transporting electric charges, optionally with a binder is(are) dissolved in a solvent. If needed, a plasticizer or leveling agent is added. The resulting solution is coated on the electroconductive support 1, followed by drying to form the photoconductive layer 2. The thickness of the photoconductive layer 2 is preferably 3 to 50 μm, more preferably 5 to 40 μm, further preferably, 5 to 25 μm. The amount of the binder in the photoconductive layer 2 is preferably 30 to 95 wt %. When based on 100 weight parts of the binder, the amount of the charge generation material is preferably 5 to 40 weight parts and the amount of the charge transport material is preferably 0 to 190 weight parts, more preferably 50 to 150 weight parts. The solid contents of the acryl-modified polyorganosiloxane particles in the photoconductive layer 2 is preferably 20 wt % or less, more preferably 10 wt % or less. Also, it is possible to use a composition of a low-molecular charge transport material and a binder instead of the resin capable of transporting electric charges. Examples of solvents which can be used include tetrahydrofuran, dioxane, dichloroethane, cyclohexane, etc. The coating of the coating solution may be carried out by dip coating, spray coating, beat coating, ring coating, etc.

The content of the charge generation material 3 in photoconductive layer 2 is preferably 0.1 to 50 wt %, more preferably 1 to 20 wt %.

In order to prepare the electrophotographic photoconductor 200 shown in FIG. 5, finely-divided particles of the charge generation material 5 are dispersed into a solution where one or two or more resin(s) capable of transporting electric charges, optionally with a binder, or low-molecular charge transport material and a binder is(are) dissolved in a solvent. The resulting solution is coated on the electroconductive support 1, followed by drying to form the photoconductive layer 2'. A resin capable of transporting electric charges, optionally with a binder, or low-molecular charge transport material and a binder is(are) dissolved along with acryl-modified polyorganosiloxane particles in a solvent to form a solution. The solution is coated on the photoconductive layer 2', followed by drying, to form the protective layer 6. The thickness of the protective layer 6 is preferably 0.15 to 10 μm. The amount of the resin in the protective layer 6 is preferably 40 to 95 wt %. The amount of the acryl-modified polyorganosiloxane particles is 20 wt % less, preferably 10 wt %, based on the weight of the resin. The protection may be formed of a binder and acryl-modified polyorganosiloxane particles.

The protective layer may be suitably formed on the photoconductive layer by dip coating, spray coating, bead coating, nozzle coating, spinner coating, ring coating, etc. Among these coating methods, spray coating is preferred in terms of uniformity of the coated film. Also, the protective layer may be preferably formed by carrying out the coating operation at least twice so that the protective layer be a multi-layered structure, though it may be formed by performing the coating operation in a single step to a desired thickness. The repetitive coating method is preferred in terms of uniform distribution of the filer. Also, by this method, it is possible to attain more effectively reduction of residual potential and improvement of resolution and wear resistance. The entire thickness of the protective layer is suitably 0.1 to 10 μm.

Addition of the charge transport material instead of the protective layer is advantageous and effective to reduce residual potential and improvement of image quality. In this case, the charge transport material is preferably added to the protective layer in such a way that the ionization potential (Ip) of the charge transport material in the protective layer is equal to or less than the Ip of the charge transport material contained in photoconductive layer, whereby it is possible to reduce residual potential. The ionization potential (Ip) can be measured by various methods such as spectrometrically or electrochemically monitored methods.

Figure 6:
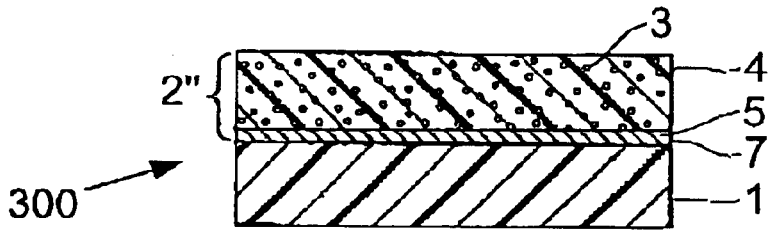
FIG. 6 is a schematic cross-sectional view of anther embodiment of an electrophotographic photoconductor according to the present invention.

In order prepare the electrophotographic photoconductor 300 shown in FIG. 6, a charge generation material is vacuum deposited on the electroconductive support 1. Alternatively, finely-divided particles of a charge generation material 5 is dispersed in a solution of a binder dissolved in a proper solvent. The resulting dispersion is coated and dried. If needed, the produced coating is subjected to a surface finishing such as buff polishing to adjust its thickness, thereby forming the charge generation layer 7. Then, one or two or more resin(s) capable of transporting electric charges, optionally with a binder, or a low-molecular charge transport material and a binder is(are) dissolved along with acryl-modified polyorganosiloxane particles in a solvent. The resulting solution is coated, followed by drying, to form the charge transport layer 4. As to the charge generation material used for formation of the charge generation layer 7, reference is made to the above description for the photoconductive layer 2.

The thickness of the charge generation layer 7 is preferably up to 5 μm, more preferably up to 2 μm. The thickness of the charge transport layer 4 is preferably 3 to 50 μm, preferably 5 to 40 μm.

In case when the charge generation layer 7 is formed of finely-divided particles of the charge generation layer material 5 in the binder, the content of the finely-divided particles of the charge generation material 5 in the charge generation layer 7 is preferably 10 to 100 wt %, more preferably 50 to 100 wt %. The amount of the resin comprising the charge transport layer 4 is preferably 40 to 95 wt % and the amount of the acryl-modified polyorganosiloxane is preferably up to 20 wt %, more preferably up to 10 wt % with respect to the binder. As described above, the resin capable of transporting electric charges may be replaced by a low-molecular charge transport material. Examples of the charge transport material which can be used are as follows: oxazole derivatives, oxadiazole derivatives (Japanese Laid-Open Patent Applications 52-139065 and 52-139066), imidazole derivatives, triphenylamine derivatives (Japanese Patent Laid-Open No. 3-285960), benzidine derivatives (Japanese Patent Publication 58-32372), α-phenylstilbene derivatives (Japanese Patent Laid-Open No. 57-73075), hydrazone derivatives (Japanese Patent Laid-Open Nos. 55-154955, 55-156954, 55-52063, and 56-81850), triphenylmethane derivatives (Japanese Patent Publication 51-10983), anthracene derivatives (Japanese Patent Laid-Open No. 51-94829), styryl derivatives (Japanese Laid-Open Patent Applications 56-29245 and 58-198043), carbazole derivatives (Japanese Patent Laid-Open No. 58-58552), and pyrene derivatives (Japanese Patent Laid-Open No. 2-94812).

As the resin capable of transporting electric charges, any known charge transporting material can be used. For example, materials described in Japanese Patent Laid-Open No. 51-73888, Japanese Patent Laid-Open No. 54-8527, Japanese Patent Laid-Open No. 54-11737, Japanese Patent Laid-Open No. 56-150749, Japanese Patent Laid-Open No. 57-78402, Japanese Patent Laid-Open No. 63-285552, Japanese Patent Laid-Open No. 64-1728, Japanese Patent Laid-Open No. 64-13061, Japanese Patent Laid-Open No. 64-19049, Japanese Patent Laid-Open No. 3-50555, Japanese Patent Laid-Open No. 4-225014, Japanese Patent Laid-Open No. 4-230767, Japanese Patent Laid-Open No. 5-232727, Japanese Patent Laid-Open No. 5-310904 can be used.

Also, as the high molecular charge transport material according to the present invention, any known charge transporting polymer having a triarylamine structure can be used. For example, acetophenone derivatives (Japanese Patent Laid-Open No. 8-269183), distyryl benzene derivatives (Japanese Patent Laid-Open No. 9-71642), diphenetyl benzene derivatives (Japanese Patent Laid-Open No. 9-104746), α-phenylstilbene derivatives (Japanese Patent Laid-Open No. 9-272735 and Japanese Patent Laid-Open 2000-314973), butadiene derivatives (Japanese Patent Laid-Open No. 9-235367), hydrogenated butadiene derivatives (Japanese Patent Laid-Open No. 9-87376), diphenylcyclohexane derivatives (Japanese Patent Laid-Open No. 9-110976), distyryltriphenylamine derivatives (Japanese Patent Laid-Open No. 9-268226), distyryldiamine derivatives (Japanese Patent Laid-Open No. 11-60718), diphenyldistyrylbenzene derivatives (Japanese Patent Laid-Open No. 9-221544 and Japanese Patent Laid-Open No. 9-227669), stilbene derivatives (Japanese Patent Laid-Open No. 9-157378 and Japanese Patent Laid-Open No. 11-71453), m-phenylenediamine derivatives (Japanese Patent Laid-Open No. 9-302084 and Japanese Patent Laid-Open No. 9-302085), resorcin derivatives (Japanese Patent Laid-Open No. 9-328539), fluorene derivatives (Japanese Patent Laid-Open No. 11-5836) and phenoxystilbene derivatives (Japanese Patent Laid-Open No. 11-71453).

In addition, polycarbonate resins having a triarylamine structure can be used. For example, resins described in specifications of U.S. Pat. Nos. 4,801,517, 4,806,443, 4,806,444, 4,937,165, 4,959,288, 5,030,532, 5,034,296, 5,080,989, and Japanese Patent Laid-Open No. 64-9964, Japanese Patent Laid-Open No. 3-221522, Japanese Patent Laid-Open No. 2-304456, Japanese Patent Laid-Open No. 4-11627, Japanese Patent Laid-Open No. 4-175337, Japanese Patent Laid-Open No. 4-18371, Japanese Patent Laid-Open No. 4-31404 and Japanese Patent Laid-Open No. 4-133065 can be used.

In order to prepare the electrophotographic photoconductor 400, a charge generation material is vacuum deposited on the electroconductive support 1. Alternatively, finely-divided particles of a charge generation material 5 is dispersed in a proper solvent, in which a binder is dissolved as needed. The resulting dispersion is coated and dried. If further needed, the produced coating is subjected to a surface finishing such as buff polishing to adjust its thickness, thereby forming the charge generation layer 7. Then, one or two or more resin(s) capable of transporting electric charges, optionally with a binder, or a low-molecular charge transport material and a binder is(are) dissolved along with acryl-modified polyorganosiloxane particles in a solvent. The resulting solution is coated, followed by drying, to form the charge transport layer 4. On the charge transport layer 4, the protection layer 6 as shown in FIG. 8 is formed.

In order prepare the electrophotographic photoconductor 500 shown in FIG. 8, one or two or more resin(s) capable of transporting electric charges, optionally with a binder, or a low-molecular charge transport material and a binder are dissolved along with acryl-modified polyorganosiloxane particles in a solvent to form a solution. The resulting solution is coated, followed by drying, to form the charge transport layer 4. Then, finely-divided particles of the charge generation material and acryl-modified polyorganosiloxane particles are dispersed in a solvent, in which a binder is dissolved as needed. The resulting dispersion is coated on the charge transport layer 4, followed by drying, to form the charge generation layer 7. As to the proportions of the charge generation layer and the charge transport layer, reference is made to the above description for the photoconductive layer shown in FIG. 7.

In order prepare the electrophotographic photoconductor 600 shown in FIG. 9, one or two or more resin(s) capable of transporting electric charges, optionally with a binder, or a low-molecular charge transport material and a binder are dissolved in a solvent to form a solution. The resulting solution is coated, followed by drying, to form the charge transport layer 4. Then, finely-divided particles of the charge generation material are dispersed in a solvent, in which a binder is dissolved as needed. The resulting dispersion is coated on the charge transport layer 4 for example, by spray coating, followed by drying, to form the charge generation layer 7. On the charge transport layer 4, the protection layer 6 as shown in FIG. 8 is formed.

In order prepare the electrophotographic photoconductor 700 shown in FIG. 10, acryl-modified polyorganosiloxane particles and one or two or more resin(s) capable of transporting electric charges, optionally with a binder, or a low-molecular charge transport material and a binder is(are) dispersed and dissolved in a solvent to form a solution, to which a sensitizing dye is added. The resulting solution is coated on the electroconductive layer 1, followed by drying, to form the photoconductive layer 2"""".

The thickness of the photoconductive layer is preferably 3 to 50 μm, more preferably 5 to 40 μm. The content of the one or two or more resin(s) capable of transporting electric charges or the low-molecular charge transport material in the photoconductive layer(2"""") is 30 to 100 wt % and the added amount of the sensitizing dye in photoconductive layer 2 is preferably 0.1 to 5 wt %, more preferably 0.5 to 3 wt %.

Examples of the sensitizing dye useful in the present invention include triarylmethane dyes such as brilliant green, victoria blue B, methylviolet, crystal violet and acid violet 6B; xantene dyes such as rhodamine B, rhodamine 6G, rhodamine G extra, eosin S, erythrosine, rose bengal, fluorescein; thiazine dyes such as methylene blue; cyanine dyes such as cyanine, and the like.

In order to prepare the electroconductive support 1 for use in the electrophotographic photoconductor, a electroconductive material with a volume resistance of 10 Ω·cm or less, including for example, plates or foils of metal elements such as aluminum, nickel, chromium, nichrome, copper, gold, silver, platinum, and the like; or a metallic oxide such as tin oxide or indium oxide can be used. The forgoing material is coated by deposition or sputtering on a supporting material, e.g., a plastic film or a sheet of paper, which may be fabricated in a cylindrical form. Alternatively, a plate of aluminum, aluminum alloy, nickel or stainless steel can be used as the electroconductive support 1, and the above-mentioned metal plate may be made into a tube by extrusion or emission and subjected to surface treatment such as cutting, super finishing and grinding. Also, endless nickel belt, endless stainless belt, etc. disclosed in Japanese Patent Laid-Open No. 52-36016 may be used as the electroconductive support 31. In addition, the support coated with a liquid coating comprising electroconductive powders dispersed in a proper binder resin may be used. The electroconductive powders are for example metallic powders such as carbon black, acetylene black, aluminum, nickel, iron, nichrome, copper, zinc, silver, etc. and metal oxide powders of electroconductive tin oxide, ITO, etc.

Examples of the binder resin include condensed resins such as polyamide, polyurethane, epoxy resin, polyketone and the like; vinyl polymers such as polyketone, polystyrene, styrene-maleic anhydride copolymer, poly (vinyl chloride), vinyl chloride-vinyl acetate copolymer, cellulose acetate resin, ethyl cellulose resin, poly(vinyl butyral), poly(vinyl formal), poly(vinyltoluene), poly-N-vinylcarbazole, polyacrylamide; and thermoplastic, thermosetting or photocurable resins such as acrylic resin, silicone resin, epoxy resin, melamine resin, urethane resin, phenolic resin, and alkyd resin and the like. The type of the binder resin is not particularly limited as long as it has a insulating properties and adhesion. The electroconductive support may be prepared by dispersing the above described electroconductive powder and binder in a proper solvent, for example tetrahydrofuran, dichloromethane, methylethylketone, toluene, etc, and coating the dispersion. If needed, a plasticizer may be added to the binder resin. Examples of such plasticizer include halogenated paraffin, dimethylnaphthalene, dibutylphthalate, etc. Also, an additive such as an antioxidant, UV stabilizer, thermal stabilizer, lubricating agent and the like may be added as needed. In the photoconductor thus obtained, an adhesive layer or barrier layer may be provided between the electroconductive support and photoconductive layer, as needed. Material useful in these layers include polyamide, nitrocellulose, aluminum oxide, titanume oxide and the like. Their thickness is preferably 1 $\mu$m or less. Further, as the electroconductive support, an electroconductive support comprising an electroconductive layer formed on a material such as polyvinyl chloride, polypropylene, polyester, polystyrene, polyvinylidene chloride, polyethylene, rubber chloride, Teflon™ on a proper cylindrical body by means of a thermal contracting tube containing the foregoing electroconductive powders.

Also, the electrophotographic photoconductor according to the present invention may further comprise an undercoat layer which is interposed between the electroconductive support and the photoconductive layer. The undercoat layer comprises a resin as the main component. Since the photoconductive layer is provided on the undercoat layer by coating method using a solvent, it is desirable that the resin for use in the undercoat layer have high resistance against general-purpose organic solvents. Preferable examples of the resin for use in the undercoat layer include water-soluble resins such as poly(vinyl alcohol), casein, and sodium polyacrylate; alcohol-soluble resins such as copolymer nylon and methoxymethylated nylon; and hardening resins with three-dimensional network such as polyurethane, melamine resin, alkyd-melamine resin, and epoxy resin. To effectively prevent the occurrence of Moire and reduce a residual potential, the undercoat layer may further comprise finely-divided particle pigments of metallic oxides such as titanium oxide, silica, alumina, zirconium oxide, tin oxide, and indium oxide.

Similar to the photoconductive layer, the undercoat layer can be provided on the electroconductive support by a coating method, using an appropriate solvent. Further, in the undercoat layer according to the present invention, a coupling agent such as silane coupling agent, titanium coupling agent, or chromium coupling agent can be used. Furthermore, to prepare the undercoat layer, $Al_2O_3$ may be deposited on the electroconductive support by the anodizing process, or an organic material such as polypara-xylylene (parylene), or inorganic materials such as SiO, $SnO_2$, $TiO_2$, ITO, and $CeO_2$ may be deposited on the electroconductive support by vacuum thin-film forming method. It is preferable that the thickness of the undercoat layer be in the range of 0 to 5 $\mu$m.

It is preferable that the contact angle which pure water makes with the surface of the photoconductor according to the present invention be 90° or more, and more preferably 95° or more.

When the contact angle of pure water is less than 90°, foreign materials generated by a charging step and some components contained in a toner and paper are easily attached to the surface of the photoconductor during repeated electrophotographic process. Thus, defective cleaning and decreased surface resistivity will hinder the formation of latent images on the photoconductor, thereby causing image degradation(image deletion). On the other hand, when the above-mentioned contact angle of pure water with the surface of the photoconductor is excessively large, the toner cannot deposit on the photoconductor in a development step. Therefore, the upper limit of the aforementioned contact angle of pure water is preferably 140° or less.

Also, it is preferable that the coefficient of electrostatic friction on the surface of the electrophotographic photoconductor according to the present invention be 0.4 or less, and more preferably 0.35 or more.

When the coefficient exceeds 0.4, foreign materials generated by a charging step and dust resulting from a toner and paper cannot be cleaned during repeated electrophotographic process. Thus, defective cleaning and decreased surface resistivity will cause image degradation(image deletion).

In the present invention, the contact angle which pure water makes with the surface of the photoconductor is measured after the photoconductor is abraded with a depth of about 1 $\mu$m from the outermost surface. This is because the contact angle becomes constant after the surface of the photoconductor is abraded to the extent mentioned above. In practice, the contact angle of pure water may be measured on the surface of the photoconductor after the surface is abraded with a depth of 1±0.3 $\mu$m. To measure the above-mentioned contact angle, an electrophotographic photoconductor is incorporated in a commercially available copying machine and the surface of the photoconductor is caused to wear away by rubbing to the above-mentioned extent by continuous image formation.

In order to abrade, the surface of the photoconductor may be scraped, for example, using a commercially available Taber abrader (made by Toyo Seiki Seisaku-sho, Ltd.), with a truck wheel CS-5 by 1,000 rotations at a rate of 60 rpm under the application of a load of 1000 g at 20° C. and 50% RH. The contact angle which pure water makes with the surface of the photoconductor can be measured by a sessile drop method using a commercially available measuring instrument "Automatic Contact Angle Meter CA-W" (trademark), made by KYOWA INTERFACE SCIENCE CO., LTD. In this measurement, it is preferable that the contact angle which pure water makes with the surface of the photoconductor be in the range of 90 to 140°, and more preferably at least 90° The coefficient of friction is also measured using a scraped surface by the Bowden method using a stainless ball.

According to the electrophotographic image forming method using the photoconductor of the present invention, the surface of the photoconductor is uniformly charged, the charged photoconductor is exposed to a light image, the latent image is developed as a visible image, and then the developed image is transferred to a sheet of paper when necessary.

The thus obtained photoconductor containing acryl-modified polyorganosiloxane according to the present invention has a high sensitivity and low friction properties of polyorganosiloxane and compatibility of acryl to the matrix resin.

[Electrophotographic Apparatus and Process Cartridge]

The electrophotographic image forming apparatus and method, and the process cartridge according to the present invention will now be explained in detail with reference to drawings.

Figure 11:
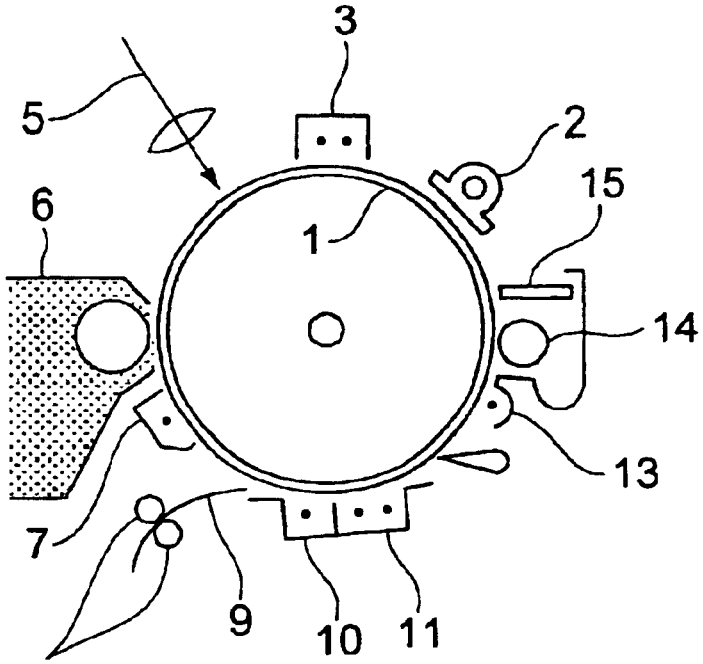
FIG. 11 is a schematic diagram in explanation of an embodiment of a process cartridge and electrophotographic image forming apparatus according to the present invention.

FIG. 11 is a schematic view which shows one embodiment of the process cartridge and electrophotographic apparatus according to the present invention including the modification as described below.

In FIG. 11, as an electrophotographic photoconductor 1, the electrophotographic photoconductor according to the present invention may be used. The electrophotographic photoconductor 1 is in the form of a drum but it may be in the form of a sheet or an endless belt. It is provided with a electrostatic charger 3, a pretransfer charger 7, a transfer charger 10, a separating charger 11, and a pre-cleaning charger 13. These chargers may employ the conventional means such as a corotron charger, a scorotron charger, a solid state charger, and a charging roller. For the image transfer means, it is effective to employ both the image transfer charger 10 and the separating charger 11 as illustrated in FIG. 11.

As the light sources for the light exposure unit 5 and the quenching lamp 2, there can be employed, for example, a fluorescent tube, tungsten lamp, halogen lamp, mercury vapor lamp, sodium light source, light emitting diode (LED), semiconductor laser (LD), and electroluminescence (EL). Further, various filters such as a sharp-cut filter, bandpass filter, a near infrared cut filter, dichroic filter, interference filter, and color conversion filter can be used to selectively irradiate a desired wavelength. The photoconductor may be irradiated with light from these light sources in the course of the image transfer step, quenching step, cleaning step, or pre-light-exposure step in addition to the step shown in FIG. 13.

When the toner image formed on the photoconductor 1 using the development unit 6 is transferred to a transfer sheet 9, all the toner particles deposited on the photoconductor 1 are not transferred to the transfer sheet 9. Some toner particles remain on the surface of the photoconductor 1. The remaining toner particles are removed from the photoconductor 1 using the fur brush 14 and the cleaning blade 15. The cleaning of the photoconductor may be carried out only by use of a cleaning brush. As the cleaning brush, there can be employed a conventional fur brush and magnetic fur brush.

When the photoconductor 1 is positively (negatively) charged, and exposed to light images, positive (negative) electrostatic latent images are formed on the photoconductor 1.

The positive (negative) electrostatic latent images are developed using a positive (negative) toner, thereby obtaining positive images. Not only such development means, but also the quenching means may employ the conventional manner.

Figure 12:
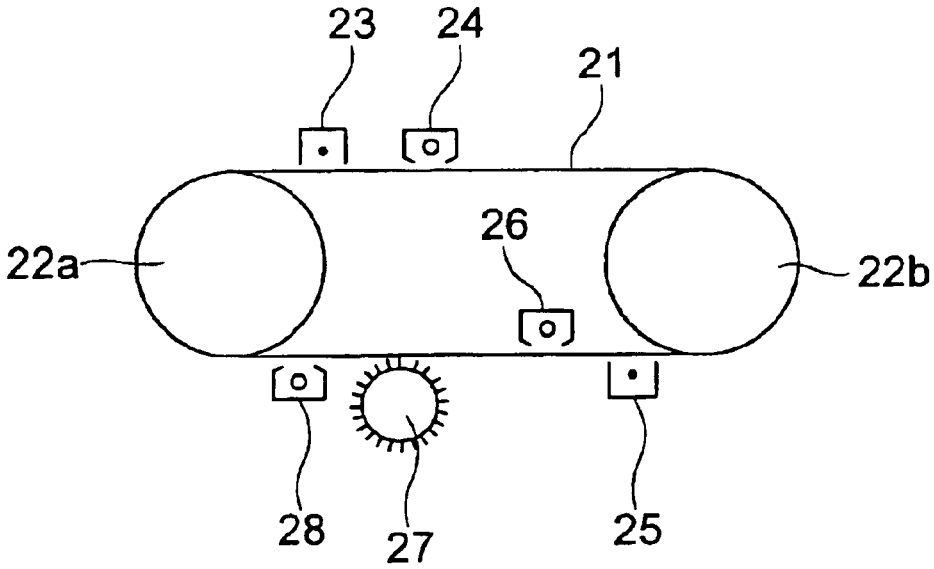
FIG. 12 is a schematic view of the construction of the electrophotographic image forming apparatus according to the present invention.

FIG. 12 is a schematic view which shows another embodiment of the electrophotographic image forming apparatus according to the present invention. A photoconductor 21 shown in FIG. 12 according to the present invention, in the form of an endless belt, is driven by driving rollers 22*a* and 22*b*. Charging of the photoconductor 21 is carried out by use of a charger 23, and the charged photoconductor 21 is exposed to light images using an image exposure light 24. Thereafter, latent electrostatic images formed on the photoconductor 21 are developed to toner images using a development unit (not shown), and the toner images are transferred to a transfer sheet with the aid of a transfer charger 25. After the toner images are transferred to the transfer sheet, the photoconductor 21 is subjected to pre-cleaning light exposure using a pre-cleaning light 26, and cleaned by use of a cleaning brush 27. Finally, quenching is carried out using a lamp 28.

This electrophotographic image forming apparatus is for illustration of an embodiment according to the present invention but the present invention does not limited thereto. For example, In FIG. 12, the pre-cleaning light 26 is applied to the electroconductive support side of the photoconductor 21. However, the photoconductive layer side of the photoconductor 21 may also be exposed to the pre-cleaning light. Further, the image exposure light 24 and the quenching lamp 28 may be disposed so that light is directed toward the electroconductive support side of the photoconductor 21.

Meanwhile, it is shown that the photoconductor 21 is exposed to light using the image exposure light, the pre-cleaning light, and the quenching lamp. In addition to the above, light exposure may be carried out before image transfer and before image exposure and by other known light exposure processes.

The image forming means as described above can be fixedly incorporated in the copying machine, facsimile machine, or printer. Alternatively, they can be incorporated as a process cartridge to at least one of those machines.

Figure 13:
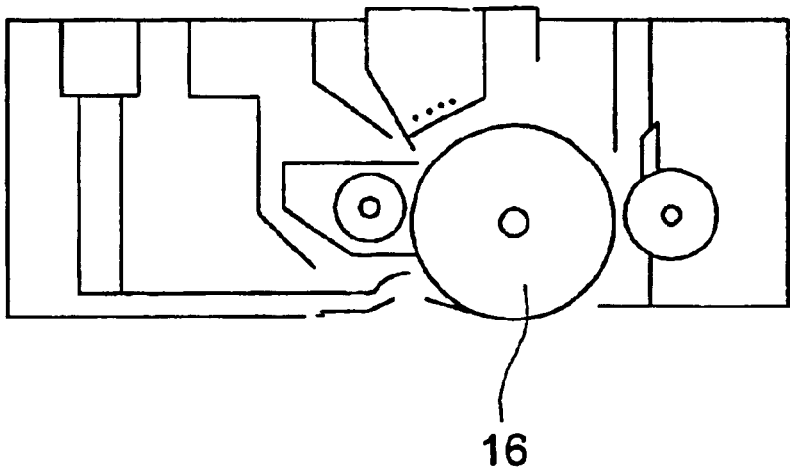
FIG. 13 is a schematic view of the construction of the process cartridge according to the present invention.

The process cartridge according to the present invention may hold therein a photoconductor, and at least one of the charging unit, light exposure unit, development unit, image transfer unit, cleaning unit, or quenching unit. It can take many different shapes and in FIG. 13, there is shown an general embodiment among them. The electrophotographic photoconductor according to the present invention can be used as a photoconductor 16. In FIG. 13, the pre-cleaning light is applied to the electroconductive support side of the photoconductor 16.

Now, the present invention will be explained in detail by the following examples. However, in the following examples, "part(s)" represent weight part(s), unless indicated otherwise.

Example A and Comparative Example A

Purification of acryl-modified polyorganosiloxane 1

30 g of Acryl-modified polyorganosiloxane polyorganosiloxane (CHALINE R-170S (volume average particle diameter ($D_{50}$)=30 $\mu$m), produced by Nissan Chemical Industries Ltd.) was taken into 300 ml of methanol. The stirring operation for 60 minutes was performed twice and the reaction was substituted with ion exchange water. By lyophilization, 27.76 g of acryl-modified polyorganosiloxane was obtained. Chemical composition of the purified acryl-modified polyorganosiloxane was determined by fluorescent X-ray analysis. The result is shown in Table 1.

Purification of Acryl-modified polyorganosiloxane 2

30 g of Acryl-modified polyorganosiloxane polyorganosiloxane (CHALINE R-170S (volume average particle diameter ($D_{50}$)=30 $\mu$m), produced by Nissan Chemical Industries Ltd.) was taken into 300 ml of methanol. The stirring operation for 60 minutes was performed three times and the reaction was substituted with ion exchange water. By lyophilization, 26.67 g of acryl-modified polyorganosiloxane was obtained. Chemical composition of the purified acryl-modified polyorganosiloxane was determined by fluorescent X-ray analysis. The result is shown in Table 1.

TABLE 1

| No. | Ion content (ppm) Na | S |
|---|---|---|
| Purification Example 1 | 100 | 200 |
| Purification Example 2 | 50 | 150 |
| Unpurified | 2550 | 1890 |

Example A-1

A solution of polyamide resin (CM-8000, produced by Toray Industries, Inc.) dissolved in a solvent mixture of methanol/butanol was coated on an aluminum plate by means of a doctor blade, followed by drying in the air, to form a intermediate layer of 0.3 μm. Bisazo compound, represented by the following formula, as an electron generating material was pulverized in a solvent mixture of cyclohexanone and 2-butanone by a ball mill. The resulting dispersion was coated on the intermediate layer by means of a doctor blade, followed by drying in the air, to form a charge generation layer of 0.5 μm.

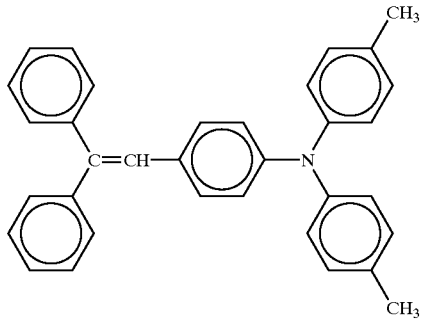

The produced electrophotographic photoconductor was set in a electrophotographic apparatus, recording paper test apparatus for static electricity SP 428, commercially available from Kawaguchi Electric Works Co., Ltd.) and subjected to a corona discharge at −6 KV for 20 seconds in a dark place, thereby being charged. The surface potential of the photoconductor $V_m$(V) was measured and left in a darker place for additional 20 seconds. Again, the surface potential of the photoconductor $V_0$(V) was measured. Subsequently, light from a tungsten lamp was irradiated to a surface of the photoconductor with an illuminance at the surface of the photoconductor of 5.3 lux. Exposure input $E_{1/2}$, (lux·sec) was calculated by measuring time (second) until V0 became ½. V30 was the surface potential at 30 seconds after irradiating the electrophotographic photoconductor. The result is shown below.

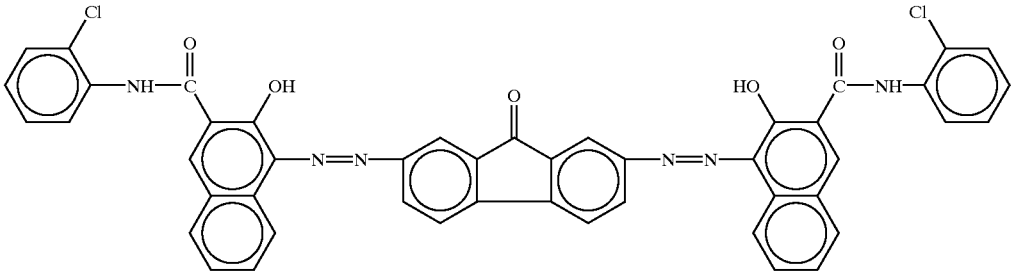

Next, a coating solution of a charge transport layer having a composition described below was coated on the charge generation layer by means of a doctor blade, followed by drying in the air and then at 120° C. for 20 minutes, to form a charge transport layer having a thickness of 20 μm. Thus, a photographic photoconductor was formed.

Coating Solution of Charge Transport Layer charge transport material represented by the following formula: 8.4 parts polycarbonate resin (Panlite TS2050, produced by Teijin Chemicals Ltd.): 9.3 parts acryl modified polyorganosiloxane purified in Purification Example 1: 0.93 parts dichloromethane: 100 parts $V_m$=−1308 V
$V_0$=−1058 V
$E_{1/2}$=0.68 lux·sec
$V_{30}$=−5 V Example A-1'

An electrophotographic photoconductor was prepared following the same procedure as in Example A-1 except for that the acryl-modified polyorganosiloxane as purified in Purification Example 1 was substituted with the acryl-modified polyorganosiloxane as purified in Purification Example 2. The photoconductor was characterized as described in Example 1. The result is shown in below.

$V_m$=−1310 V
$V_0$=−1043 V
$E_{1/2}$=0.63 lux·sec
$V_{30}$=−4 V

Example A-1"

An electrophotographic photoconductor was prepared following the same procedure as in Example A-1 except for that the acryl-modified polyorganosiloxane as purified in Purification Example 1 was substituted with the crude acryl-modified polyorganosiloxane as described in Table 1. The photoconductor was characterized as described in Example 1. The result is shown in below.

$V_m$=−1312 V $V_0$=−1088 V $E_{1/2}$=1.23 lux·sec $V_{30}$=−264 V

Example A-2

On an aluminum plate, a intermediate layer and charge generation layer were formed in order, as described in Example 1. Also, a coating solution of a charge transport layer having a composition described below was coated on the charge generation layer by means of a doctor blade, followed by drying in the air and then at 120° C. for 20 minutes, to form a charge transport layer having a thickness of 20 μm. Thus, a photographic photoconductor was formed.

charge transport material represented by the following formula: 17.7 parts

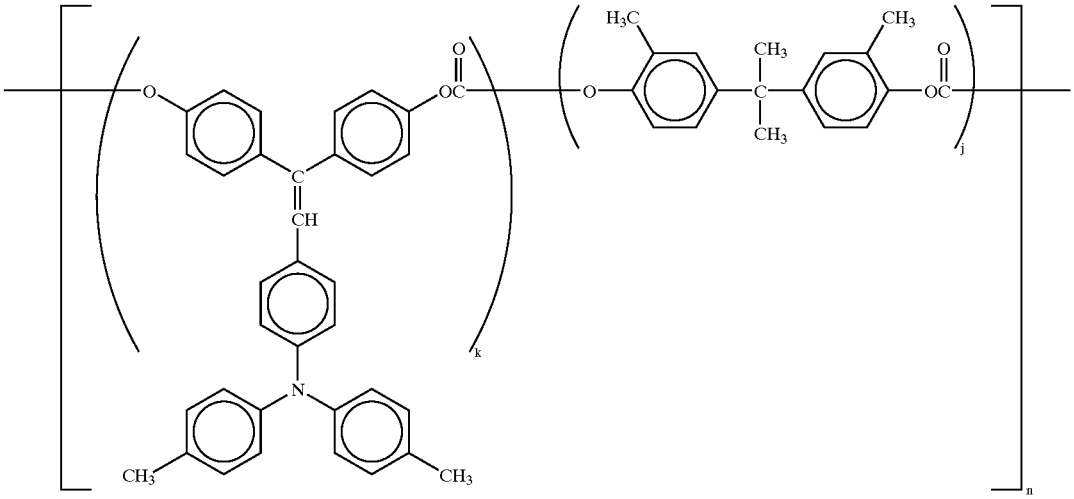

(random copolymer in which k=0.50, j=0.50)

acryl modified polyorganosiloxane purified in Purification Example 2: 0.93 parts dichloromethane: 100 parts The photoconductor was characterized as described in Example 1. The result is shown in below.

$V_m$=−1531 V $V_0$=−1107 V $E_{1/2}$=1.18 lux·sec

V30=−7V

Also, the electrophotographic photoconductor was charged using a commercially available electrophotographic copier. Irradiation was performed through an original pattern to form a latent electrostatic image, which was developed using a dry developing agent. The produced image (toner image) was transferred to a sheet of plain paper, followed by fixation, to obtain a clear image. Also, when using a wet developing agent instead of the dry developing agent, a clear image was obtained.

Example A-3

The electrophotographic photoconductor prepared in Example 1 was subjected to the Taber abrasion test. That is, the abrasion test was conducted by spinning CS-5 abrader wheel on a Taber abrasion tester, produced by Toyoseiki, at a load of 1 Kg for 3,000 revolutions according to JIS K 7204(1995). The wear amount of the photoconductor after 3,000 revolutions is shown in Table 2.

Example A-4

The electrophotographic photoconductor prepared in Example 2 was subjected to the Taber abrasion test as described in Example A-3. The result is shown Table 2.

Comparative Example A-1

An electrophotographic photoconductor was prepared following the same procedure as in Example A-1 except for that the acryl-modified polyorganosiloxane was not used. The photoconductor was subjected to the Taber abrasion test as described in Example A-3. The result is shown Table 2.

Comparative Example A-2

An electrophotographic photoconductor was prepared following the same procedure as in Example A-2 except for that the acryl-modified polyorganosiloxane was not used. The photoconductor was subjected to the Taber abrasion test as described in Example A-3. The result is shown Table 2.

Comparative Example A-3

An electrophotographic photoconductor was prepared following the same procedure as in Example A-1 except for that the acryl-modified polyorganosiloxane was substituted with polysiloxane particles, Trepil R-902A, produced by Toray Silicon Co., Ltd. The photoconductor was subjected to the Taber abrasion test as described in Example A-3. The result is shown Table 2.

Comparative Example A-4

An electrophotographic photoconductor was prepared following the same procedure as in Example A-1 except for that the acryl-modified polyorganosiloxane was substituted with cross-linked polystyrene particles, SX8742(D)-05, produced by Nippon gohsei gom. The photoconductor was subjected to the Taber abrasion test as described in Example A-3. The result is shown Table 2.

TABLE 2

| Example/ Comparative Example | Specimen | Wear amount (mg) |
|---|---|---|
| Example A-3 | Photoconductor prepared in Example A-1 | 0.75 |
| Example A-4 | Photoconductor prepared in Example A-1 | 0.66 |
| Comparative Example A-1 | Photoconductor prepared in Comparative Example A-1 | 3.56 |
| Comparative Example A-2 | Photoconductor prepared in Comparative Example A-2 | 3.84 |
| Comparative Example A-3 | Photoconductor prepared in Comparative Example A-3 | 3.47 |
| Comparative Example A-4 | Photoconductor prepared in Comparative Example A-4 | 3.81 |

Comparative Example A-5

An electrophotographic photoconductor was prepared following the same procedure as in Example A-1 except for that the acryl-modified polyorganosiloxane was substituted with an acryl-silicone graft copolymer as used in examples of Japan Laid-Open Patent Application No. 5-323646, in which acryl is a main chain and silicone is a side chain (GS-101, produced by Toagosei chemicals co., ltd. The photoconductor was subjected to the Taber abrasion test as described in Example A-3. The result is shown Table 3.

Comparative Reversibly Phase-changing CARTIREDGE Example A-6

An electrophotographic photoconductor was prepared following the same procedure as in Example A-1 except for that the acryl-modified polyorganosiloxane was substituted with an acryl-silicone graft copolymer as used in examples of Japan Laid-Open Patent Application No. 5-323646, in which acryl is a main chain and silicone is a side chain (GS-30, produced by Toagohsei chemicals co., ltd. The photoconductor was subjected to the Taber abrasion test as described in Example A-3. The result is shown Table 3.

Comparative Example A-7

An electrophotographic photoconductor was prepared following the same procedure as in Comparative Example A-6 except for that the acryl-silicone graft copolymer was used in an amount of 1.97 weight parts. The photoconductor was subjected to the Taber abrasion test as described in Example A-3. The result is shown Table 3.

TABLE 3

| No. | Specimen | Wear amount (mg) |
|---|---|---|
| Comparative Example A-5 | Electrographic photoconductor prepared in Comparative Example A-5 | 3.62 |
| Comparative Example A-6 | Electrographic photoconductor prepared in Comparative Example A-6 | 3.95 |
| Comparative Example A-7 | Electrographic photoconductor prepared in Comparative Example A-7 | 3.53 |

As clearly seen from the characterization of the electrophotographic conductors in Example A-1 and A-2 and data of Table 1 and 2, the electrophotographic conductors according to the present invention shows a high sensitivity and excellent abrasion resistance.

Example A-5

The electrophotographic photoconductor which had been subjected to the Taber abrasion test in Example A-3 was used as a specimen. The contact angle of the specimen to pure water was measured using an Automatic Contact Angle Meter, produced by Kyowa Interface Science Co., Ltd. Also, the specimen was examined for the static friction coefficient between a stainless ball and an abrasion surface using full-automatic friction abrasion analyzing apparatus, produced by Kyowa interface science co., ltd. The result is shown in Table 4.

Example A-6

Using the method described in Example A-5, the electrophotographic photoconductor which had been subjected to the Taber abrasion test in Example A-4 was examined for the contact angle to pure water and the static friction coefficient between a stainless ball and an abrasion surface. The result is shown in Table 4.

Comparative Example A-8~Comparative Example A-14

Using the method described in Example A-5, the electrophotographic photoconductors prepared from Comparative Example A-1 to A-7 were examined for their contact angles to pure water and static friction coefficient between a stainless ball and an abrasion surface. The results are shown in Table 4.

TABLE 4

| | Abraded photoconductor No. | Contact angle (°) | Static friction coefficient |
|---|---|---|---|
| Example A-5 | Example A-3 | 96.16 | 0.09 |
| Example A-6 | Example A-4 | 65.49 | 0.08 |
| Comparative Example A-8 | Comparative Example A-1 | 83.05 | 0.47 |
| Comparative Example A-9 | Comparative Example A-2 | 83.41 | 0.43 |
| Comparative Example A-10 | Comparative Example A-3 | 58.89 | 0.42 |
| Comparative Example A-11 | Comparative Example A-4 | 86.00 | 0.44 |
| Comparative Example A-12 | Comparative Example A-6 | 85.89 | 0.41 |
| Comparative Example A-13 | Comparative Example A-6 | 85.11 | 0.34 |
| Comparative Example A-14 | Comparative Example A-7 | 88.90 | 0.37 |

As been clearly seen from these results, the electrophotographic photoconductor according to the present invention has water repellency and low-friction superior to Comparative Examples.

Example A-7

Figure 15:
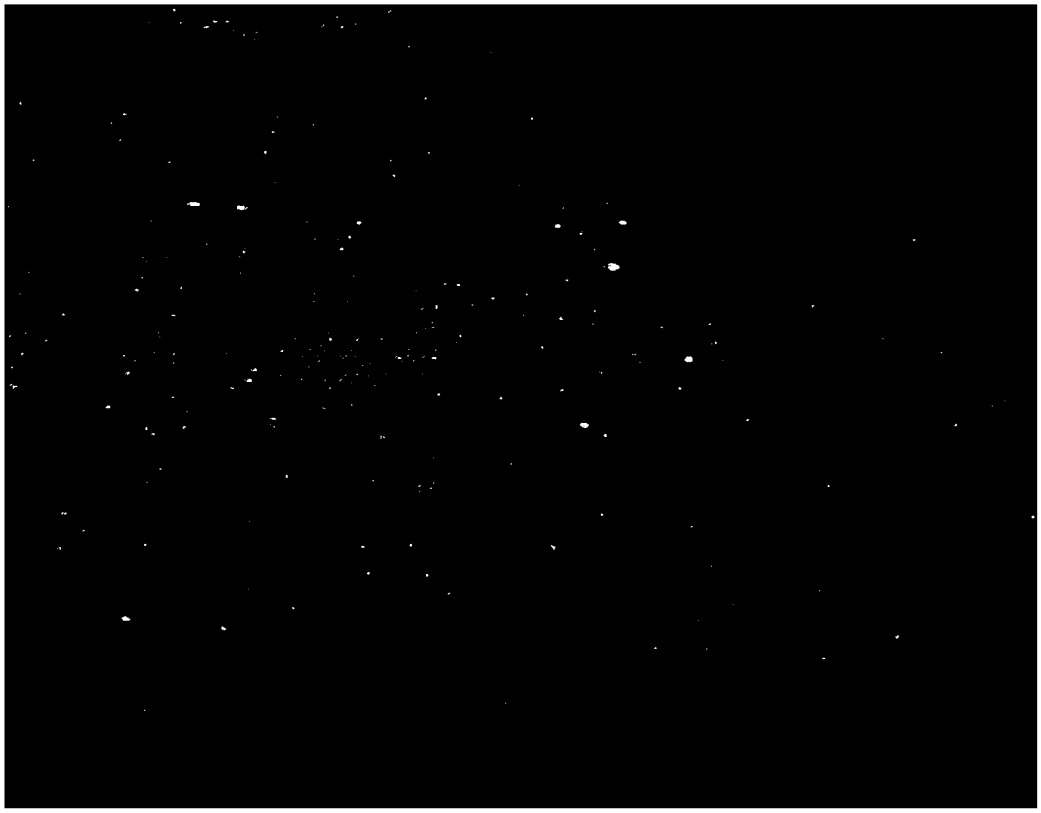
FIG. 15 is a view illustrating morphology of the electrophotographic photoconductor prepared from Example A-1 by a transmission electron microscopy (H-9000 NAR), in which the segment of the charge transport layer is stained with ruthenium steam.

The charge transport layers of the electrophotographic photoconductors prepared in Example A-1 were stained with ruthenium vapors and examined for their morphologies by a transmission electron microscopy (H-9000NAR). The results are schematically shown in FIG. 15. As shown in FIG. 15, acryl-modified polyorganosiloxane having an average particle diameter of 0.2 $\mu$m is uniformly dispersed in the matrix of polycarbonate, showing a so-called microphase separation structure.

Example B•Comparative Example B

Example B-1

On an aluminum cylinder, coating solutions of a under coat layer, charge generation layer and charge transport layer were sequentially coated by dip coating, followed by drying, to form a under coat layer of 3.5 μm, a charge generation layer of 0.2 μm and a charge transport layer of 20 μm.

<Coating Solution of Under Coat Layer> titanium dioxide powders: 400 parts melamine resin: 40 parts alkid resin: 60 parts 2-butanone: 500 parts <Coating Solution of Charge Generation Layer> bisazo pigment of the following formula: 12 parts

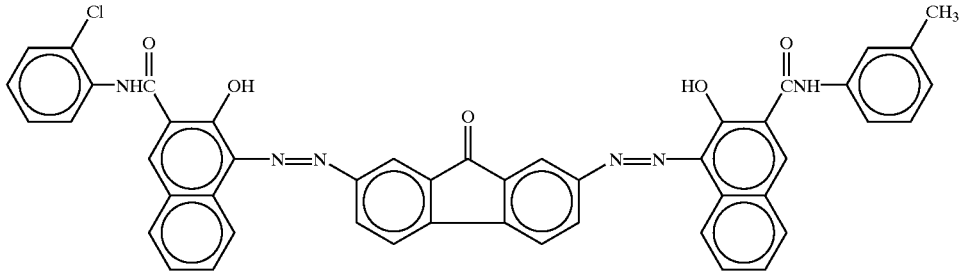

polyvinylbutyral: 5 parts 2-butanone: 200 parts cyclohexanone: 400 parts

<Coating Solution of Charge Transport Layer> polycarbonate(Z-Polyca, produced by Teijin Chemicals Ltd.): 10 parts charge transport material of the following formula: 10 parts

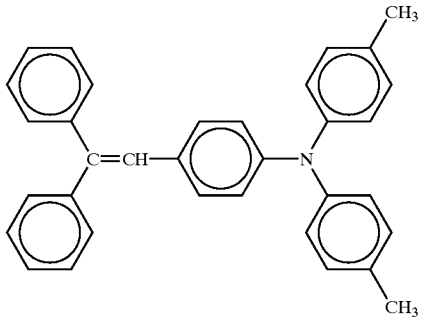

tetrahydrofuran: 100 parts

1% silicone oil (KF50-100 cs, produced by Shin-Etsu Chemical Co., Ltd.) tetrahydrofuran solution: 1 parts A coating solution of a protection layer prepared by ball milling was further coated on the charge transport layer of the electrophotographic photoconductor of Example 1, to form a protection layer of about 5 μm. The resulting electrophotographic photoconductor was partially peeled and its section was observed under TEM to examine the dispersion of acryl-modified polyorganosiloxane. As a result, it was confirmed that the protection layer was a membrane having particles of about 0.1 to 4 μm dispersed therein. Also, when dispersing CHALINE R-170S used in the coating solution of the protection layer in tetrahydrofuran, agglomerated particles disappeared by dissolution but up to primary particles were not dissolved and thereby, could not pass 0.2 μm due to swelling. Thus, it was noted that CHALINE R-170S existed as a micro gel phase in the protection layer.

<Coating Solution of Protection Layer> acryl-modified polyorganosiloxane: 0.6 parts (CHALINE R-170 S, produced by Nissin Chemical Industry Co., Ltd., average primary particle size: 0.2 μm, volume average particle size ($D_{50}$)=30 μm, an acryl-modified polyorganosiloxane compound comprising polyorganosiloxane component 70% and acrylic component 30%)

alumina (average primary particle size: 0.3 μm, produced by Sumitomo chemical co., ltd.): 1.1 parts charge transport material of the following formula (Ip: 5.4 eV): 4 parts

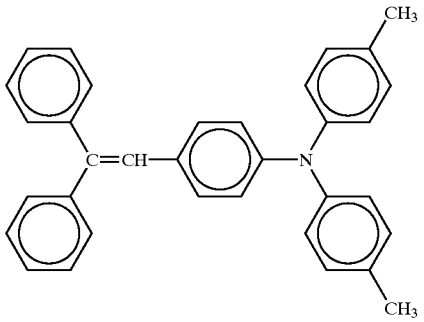

polycarbonate(Z-Polyca, produced by Teijin Chemicals Ltd.): 5.5 parts dispersing agent BYK-P104 (produced by Bigchemi co., ltd.): 0.1 parts tetrahydrofuran: 220 parts cyclohexanone: 80 parts dispersing time by a vibration mil: 60 min Example B-2

An electrophotographic photoconductor was prepared following the same procedure as in Example B-1 except for that CHALINE R-170 (produced by Nissin Chemical Industry Co., Ltd., average primary particle size: 0.2 μm, volume average particle size ($D_{50}$)=350 μm, an acryl-modified polyorganosiloxane compound comprising polyorganosiloxane component 70% and acrylic component 30%) was used as the acryl-modified polyorganosiloxane in the protection layer. Also, the dispersion of the acryl-modified polyorganosiloxane was examined by the same method as in Example B-1 and the same result was obtained.

Example B-3

An electrophotographic photoconductor was prepared following the same procedure as in Example B-1 except for that CHALINE R-210 (produced by Nissin Chemical Industry Co., Ltd., average primary particle size: 0.2 μm, volume average particle size ($D_{50}$)=350 μm, an acryl-modified polyorganosiloxane compound comprising polyorganosiloxane component 10% and acrylic component 90%) was used as the acryl-modified polyorganosiloxane in the protection layer. Also, the dispersion of the acryl-modified polyorganosiloxane was examined by the same method as in Example B-1 and the same result was obtained.

Example B-4

An electrophotographic photoconductor was prepared following the same procedure as in Example B-1 except for that the inorganic filler was substituted with the following material. Also, the dispersion of the acryl-modified polyorganosiloxane was examined by the same method as in Example B-1 and the same result was obtained, titanium oxide (average primary particle size 0.3 μm, produced by Ishihara Sangyo Kaisha, ltd.): 1.1 parts Example B-5

An electrophotographic photoconductor was prepared following the same procedure as in Example B-1 except for that the inorganic filler was substituted with the following material. Also, the dispersion of the acryl-modified polyorganosiloxane was examined by the same method as in Example B-1 and the same result was obtained.

alumina(average primary particle size 0.6 μm, produced by ISHIHARA SANGYO KAISHA,LTD.): 1.1 parts Example B-6

An electrophotographic photoconductor was prepared following the same procedure as in Example B-1 except for that the inorganic filler was substituted with the following material. Also, the dispersion of the acryl-modified polyorganosiloxane was examined by the same method as in Example B-1 and the same result was obtained.

silica(average particle size 0.015 μm, produced by Shin-Etsu silicone co., ltd.): 0.8 parts Example B-7

An electrophotographic photoconductor was prepared following the same procedure as in Example B-1 except for that the inorganic filler was substituted with the following material. Also, the dispersion of the acryl-modified polyorganosiloxane was examined by the same method as in Example B-1 and the same result was obtained.

alumina surface-treated with a titanate-containing coupling agent: 1.1 parts

{1 parts of plenact 5776, a titanate-containing coupling agent produced by Ajinomoto-Fine-Techno Co., Inc. was used per 10 parts of alumina (average primary particle size: 0.3 μm, produced by Sumitomo chemical co., ltd.)}

Example B-8

An electrophotographic photoconductor was prepared following the same procedure as in Example B-1 except for that the inorganic filler was substituted with the following material. Also, the dispersion of the acryl-modified polyorganosiloxane was examined by the same method as in Example B-1 and the same result was obtained.

alumina surface-treated with a aluminum-containing coupling agent: 1.1 parts

{1 parts of plenact AL-M, a aluminium-containing coupling agent produced by Ajinomoto-Fine-Techno Co., Inc. was used per 10 parts of alumina (average primary particle size: 0.3 μm, produced by Sumitomo chemical co., ltd.)}

Example B-9

An electrophotographic photoconductor was prepared following the same procedure as in Example B-1 except for that the charge transport material was substituted with the following material. Also, the dispersion of the acryl-modified polyorganosiloxane was examined by the same method as in Example B-1 and the same result was obtained.

charge transport material of the following formula: 10 parts

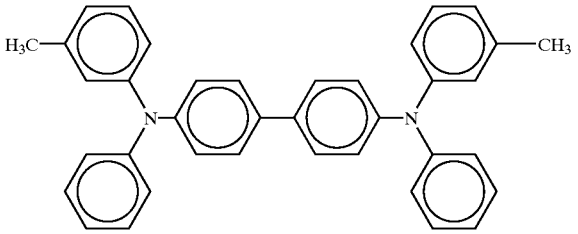

Example B-10

An electrophotographic photoconductor was prepared following the same procedure as in Example B-1 except for that the charge transport material was not contained and the protection layer had a film thickness of 2 μm. Also, the dispersion of the acryl-modified polyorganosiloxane was examined by the same method as in Example B-1 and the same result was obtained.

Example B-11

An electrophotographic photoconductor was prepared following the same procedure as in Example B-1 except for that the binder resin contained in the protection layer was substituted with the following material. Also, the dispersion of the acryl-modified polyorganosiloxane was examined by the same method as in Example B-1 and the same result was obtained.

polyarylate resin(U polymer, produced by Unitika co., ltd.): 10 parts

Example B-12

An electrophotographic photoconductor was prepared following the same procedure as in Example B-1 except for that the binder resin contained in the protection layer was substituted with the following material. Also, the dispersion of the acryl-modified polyorganosiloxane was examined by the same method as in Example B-1 and the same result was obtained.

polystyrene resin: 10 parts

Example B-13

An electrophotographic photoconductor was prepared following the same procedure as in Example B-1 except for that the coating solution of the charge generation layer, the coating solution of the charge transport layer and the coating solution of the protection layer was substituted with the following materials. Also, the dispersion of the acryl-modified polyorganosiloxane was examined by the same method as in Example B-1 and the same result was obtained.

<Coating Solution of Charge Generation Layer>

Y type titanylphthalocyanine: 9 parts polyvinylbunyral: 5 parts 2-butanone: 450 parts <Coating Solution of Charge Transport Layer>

C type polycarbonate: 10 parts charge transport material of the following formula: 8 parts

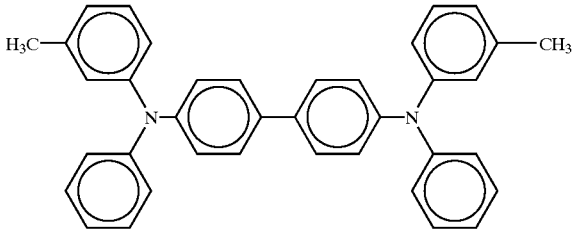

organic sulfur-containing compound of the following formula, produced by Sumitomo Chemical Industry Co., Ltd.: 0.15 parts $S—(CH_2CH_2COOC_{14}H_{29})_2$ toluene: 70 parts <Coating Solution of Protection Layer> acryl-modified polyorganosiloxane (CHALINE R-170S, produced by Nissin Chemical Industry Co., Ltd., average primary particle size: 0.2 μm, average particle size: 30 μm, an acryl-modified polyorganosiloxane compound comprising polyorganosiloxane component 70% and acrylic component 30%): 0.6 parts titanium oxide treated with alumina: 1.2 parts (average primary particle size 0.035 μm, produced by Tayca corporation)

methacryl acid/methylmethacrylate copolymer(acidity 50 mgKOH/g): 0.5 parts

C type polycarbonate, produced by Teijin Chemicals Ltd.: 5.5 parts phenol compound having a hindered amine structure and a hindered phenol structure, represented by the following formula: 0.24 parts charge transport material of the following formula (Ip: 5.3 eV): 4 parts

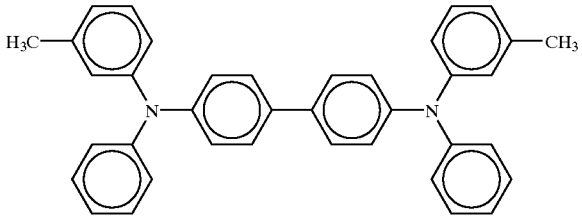

tetrahydrofuran: 250 parts cyclohexanone: 50 parts dispersing time by a vibration mil: 60 min Example B-14

An electrophotographic photoconductor was prepared following the same procedure as in Example B-10 except for that CHALINE R-210 (produced by Nissin Chemical Industry Co., Ltd., average primary particle size: 0.2 μm, volume average particle size ($D_{50}$)=350 μm, an acryl-modified polyorganosiloxane compound comprising polyorganosiloxane component 10% and acrylic component 90%) was used as the acryl-modified polyorganosiloxane in the protection layer. Also, the dispersion of the acryl-modified polyorganosiloxane was examined by the same method as in Example B-1 and the same result was obtained.

Comparative Example B-1

An electrophotographic photoconductor was prepared following the same procedure as in Example B-1 except for that the protection layer was not included.

Comparative Example B-2

An electrophotographic photoconductor was prepared following the same procedure as in Example B-1 except for that acryl-modified polyorganosiloxane was not added to the coating solution of the protection layer.

Comparative Example B-3

An electrophotographic photoconductor was prepared following the same procedure as in Example B-4 except for that acryl-modified polyorganosiloxane was not added to the coating solution of the protection layer.

Comparative Example B-4

An electrophotographic photoconductor was prepared following the same procedure as in Example B-5 except for that

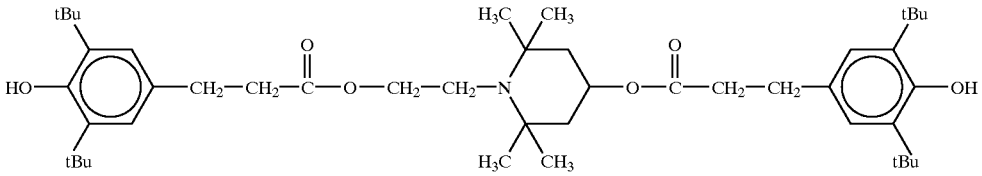

acryl-modified polyorganosiloxane was not added to the coating solution of the protection layer.

Comparative Example B-5

An electrophotographic photoconductor was prepared following the same procedure as in Example B-6 except for that acryl-modified polyorganosiloxane was not added to the coating solution of the protection layer.

Comparative Example B-6

An electrophotographic photoconductor was prepared following the same procedure as in Example B-7 except for that acryl-modified polyorganosiloxane was not added to the coating solution of the protection layer.

Comparative Example B-7

An electrophotographic photoconductor was prepared following the same procedure as in Example B-8 except for that acryl-modified polyorganosiloxane was not added to the coating solution of the protection layer.

Comparative Example B-8

An electrophotographic photoconductor was prepared following the same procedure as in Example B-13 except for that the protection layer was not included.

Comparative Example B-9

An electrophotographic photoconductor was prepared following the same procedure as in Example B-13 except for that acryl-modified polyorganosiloxane was not added to the coating solution of the protection layer.

Comparative Example B-10

An electrophotographic photoconductor was prepared following the same procedure as in Example B-1 except for that the following material was used instead of the acryl-modified polyorganosiloxane in the coating solution of the protection layer.

Silicon corpuscle (GE Toshiba silicones, TOSPEARL 105, average particle size 0.5 $\mu$m).

Comparative Example B-11

An electrophotographic photoconductor was prepared following the same procedure as in Example B-1 except for that the following material was used instead of the acryl-modified polyorganosiloxane in the coating solution of the protection layer.

acryl-silicone graft polymer (Toagosei chemicals co., ltd., SYMAC US-450, prepared by extracting only solids from water-based emulsion of 30 solid %)

Comparative Example B-12

An electrophotographic photoconductor was prepared following the same procedure as in Example B-1 except for that the following material was used instead of the acryl-modified polyorganosiloxane in the coating solution of the protection layer.

silicone graft polyacryl resin prepared by polymerizing methacryloxy-terminated dimethylsiloxane 30 parts with methylmethacrylate 70 parts in the presence of azobisisobutyronitrile, a radical reaction initiating agent, in toluene/water based emulsion

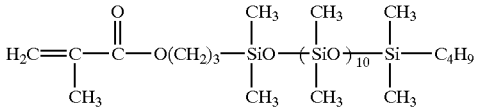

Comparative Example B-13

An electrophotographic photoconductor was prepared following the same procedure as in Example B-1 except for that the following material was used instead of the acryl-modified polyorganosiloxane in the coating solution of the protection layer.

alkoxy-modified silicone(Shin-Etsu silicones, KF-851)

Comparative Example B-14

An electrophotographic photoconductor was prepared following the same procedure as in Example B-1 except for that the following material was used instead of the acryl-modified polyorganosiloxane in the coating solution of the protection layer.

spherical melamine particles (Nippon Shokubai co., ltd., EPOSTAR S, primary particle size: 0.3 $\mu$m)

Each of the electrophotographic photoconductors prepared in Example B-1 to B-18 and electrophotographic photoconductors prepared in Comparative Example B-1 to B-14 was mounted on a digital copier IMAGIO MF6550 produced by Ricoh Co., Ltd or its modification (wavelength of light source laser for recording: 655 nm). After continuously printing 50,000 sheets of plain paper under circumstances at a temperature of 25° C. and a humidity of 90%, a dark portion potential and light portion potential of the electrophotographic photoconductor were measured and the image quality was examined. The measurement of the dark portion potential and light portion potential, and examination of image quality were performed as follows.

Dark portion potential: a surface potential of a primarily charged photoconductor reaching a developing part Light portion potential: a surface potential of a primarily charged photoconductor reaching a developing part after exposure of image (the entire surface) to light Image quality: synthetic examination with respect to image density, reproducibility of micro lines, scratched letters, resolution, greasing, etc.

Also, after printing 50,000 sheets, the thickness of the photoconductor was measured and compared to the thickness before the printing to determine the wear amount. The results are shown in Table 5.

TABLE 5

| | Initially | | | After printing 100,000 sheets | | | |
|---|---|---|---|---|---|---|---|
| | Dark Portion Potential (−V) | Light Portion Potential (−V) | Image Quality | Dark Portion Potential (−V) | Light Portion Potential (−V) | Image Quality | Wear Amount |
| Example B-1 | 800 | 90 | Good | 810 | 105 | Good | 0.8 |
| Example B-2 | 800 | 95 | Good | 790 | 105 | Good | 0.8 |
| Example B-3 | 800 | 100 | Good | 800 | 100 | Decreased in resolution | 0.9 |
| Example B-4 | 810 | 100 | Good | 800 | 105 | Good | 0.7 |
| Example B-5 | 810 | 95 | Good | 820 | 100 | Good | 0.8 |
| Example B-6 | 790 | 90 | Good | 820 | 90 | Good | 0.8 |
| Example B-7 | 800 | 90 | Good | 810 | 95 | Good | 0.8 |
| Example B-8 | 810 | 95 | Good | 800 | 100 | Good | 0.8 |
| Example B-9 | 810 | 100 | Good | 800 | 110 | Good | 0.8 |
| Example B-10 | 820 | 140 | Good | 820 | 220 | Decreased in resolution | 0.7 |
| Example B-11 | 800 | 95 | Good | 800 | 110 | Good | 1.2 |
| Example B-12 | 800 | 90 | Good | 800 | 50 | Slight toner deposition observed | 4.0 |
| Example B-13 | 790 | 110 | Good | 800 | 120 | Good | 0.8 |
| Example B-14 | 790 | 120 | Good | 810 | 130 | Decreased in resolution | 0.8 |
| Comp. Ex. B-1 | 800 | 50 | Good | 500 | 45 | Greasing in the entire surface | 8.5 |
| Comp. Ex. B-2 | 800 | 95 | Good | 800 | 160 | Image deletion by filming | 1.0 |
| Comp. Ex. B-3 | 810 | 90 | Good | 800 | 180 | Image deletion by filming | 0.8 |
| Comp. Ex. B-4 | 810 | 95 | Good | 810 | 180 | Image deletion by filming | 1.0 |
| Comp. Ex. B-5 | 800 | 80 | Good | 800 | 150 | Image deletion by filming | 1.0 |
| Comp. Ex. B-6 | 810 | 90 | Good | 800 | 180 | Image deletion by filming | 1.0 |
| Comp. Ex. B-7 | 810 | 80 | Good | 810 | 170 | Image deletion by filming | 1.0 |
| Comp. Ex. B-8 | 800 | 50 | Good | 450 | 60 | Greasing in the entire surface | 10.0 |
| Comp. Ex. B-9 | 800 | 100 | Good | 800 | 140 | Image deletion by filming | 1.0 |
| Comp. Ex. B-10 | 800 | 100 | Good | 800 | 140 | Image deletion by filming | 0.8 |
| Comp. Ex. B-11 | 800 | 105 | Good | 810 | 160 | Image deletion by filming | 0.9 |
| Comp. Ex. B-12 | 800 | 100 | Good | 805 | 160 | Image deletion by filming | 0.9 |
| Comp. Ex. B-13 | 810 | 120 | Good | 815 | 260 | Image deletion by filming | 0.8 |
| Comp. Ex. B-14 | 810 | 110 | Good | 800 | 150 | Image deletion by filming | 0.8 |

From the results of Table 4, it was noted that when the protection layer was not included, film wear was increased and greasing occurred in the entire surface due to charge leakage after 50,000 sheets, whereby the life span of the apparatus was terminated. Also, it was noted that when only the inorganic filler was added to the protection layer, wear resistance was considerably increased but cleaning properties became poor, whereby filming of impurities, which were believed as components of a toner or developer occurred on the photoconductor. Therefore, under a high humidity condition, image flowing might occur ("image flowing" means phenomenon that when a latent electrostatic image is formed, as the electric resistance of a certain part of a photoconductor where impurities are adhered to the surface of the photoconductor via filming and the impurities are absorbed absorption of the substances is decreased, charges are diffused in a surface direction of the photoconductor, thereby the image being not formed after developing or the image being deformed like flowing). In contrast, when both acryl-modified polyorganosiloxane and an inorganic filler were added to the protection layer, wear resistance and cleaning properties were improved, thereby being capable of producing images of a high quality under a humid circumstance over a long period of time.

Also, when both acryl-modified polyorganosiloxane and an inorganic filler were added to the protection layer, if the amount of polyorganosiloxane was greater than that of (meth) acrylate or a mixture of 70 wt % or more of (meth) acrylate and 30 wt % or less of a monomer copolymerizable therewith, the resolution did not decrease, producing stable images.

Further, when both acryl-modified polyorganosiloxane and an inorganic filler were added to the protection layer, if charge transport material was contained in the protection layer, potential was maintained constantly and hence, image density did not decrease, thereby producing stable images.

In addition, when both acryl-modified polyorganosiloxane and an inorganic filler were added to the protection layer, if polycarbonate resin or poly acrylate resin was used in the protection layer, wear resistance of the protection layer was increased and greasing due to film abrasion did not occur, thereby producing stable images.

Meanwhile, when silicone particles or silicone graft acryl resin was added instead of the acryl-modified polyorganosiloxane, the cleaning property was deteriorated after repeated printings and image flowing occurred by filming.

Also, when an inorganic filler was mixed with an organic filler, the cleaning property was not improved and moreover, image flowing occurred by filming.

As described above, by forming a protection layer of an electrophotographic photoconductor and adding an inorganic filler and an acryl-modified polyorganosiloxane compound to the protection layer, it is possible to provide an electrophotographic photoconductor excellent in wear resistance, slide, removal of impurities. Accordingly, it is possible to provide an electrophotographic photoconductor in which problems associated with greasings caused by pin holes due to discharge destruction resulting from decrease of film thickness due to abrasion or poor cleaning, image omission due to impurity adhesion, or abnormal image such as image flowing are eliminated, thereby producing stable images over a long period of time.

Also, by using a compound formed by grafting an acryl polymer to a main chain of silicone or a emulsified graft copolymer represented by the formula (I) or formula (II) as the acryl-modified polyorganosiloxane compound silicone, it is possible to provide an electrophotographic photoconductor which is capable of producing stable images over a long period of time.

When the amount of polyorganosiloxane part is greater than that acryl polymer part, the slide and impurity removal, and durability of such properties are further improved and thus, it is possible to more stable images over a long period of time.

According to the present invention, the acryl-modified polyorganosiloxane compounds are dispersed in the particle phase of the protection layer. Therefore, it is possible to simultaneously attain wear resistance, and slide and impurity removal, which have been incompatible in the prior art. Also, since the acryl-modified polyorganosiloxane compounds are in the micro gel phase, they can readily form the particulate disperse bodies and can provide an electrophotographic photoconductor which has excellent wear resistance as well as slide and impurity removal and is capable of producing stable images after repeated printings at a low cost Also, according to the present invention by using an inorganic filler comprising at least metal oxide, it is possible to provide an electrophotographic photoconductor which has excellent wear resistance and can produce stable and high quality images over a long period of time without abnormal images such as greasing due to abrasion. Further, by surface-treating the metal oxide of the filler with a treating agent, dispersion of the inorganic filler and thereby, the stability of the coating solution are improved. Therefore, it is possible to produce a photoconductor without defects of the coating thereon, a photoconductor with a superior mechanical strength and wear resistance and a photoconductor capable of maintaining a coefficient of friction at a low level.

According to the present invention by adding charge transport material to the protection layer, charge mobility is improved, whereby sensitivity is increased and residual potential is reduced. Further, the difference between light portion potential and dark portion potential can be reduced. Therefore, it is possible to provide an photoconductor which can stably produce images of high quality at a high speed.

Also, by using polycarbonate resin and/or polyarylate resin as a binder resin in the protection layer, maintenance of the inorganic filler in the protection is improved and when the acryl-modified polyorganosiloxane compound is added, the mechanical strength is good. Therefore, it is possible to provide a photoconductor which is excellent in its mechanical strength and wear resistance and is capable of holding the coefficient of friction at a low level.

In any electrophotographic method, electrophotographic apparatus, process cartridge using the electrophotographic photoconductor according to the present invention, there is no need for exchanging the photoconductor for a long period of time. Also, maintenance and repairing are easy and convenient and cost performance is high. Further, it is possible to stably produce high quality images.

Example C•Comparative Example C

Example C-1

On an aluminum cylinder, coating solutions of a under coat layer, charge generation layer and charge transport layer were sequentially coated by dip coating, followed by drying, to form a under coat layer of 3.5 μm, a charge generation layer of 0.2 μm and a charge transport layer of 20 μm.

<Coating Solution of Under Coat Layer> titanium dioxide powders: 400 parts melamine resin: 40 parts alkid resin: 60 parts 2-butanone: 500 parts <Coating Solution of Charge Generation Layer>

Y type titanylphthlocyanine: 9 parts polyvinylbutyral: 5 parts 2-butanone: 450 parts <Coating Solution of Charge Transport Layer> polycarbonate(Z-Polyca, produced by Teijin Chemicals Ltd.): 10 parts charge transport material of the following formula: 10 parts

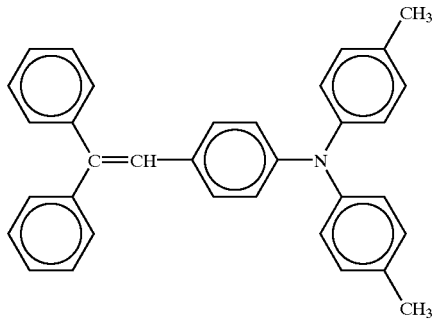

tetrahydrofuran: 100 parts

1% silicone oil (KF50-100cs, produced by Shin-Etsu Chemical Co., Ltd.) tetrahydrofuran solution: 1 parts A coating solution of a protection layer prepared by ball milling was further coated on the charge transport layer of the electrophotographic photoconductor, to form a protection layer of about 5 μm.

<Coating Solution of Protection Layer> acryl-modified polyorganosiloxane: 1.2 parts (CHALINE R-170 S, produced by Nissin Chemical Industry Co., Ltd., average primary particle size: 0.2 μm, volume average particle size ($D_{50}$)=30 μm, an acryl-modified polyorganosiloxane compound comprising polyorganosiloxane component 70% and acrylic component 30%)

alumina (average primary particle size: 0.4 μm, produced by Sumitomo chemical co., ltd.): 1.1 parts polymeric charge transport material of the following formula: 9.5 parts

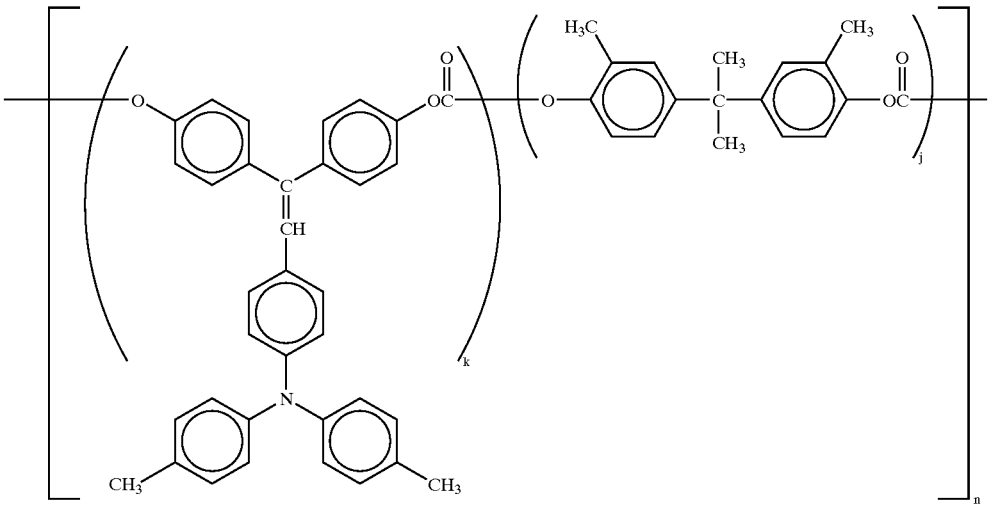

(random copolymer, weight average molecular weight based on polystyrene; 150000)

dispersing agent BYK-P104 (produced by Bigchemi co., ltd.): 0.1 parts tetrahydrofuran: 220 parts cyclohexanone: 80 parts dispersing time by a vibration mil: 60 min Example C-2

An electrophotographic photoconductor was prepared following the same procedure as in Example C-1 except for that CHALINE R-170 (produced by Nissin Chemical Industry Co., Ltd., average primary particle size: 0.2 μm, volume average particle size (D50)=350 μm, an acryl-modified polyorganosiloxane compound comprising polyorganosiloxane component 70% and acrylic component 30%) was used as the acryl-modified polyorganosiloxane in the protection layer.

Example C-3

An electrophotographic photoconductor was prepared following the same procedure as in Example C-1 except for that CHALINE R-210 (produced by Nissin Chemical Industry Co., Ltd., average primary particle size: 0.2 μm, volume average particle size ($D_{50}$)=350 μm, an acryl-modified polyorganosiloxane compound comprising polyorganosiloxane component 10% and acrylic component 90%) was used as the acryl-modified polyorganosiloxane in the protection layer.

Example C-4

An electrophotographic photoconductor was prepared following the same procedure as in Example C-1 except for that the inorganic filler was substituted with the following material.

titanium oxide (average primary particle size 0.3 μm, produced by ISHIHARA SANGYO KAISHA,LTD.): 1.1 parts Example C-5

An electrophotographic photoconductor was prepared following the same procedure as in Example C-1 except for that the inorganic filler was substituted with the following material. Also, the dispersion of the acryl-modified polyorganosiloxane was examined by the same method as in Example C-1 and the same result was obtained.

silica(average particle size 0.015 μm, produced by Shin-Etsu silicones): 0.8 parts Example C-6

An electrophotographic photoconductor was prepared following the same procedure as in Example C-1 except for that the inorganic filler was substituted with the following material.

alumina surface-treated with a titanate-containing coupling agent: 1.1 parts

{1 parts of plenact KR TTS, a titanate-containing coupling agent produced by Ajinomoto-Fine-Techno Co., Inc. was used per 10 parts of alumina (average primary particle size: 0.3 μm, produced by Sumitomo chemical co., ltd.)}

Example C-7

An electrophotographic photoconductor was prepared following the same procedure as in Example C-1 except for that the inorganic filler was substituted with the following material.

alumina surface-treated with a aluminum-containing coupling agent: 1.1 parts

{1 parts of plenact AL-M, a aluminium-containing coupling agent produced by Ajinomoto-Fine-Techno Co., Inc. was used per 10 parts of alumina (average primary particle size: 0.3 μm, produced by Sumitomo chemical co., ltd.)}

Example C-8

An electrophotographic photoconductor was prepared following the same procedure as in Example C-1 except for that the charge transport material was substituted with the following material.

polymeric charge transport material of the following formula: 9.5 parts

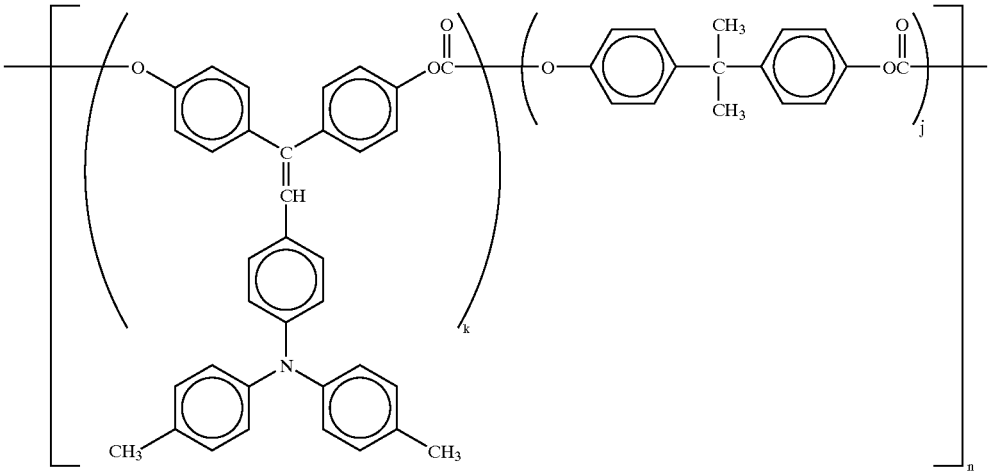

(random copolymer, weight average molecular weight based on polystyrene; 90000)

Example C-9

An electrophotographic photoconductor was prepared following the same procedure as in Example C-1 except for that the high molecular charge transport material was substituted with the following material.

high molecular charge transport material of the following formula: 9.5 parts (random copolymer, weight average molecular weight based on polystyrene; 130000)

Example C-10

An electrophotographic photoconductor was prepared following the same procedure as in Example C-1 except for that the high molecular charge transport material was substituted with the following material.

high molecular charge transport material of the following formula: 9.5 parts

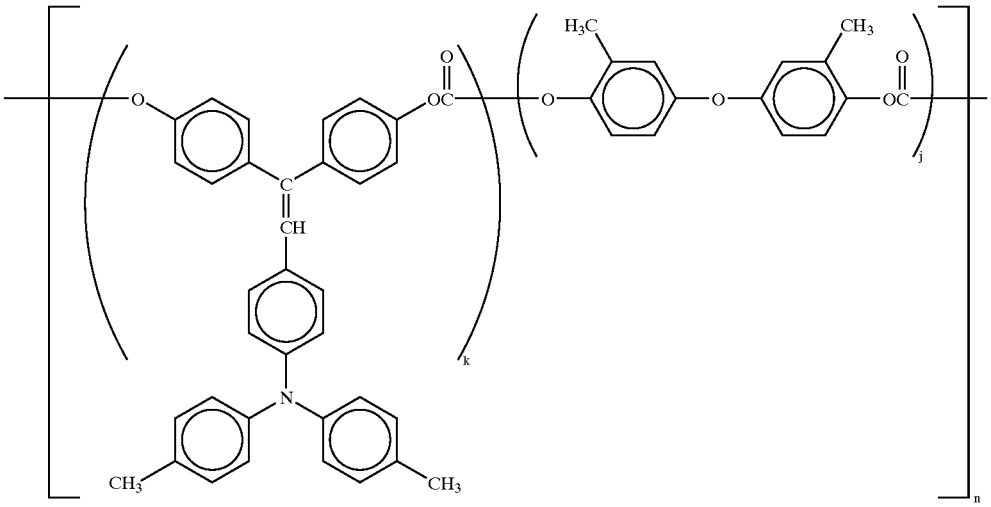

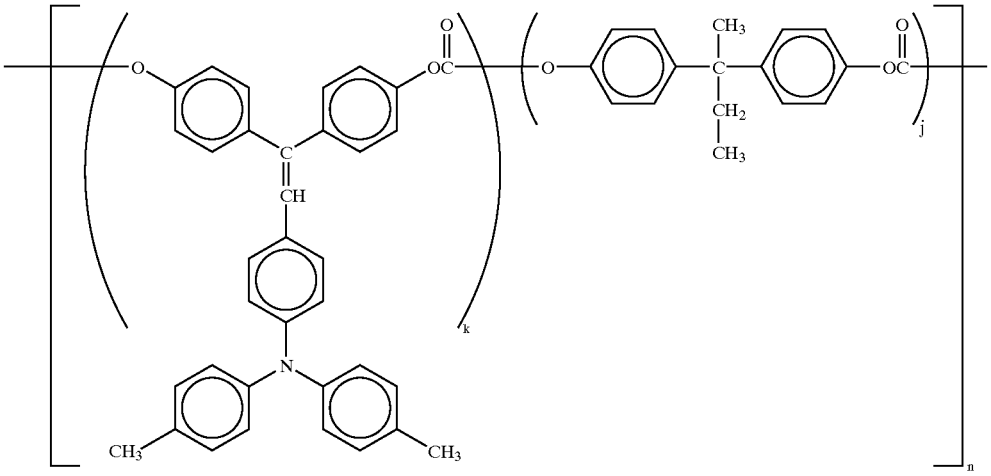

(random copolymer, weight average molecular weight based on polystyrene; 110000)

Example C-11

An electrophotographic photoconductor was prepared following the same procedure as in Example C-1 except for that the high molecular charge transport material was substituted with the following material.

high molecular charge transport material of the following formula: 9.5 parts

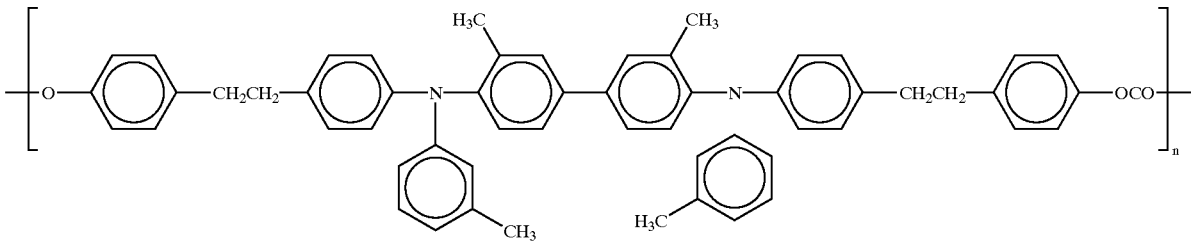

weight average molecular weight based on polystyrene; 53000

Example C-12

An electrophotographic photoconductor was prepared following the same procedure as in Example C-1 except for that the high molecular charge transport material was substituted with the following material.

high molecular charge transport material of the following formula: 9.5 parts weight average molecular weight based on polystyrene; 70000

Example C-13

An electrophotographic photoconductor was prepared following the same procedure as in Example C-1 except for that the high molecular charge transport material was substituted with the following material.

high molecular charge transport material of the following formula: 9.5 parts

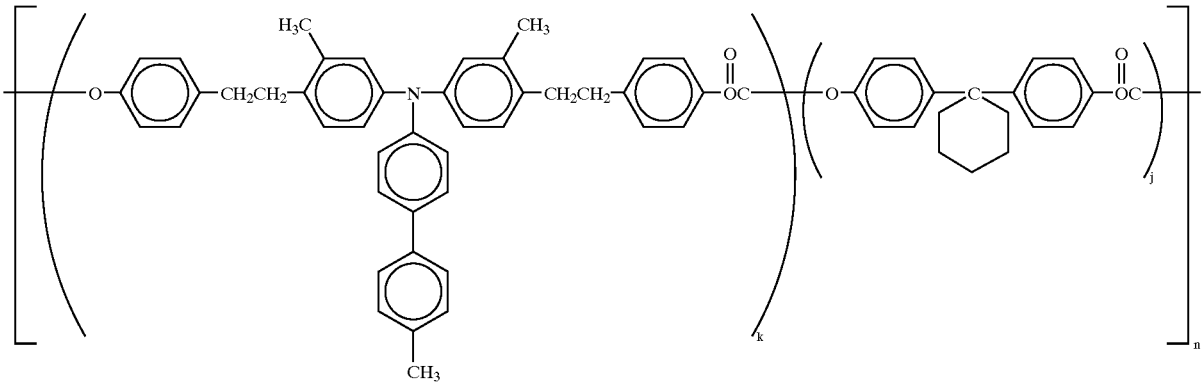

weight average molecular weight based on polystyrene; 220000

Example C-14

An electrophotographic photoconductor was prepared following the same procedure as in Example C-1 except for that the high molecular charge transport material was substituted with the following material.

high molecular charge transport material of the following formula: 9.5 parts

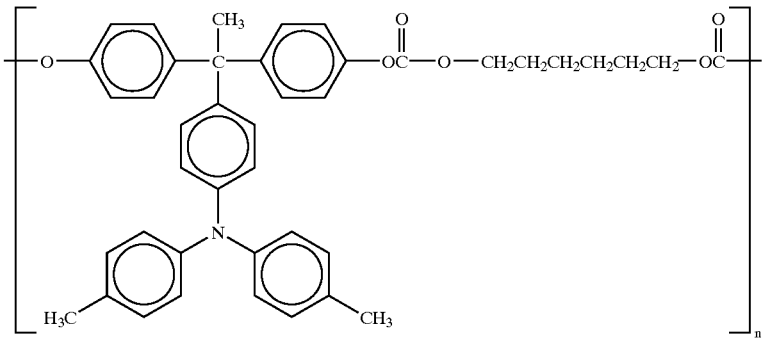

weight average molecular weight based on polystyrene; 650,000

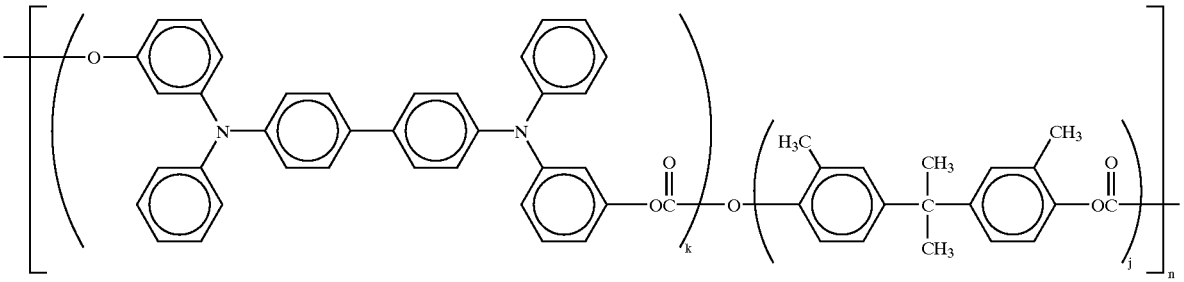

Example C-15

An electrophotographic photoconductor was prepared following the same procedure as in Example C-1 except for that the high molecular charge transport material was substituted with the following material.

high molecular charge transport material of the following formula: 9.5 parts random copolymer, weight average molecular weight based on polystyrene; 110000

Example C-16

An electrophotographic photoconductor was prepared following the same procedure as in Example C-1 except for that the high molecular charge transport material was substituted with the following material.

high molecular charge transport material of the following formula: 9.5 parts

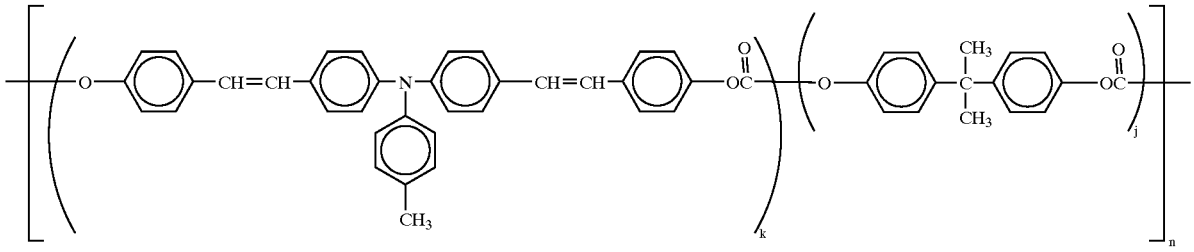

random copolymer, weight average molecular weight based on polystyrene; 160000

Example C-17

An electrophotographic photoconductor was prepared following the same procedure as in Example C-1 except for that the coating solution of the charge generation layer, coating solution of the charge transport layer or coating solution of the protection layer was substituted with the following materials.

<Coating Solution of Charge Generation Layer> bisazo pigment of the following formula: 12 parts polyvinylbunyral: 5 parts 2-butanone: 200 parts cyclohexanone: 400 parts

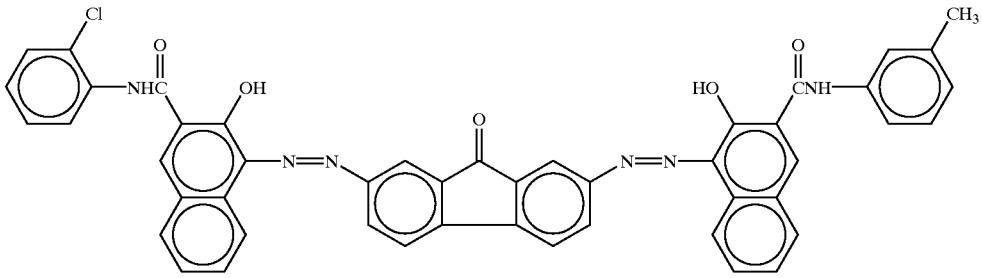

<Coating Solution of Charge Transport Layer>

C type polycarbonate: 10 parts charge transport material of the following formula: 8 parts

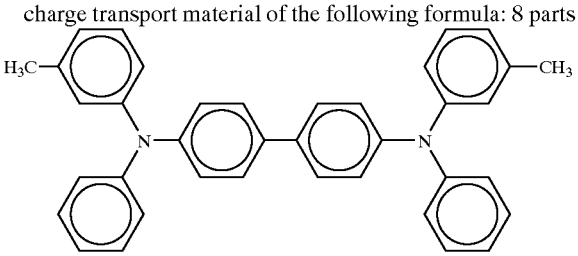

organic sulfur-containing compound of the following formula, produced by Sumitomo chemical co., ltd.: 0.15 parts $S—(CH_2CH_2COOC_{14}H_{29})_2$ toluene: 70 parts <Coating Solution of Protection> acryl-modified polyorganosiloxane (CHALINE R-170S, produced by Nissin Chemical Industry Co., Ltd., average primary particle size: 0.2 μm, average particle size: 30 μm, an acryl-modified polyorganosiloxane compound comprising polyorganosiloxane component 70% and acrylic component 30%): 1.2 parts titanium oxide treated with alumina: 1.2 parts (average primary particle size 0.035 μm, produced by Tayca corporation)

methacryl acid/methylmethacrylate copolymer(acidity 50 mgKOH/g): 0.5 parts compound having a hindered amine structure and a hindered phenol structure, represented by the following formula: 0.24 parts

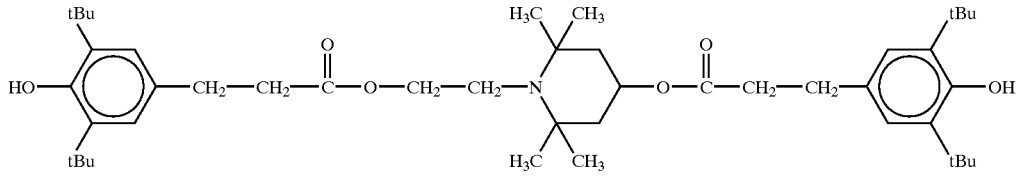

charge transport material of the following formula: 9.5 parts

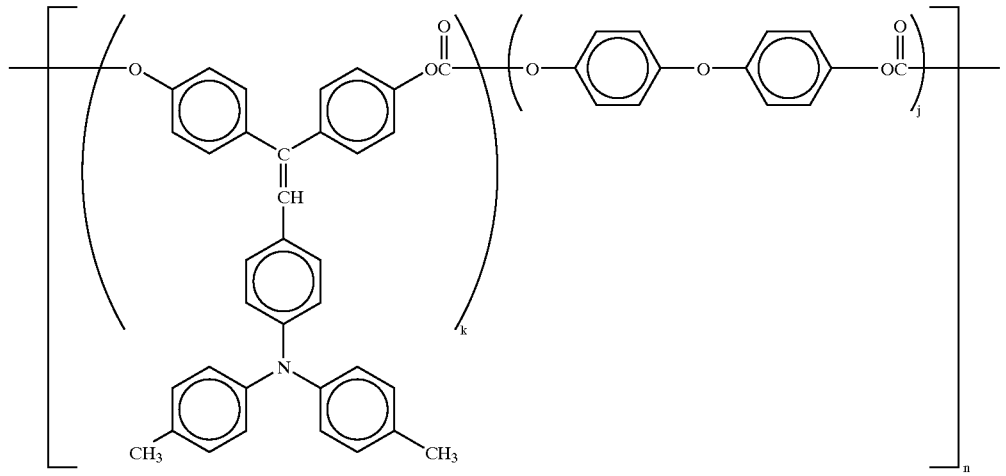

(random copolymer, weight average molecular weight based on polystyrene; 140000)

tetrahydrofuran: 250 parts cyclohexanone: 50 parts dispersing time by a vibration mil: 60 min Example C-18

An electrophotographic photoconductor was prepared following the same procedure as in Example C-17 except for that CHALINE R-210 (produced by Nissin Chemical Industry Co., Ltd., average primary particle size: 0.2 μm, volume average particle size ($D_{50}$)=350 μm, an acryl-modified polyorganosiloxane compound comprising polyorganosiloxane component 10% and acrylic component 90%) was used as the acryl-modified polyorganosiloxane in the protection layer.

Example C-19

An electrophotographic photoconductor was prepared following the same procedure as in Example C-1 except for that the weight average molecular weight of the high molecular charge transport material was 38000.

Example C-20

An electrophotographic photoconductor was prepared following the same procedure as in Example C-17 except for that the weight average molecular weight of the high molecular charge transport material was 47000.

Comparative Example C-1

An electrophotographic photoconductor was prepared following the same procedure as in Example C-1 except for that the protection layer was not included.

Comparative Example C-2

An electrophotographic photoconductor was prepared following the same procedure as in Example C-17 except for that the protection layer was not included.

Example C-21

An electrophotographic photoconductor was prepared following the same procedure as in Example C-1 except for that alumina was not added to the coating solution of the protection layer.

Example C-22

An electrophotographic photoconductor was prepared following the same procedure as in Example C-2 except for that alumina was not added to the coating solution of the protection layer.

Example C-23

An electrophotographic photoconductor was prepared following the same procedure as in Example C-3 except for that alumina was not added to the coating solution of the protection layer.

Comparative Example C-3

An electrophotographic photoconductor was prepared following the same procedure as in Example C-1 except for that acryl-modified polyorganosiloxane was not added to the coating solution of the protection layer.

Comparative Example C-4

An electrophotographic photoconductor was prepared following the same procedure as in Example C-4 except for that acryl-modified polyorganosiloxane was not added to the coating solution of the protection layer.

Comparative Example C-5

An electrophotographic photoconductor was prepared following the same procedure as in Example C-5 except for that acryl-modified polyorganosiloxane was not added to the coating solution of the protection layer.

Comparative Example C-6

An electrophotographic photoconductor was prepared following the same procedure as in Example C-6 except for that acryl-modified polyorganosiloxane was not added to the coating solution of the protection layer.

Comparative Example C-7

An electrophotographic photoconductor was prepared following the same procedure as in Example C-7 except for that acryl-modified polyorganosiloxane was not added to the coating solution of the protection layer.

Example C-24

An electrophotographic photoconductor was prepared following the same procedure as in Example C-1 except for that the high molecular charge transport material was substituted with low molecular charge transport material and a binder resin.

polycarbonate(Z-Polyca, produced by Teijin Chemicals Ltd.): 5 parts charge transport material of the following formula: 4.5 parts

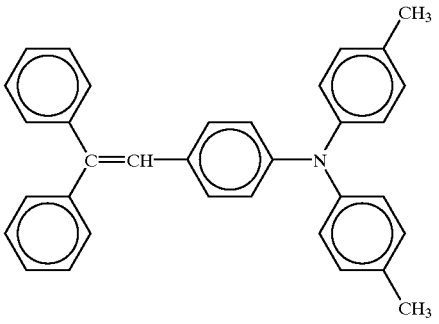

Example C-25

An electrophotographic photoconductor was prepared following the same procedure as in Example C-3 except for that the high molecular charge transport material was substituted with low molecular charge transport material and a binder resin.

polycarbonate(Z-Polyca, produced by Teijin Chemicals Ltd.): 5 parts charge transport material of the following formula: 4.5 parts

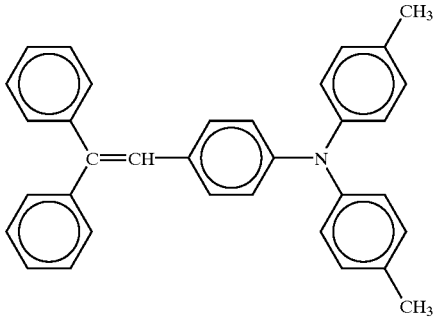

Example C-26

An electrophotographic photoconductor was prepared following the same procedure as in Example C-17 except for that the high molecular charge transport material was substituted with low molecular charge transport material and a binder resin.

polycarbonate(Z-Polyca, produced by Teijin Chemicals Ltd.): 5 parts charge transport material of the following formula: 4.5 parts

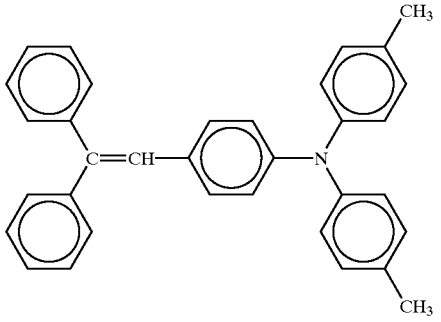

Each of the electrophotographic photoconductors prepared in Example C-1 to C-26 and electrophotographic photoconductors prepared in Comparative Example C-1 to C-7 was mounted on a digital copier IMAGIO MF6550 produced by Ricoh Co., Ltd or its modification (wavelength of light source laser for recording: 655 nm). After continuously printing 100,000 sheets of plain paper under an circumstance at room temperature and humidity, a dark portion potential and light portion potential of the electrophotographic photoconductor were measured and the image quality was examined. The measurement of the dark portion potential and light portion potential, and examination of image quality were performed as follows.

Dark portion potential: a surface potential of a primarily charged photoconductor reaching a developing part Light portion potential: a surface potential of a primarily charged photoconductor reaching a developing part after exposure of image (the entire surface) to light Image quality: synthetic examination with respect to image density, reproducibility of micro lines, scratched letters, resolution, greasing, etc.

Also, after printing 100,000 sheets, the thickness of the photoconductor was measured and compared to the thickness before the printing to determine the wear amount. In addition, fat was applied onto the surface of each photoconductor and stored at room temperature and room humidity for 7 days. After 7 days, the photoconductor surfaces were examined for whether crack took places. The results are shown in Table 6.

TABLE 6

| | Initially | | | After printing 100,000 sheets | | | | |
|---|---|---|---|---|---|---|---|---|
| | Dark Portion Potential (−V) | Light Portion Potential (−V) | Image Quality | Dark Portion Potential (−V) | Light Portion Potential (−V) | Image Quality | Wear Amount (μm) | Crack due to Fat Adhesion |
| Example C-1 | 910 | 160 | Good | 900 | 185 | Good | 0.7 | None |
| Example C-2 | 910 | 160 | Good | 910 | 185 | Good | 0.7 | None |
| Example C-3 | 910 | 160 | Good | 900 | 190 | Local emission of image | 0.7 | None |
| Example C-4 | 910 | 165 | Good | 900 | 195 | Good | 0.5 | None |
| Example C-5 | 910 | 160 | Good | 905 | 185 | Good | 0.7 | None |
| Example C-6 | 900 | 160 | Good | 900 | 175 | Good | 0.7 | None |
| Example C-7 | 900 | 160 | Good | 910 | 180 | Good | 0.7 | None |
| Example C-8 | 910 | 160 | Good | 900 | 185 | Good | 0.8 | None |
| Example C-9 | 900 | 160 | Good | 900 | 185 | Good | 0.5 | None |
| Example C-10 | 900 | 160 | Good | 910 | 190 | Good | 0.7 | None |
| Example C-11 | 910 | 165 | Good | 910 | 200 | Good | 0.8 | None |
| Example C-12 | 910 | 160 | Good | 900 | 205 | Good | 0.5 | None |
| Example C-13 | 900 | 165 | Good | 910 | 210 | Good | 0.4 | None |
| Example C-14 | 910 | 160 | Good | 910 | 230 | Good | 1.6 | None |
| Example C-15 | 910 | 155 | Good | 900 | 235 | Good | 1.5 | None |
| Example C-16 | 900 | 160 | Good | 910 | 185 | Good | 1.7 | None |
| Example C-17 | 890 | 120 | Good | 880 | 135 | Good | 0.4 | None |
| Example C-18 | 890 | 125 | Good | 890 | 150 | Good | 0.4 | None |
| Example C-19 | 900 | 160 | Good | 900 | 185 | Good | 2.6 | None |
| Example C-20 | 910 | 160 | Good | 900 | 185 | Good | 2.4 | None |
| Example C-21 | 900 | 130 | Good | 900 | 170 | Good | 5.5 | None |
| Example C-22 | 900 | 130 | Good | 900 | 170 | Good | 5.5 | None |
| Example C-23 | 900 | 130 | Good | 800 | 175 | Local omission of image | 5.5 | None |
| Example C-24 | 900 | 155 | Good | 900 | 180 | Local image defects due to scratch | 1.0 | Observed |
| Example C-25 | 890 | 120 | Good | 880 | 175 | Local image defects due to scratch | 1.1 | Observed |
| Example C-26 | 900 | 155 | Good | 900 | 185 | Local image defect and omission of image due to scratch | 1.1 | Observed |
| Comp. Ex. C-1 | 900 | 130 | Good | 500 | 170 | Greasing in the entire surface | 8.5 | Observed |
| Comp. Ex. C-2 | 900 | 120 | Good | 500 | 150 | Grassing in the entire surface | 8.0 | Observed |
| Comp. Ex. C-3 | 910 | 160 | Good | 910 | 185 | Local omission of image due to impurity adhesion | 0.8 | None |
| Comp. Ex. C-4 | 910 | 165 | Good | 910 | 200 | Local omission of image due to impurity adhesion | 0.7 | None |
| Comp. Ex. C-5 | 900 | 160 | Good | 900 | 180 | Local omission of image due to impurity adhesion | 0.8 | None |
| Comp. Ex. C-6 | 910 | 155 | Good | 900 | 185 | Local omission of image due to impurity adhesion | 0.8 | None |
| Comp. Ex. C-7 | 910 | 160 | Good | 910 | 185 | Local omission of image due to impurity adhesion | 0.8 | None |

*Data of after printing 50,000 sheets for Comp. Ex. C-1 and C

From the results of Table 6, it was noted that when the protection layer was not included, film wear was increased and greasing occurred in the entire surface due to charge leakage after 50,000 sheets, whereby the life span of the apparatus was terminated. Also, it was noted that when only the acryl-modified polyorganosiloxane particles are not added to the protection layer, cleaning properties became poor, whereby filming of impurities, which were believed as components of a toner or developer, occurred on the photoconductor, causing local omission of image.

Also, when the inorganic filler was not added to the protection layer, since wear resistance was deteriorated and thereby, wear amount was increased. Therefore, after printing 100,000 sheets, the protection layer was run away and thus, any longer life span could not be expected. When a high molecular charge transport material was not used in the protection layer, the photoconductor could be readily scratched, causing image defects.

Also, cracks occurred due to fat adhesion. In contrast, when both acryl-modified polyorganosiloxane and an inorganic filler were added to the protection layer, wear resistance, scratch resistance, cleaning properties impurity removal were improved, thereby being capable of producing stable and high quality images in a large amount over a long period of time.

Also, according to the present invention, when the amount of polyorganosiloxane was greater than that of (meth) acrylate or a mixture of 70 wt % or more of (meth) acrylate and 30 wt % or less of a monomer copolymerizable therewith, impurity removal was improved, whereby abnormal image such as omission of print seldom occurred, particularly producing stable images.

Further, when a mixture of a high molecular charge transport material comprising component units represented by the formulae (A) and (B) and a high molecular charge transport material comprising component units represented by the formulae (C) and (B), wear resistance was improved and potential was maintained constantly. Therefore, it is possible to produce stable images.

In addition, when the weight average molecular weight of the high molecular charge transport material was more than 50000, the wear resistance was considerably improved.

As described above, by forming a protection layer as a top layer of an electrophotographic photoconductor and adding an inorganic filler and an acryl-modified polyorganosiloxane compound to the protection layer, it is possible to provide an electrophotographic photoconductor excellent in wear resistance, slide, removal of impurities and finger print resistance. Also, it is possible to provide an electrophotographic photoconductor in which problems associated with greasings caused by pin holes due to discharge destruction resulting from decrease of film thickness due to abrasion or poor cleaning, abnormal image such as image omission due to impurity adhesion and image defects caused by scratches on the photoconductor or cracks due to fat adhesion are eliminated, thereby producing stable images over a long period of time.

In any electrophotographic method, electrophotographic apparatus, process cartridge using the electrophotographic photoconductor according to the present invention, there is no need for exchanging the photoconductor for a long period of time. Also, maintenance and repairing are easy and convenient and cost performance is high. Further, it is possible to stably produce high quality images.

Example D•Comparative Example D

On an aluminum cylinder, coating solutions of a under coat layer, charge generation layer and charge transport layer were sequentially coated by dip coating, followed by drying, to form a under coat layer of 3.5 μm, a charge generation layer of 0.2 μm and a charge transport layer of 20 μm.

<Coating Solution of Under Coat Layer> titanium dioxide powders: 400 parts melamine resin: 40 parts alkid resin: 60 parts 2-butanone: 500 parts <Coating Solution of Charge Generation Layer> bisazo pigment of the following formula: 12 parts

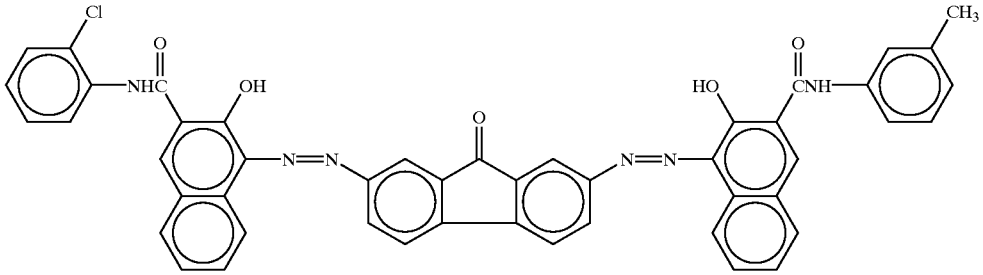

polyvinylbutyral: 5 parts 2-butanone: 200 parts cyclohexanone: 400 parts

<Coating Solution of Charge Transport Layer> polycarbonate(Z-Polyca, produced by Teijin Chemicals Ltd.): 10 parts charge transport material of the following formula: 7 parts

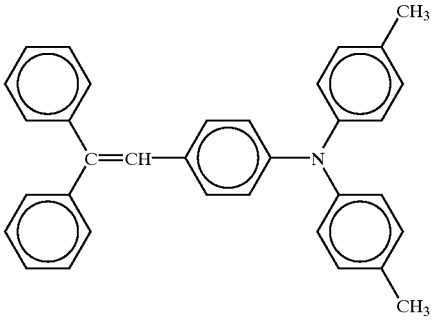

tetrahydrofuran: 104 parts

1% silicone oil(KF50-100cs, produced by Shin-Etsu Chemical Co., Ltd.) tetrahydrofuran solution: 1 parts acryl-modified polyorganosiloxane comprising 70% of purified polyorganosiloxane (R170S, produced by Nissan Chemical Industries Ltd.): 1.89 parts Example D-2

An electrophotographic photoconductor was prepared following the same procedure as in Example D-1 except for that the acryl-modified polyorganosiloxane used in Example D-1 was substituted with an acryl-modified polyorganosiloxane comprising 70% of purified polyorganosiloxane (R170, produced by Nissan Chemical Industries Ltd.).

Example D-3

An electrophotographic photoconductor was prepared following the same procedure as in Example D-1 except for that the acryl-modified polyorganosiloxane used in Example D-1 was substituted with an acryl-modified polyorganosiloxane comprising 50% of purified polyorganosiloxane (R170, produced by Nissan Chemical Industries Ltd.).

Example D-4

An electrophotographic photoconductor was prepared following the same procedure as in Example D-1 except for that the acryl-modified polyorganosiloxane used in Example D-1 was substituted with an acryl-modified polyorganosiloxane comprising 30% of purified polyorganosiloxane (R170, produced by Nissan Chemical Industries Ltd.).

Comparative Example D-1

An electrophotographic photoconductor was prepared following the same procedure as in Example D-1 except for that the acryl-modified polyorganosiloxane used in Example D-1 was substituted with a graft polymer having core/shell construction of US20010012594.

Comparative Example D-2

An electrophotographic photoconductor was prepared following the same procedure as in Example D-1 except for that the acryl-modified polyorganosiloxane used in Example D-1 was substituted with an acryl-silicone graft copolymer having a main chain of acryl and a side chain of silicone, as used in examples of Japanese Laid-Open Patent Application No. 5-323646 (Toagohsei chemicals co., ltd., GS-101).

Comparative Example D-3

An electrophotographic photoconductor was prepared following the same procedure as in Example D-1 except for that the acryl-modified polyorganosiloxane used in Example D-1 was substituted with an acryl-silicone graft copolymer having a main chain of acryl and a side chain of silicone, as used in examples of Japanese Laid-Open Patent Application No. 5-323646 (Toagohsei chemicals co., ltd., GS-30).

Comparative Example D-4

An electrophotographic photoconductor was prepared following the same procedure as in Example D-1 except for that the acryl-modified polyorganosiloxane used in Example D-1 was substituted with spherical melamine particles (GE Toshiba Silicone, Trade name: TOSPEARL105, average particle size: 0.5 μm).

Comparative Example D-5

An electrophotographic photoconductor was prepared following the same procedure as in Example D-1 except for that the acryl-modified polyorganosiloxane used in Example D-1 was substituted with an spherical melamine particles (produced by Nippon Shokubai co., ltd., EPOSTAR S, primary particle size: 0.3 μm).

Comparative Example D-6

An electrophotographic photoconductor was prepared following the same procedure as in Example D-1 except for that the acryl-modified polyorganosiloxane used in Example D-1 was substituted with alkoxy-modified silicone (Shinets silicone, KF-851).

Each of the electrophotographic photoconductors prepared in Example D-1 to C-4 and electrophotographic photoconductors prepared in Comparative Example D-1 to D-6 was mounted on a electrophotographic process cartridge (without exposure to light before cleaning). 40,000 sheets of plain paper was printed under an circumstance at a temperature of 25° C. and a humidity of 90%, using a modified laser printer produced by Ricoh Co., Ltd with an exposure light source at 655 nm. Subsequently, surface friction coefficient and morphology of each photoconductor, image quality, etc. was examined. The measurement of the friction coefficient of the photoconductor and examination of image quality and morphology of the photoconductor were performed as follows.

Surface Friction Coefficient Photoconductor:

An image carrier (drum type) was mounted on a friction measuring apparatus of oiler belt type. As a belt, high grade paper was prepared to have a width of 30 mm and a length of 290 mm. A 100 g weight was hanged at one end of the paper and a digital•force•gauge was attached at the other end of the paper. By slowly pulling the paper, a weight at the moment when the belt began to move was read and the static friction coefficient was calculated according to the following equation.

$$\mu=2/\pi\times 1n(F/W)$$

μ: static friction coefficient, F: read weight, W: weight of the weight, π: ratio of the circumference of a circle to its diameter ratio This measurement method (oiler-belt type) is also disclosed in Japanese Laid-Open Patent Application No. 9-166919.

Image quality: Image quality: synthetic examination with respect to image density, reproducibility of micro lines, scratched letters, resolution, greasing, etc.

Morphology of photoconductor: observation with an energy filtering transmission electron microscopy The results are shown in Table 7.

TABLE 7

| | (Before printing) Image quality | (After printing 40,000 sheets) Image quality | (After printing 40,000 sheets) friction coefficient of photo-conductor | Morphology of photo conductive layer |
|---|---|---|---|---|
| Ex. D-1 | Good | Good | 0.42 | Observed particles with separated phases exposed to the surface |
| Ex. D-2 | Good | Good | 0.43 | Observed particles with separated phases exposed to the surface |
| Ex. D-3 | Good | Good | 0.47 | Observed particles with separated phases exposed to the surface |
| Ex. D-4 | Good | Image deletion by filming | 0.54 | Observed particles with separated phases exposed to the surface |
| Comp. Ex. D-1 | Good | Local omission of image, Density reduction Generated image deletion by filming | 0.55 | Observed amorphous without separated phases exposed to the surface |
| Comp. Ex. D-2 | Good | Local omission of image Generated image deletion by filming | 0.61 | No clear phase separation in the dispersion phase |
| Comp. Ex. D-3 | Good | Local omission of image Generated image deletion by filming | 0.65 | No clear phase separation in the dispersion phase |
| Comp. Ex. D-4 | Good | Density reduction Generated image deletion by filming | 0.6 | No observed particles with phase separation |
| Comp. Ex. D-5 | Good | Local omission of image, Generated image deletion by filming | 0.62 | No observed particles with phase separation |
| Comp. Ex. D-6 | Good | Local omission of image, Density reduction, Generated image deletion by filming | 0.64 | No observed phase separation in the dispersion phase |

Example E•Comparative Example E

Example E-1

98.67 parts of refined acryl modified polyorganosiloxane (CHALINE R-170S available from Nissin Chemical Industry Co., Ltd.) are mixed into and agitated with 888 parts of tetrahydrofuran. Mixture is dispersed by a wet super-atomization system available from Sugino Machine Ltd. Dispersion is processed under a pressure of 110 Mpa.

Liquid obtained from a discharge port is re-invested in the high-pressure procedure for a total of 10 times, and a resultant dispersed substances after first, fifth, and tenth times are obtained. Particle distribution of acryl modified polyorganosiloxane with respect to high-pressure recovery is measured with a particle distribution measuring apparatus (product name of Horiba LA-910) available from Horiba Ltd. Results thereof are shown in Table 8.

TABLE 8

| Ex. E-1 | |
|---|---|
| Number of times Dispersed | Average particle diameter (μm) |
| 1 | 0.35 |
| 5 | 0.31 |
| 10 | 0.38 |

Example E-3

7.43 g of refined acryl modified polyorganosiloxane (CHALINE R-170S available from Nissin Chemical Industry Co., Ltd.) and 39.31 parts of polycarbonate (Z-Polyca available from Teijin Chemicals Ltd.) are mixed into and agitated with 888 parts of tetrahydrofuran. Mixture is dispersed by a wet super-atomization system (available from Sugino Machine Ltd.). Dispersion is processed under a pressure of 60 Mpa.

Liquid obtained from a discharge port is re-invested in the high-pressure procedure for a total of 5 times, and the resultant dispersed substances after the first, third, and fifth time is obtained. Particle distribution of acryl modified polyorganosiloxane in accordance with the number of times the high-pressure recovery was made is measured with a particle distribution measuring apparatus (product name of Horiba LA-910) available from Horiba Ltd. Results are shown in Table 9.

Examples E-4, E-5 and E-6

The same process is carried out as in Example E-3 except that pressures in dispersion are specified at 85, 110 and 150 Mpa, respectively. The particle distribution of the dispersion solutions each obtained under the above conditions is measured in the same manner as in Example E-3. Results are shown in Table 9.

TABLE 9

| Number of times Dispersed | Average particle diameter (μm) |
|---|---|
| Example E-3 | |
| 1 | 0.60 |
| 3 | 0.52 |
| 5 | 0.45 |

TABLE 9-continued

| Number of times Dispersed | Average particle diameter (μm) |
|---|---|
| Example E-4 | |
| 1 | 0.40 |
| 3 | 0.50 |
| 5 | 0.36 |
| Example E-5 | |
| 1 | 0.37 |
| 3 | 0.32 |
| 5 | 0.35 |
| Example E-6 | |
| 1 | 0.32 |
| 3 | 0.36 |
| 5 | 0.40 |

Example E-8

In example E-8, coating solutions for each layers formed by the following compositions are sequentially coated and then dried on an aluminum cylinder by submersion coating to obtain an underlayer of 3.5 μm, an electric charge generating layer of 0.2 μm and an electric charge carrier layer of 20 μm, thus an electrophotographic photoconductor in Example E-8 is prepared.

<Coating Solution for Underlayer>

Titanium dioxide powder: 400 parts

Melamine resin: 40 parts

Alkyd resin: 60 parts 2-butanone: 500 parts

<Coating Solution for Electric Charge Generating Layer>

Bisazo pigment of the following structural formula: 12 parts

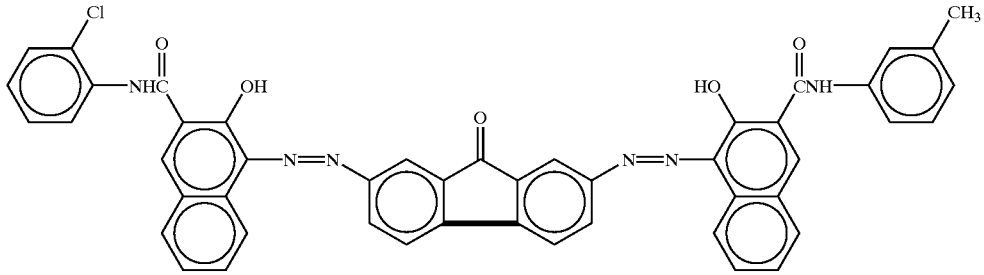

Polyvinyl-butylal: 5 parts 2-butanon: 200 parts

Cyclohexanone: 400 parts

<Coating Solution for Electric Charge Carrier Layer>

Polycarbonate (Z-Polyca available from Teijin Chemicals Ltd.): 10 parts

Electric charge carrier substance of the following structural formula: 7 parts

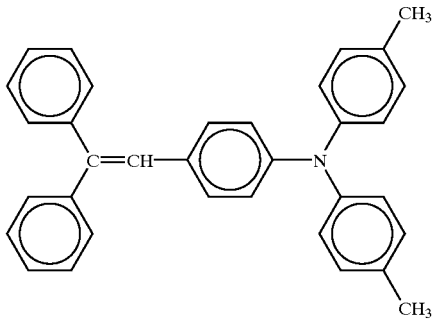

Tetrahydrofuran: 87 parts

1% silicon oil (KF50-100CS available from Shin-Etsu Chemical Co., Ltd.) tetrahydrofuran solution: 1 part Acryl modified polyorganosiloxane dispersion solution obtained in Example 1 (treated five times in the high-pressure procedure): 18.9 parts Example E-10

An electrophotographic photoconductor in Example E-10 was obtained utilizing the same electrophotographic photoconductor as in Example E-8 except that the coating solution for electric charge carrier layer is obtained according to the following formulation.

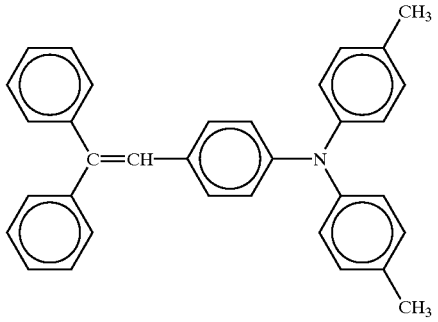

Electric charge carrier substance of the following structural formula: 7 parts

1% silicon oil (KF50-100CS available from Shin-Etsu Chemical Co., Ltd.) tetrahydrofuran solution: 1 part Acryl modified polyorganosiloxane dispersion solution obtained in Example E-3 (treated three times in the high-pressure procedure): 237.8 parts Example E-11 to E-13

The electrophotographic photoconductors in these examples were obtained utilizing the same method as in Example E-10 except that the dispersion solutions each obtained in Examples E-4 to E-6 are utilized for the acryl modified polyorganosiloxane dispersion solution in the coating solution for electric charge carrier layer (product from the third high-pressure procedure) in Example E-10.

The electrophotographic photoconductor for in Examples E-8 to E-14 prepared as mentioned above are mounted to cartridges for electrophotography process (pre-exposure before cleaning not conducted), and a continuous printing of 50,000 sheets was initially carried out by a modified laser printer (product of Ricoh Co., Ltd.) utilizing a 655 nm semiconductor laser as a light source for exposing images. Then, images are developed under temperature of 25° C. and humidity of 90%, and evaluated with respect to light portion potential, dark portion potential and image quality. The light portion potential, dark portion potential and image quality are respectively defined and evaluated as follows:

Dark portion potential: surface potential of electrophotographic photoconductor when moved up to the position to be developed after first charge;

Light portion potential: surface potential of the electrophotographic photoconductor when moved up to the position to be developed after rendered image exposure (whole surface exposure) after the first charge;

Image quality: general evaluation on an output image including image density, thin line reproducing ability, degree of blur of characters, resolution, toner deposition on the background of images, and the like;

Electrophotographic photoconductor defects: adherence of acryl modified polyorganosiloxane aggregations on the surface of electrophotographic photoconductor visually observed by naked eyes.

Further, after printing 50,000 sheets, film thickness was measured to evaluate the abrasion quantity from the difference in film thickness before and after the printing. Results are shown in Table 10.

TABLE 10

| Electrophotographic | Defect | Initial | | | After printing 50,000 sheets | | | |
|---|---|---|---|---|---|---|---|---|
| photoconductor | Defect(1) | DPP(2) (−V) | LPP(3) (−V) | Image Quality | DPP(2) (−V) | LPP(3) (−V) | Image Quality | Abrasion (μm) |
| Ex. E-8 | None | 810 | 50 | Good | 820 | 70 | Good | 7.5 |
| Ex. E-10 | None | 800 | 60 | Good | 810 | 75 | Good | 8.0 |
| Ex. E-11 | None | 810 | 65 | Good | 800 | 80 | Good | 7.0 |
| Ex. E-12 | None | 810 | 40 | Good | 800 | 50 | Good | 6.5 |
| Ex. E-13 | None | 820 | 70 | Good | 820 | 85 | Good | 7.0 |

Note:
Defect(1): Electrophotographic photoconductor defects (number of aggregations per drum)
DPP(2): Dark portion potential
LPP(3): Light portion potential Example E-15 to E-19

Pieces of the electric charge carrier layers of the electrophotographic photoconductors in Examples E-8 and E-10 to E-13 are dried with ruthenium acid vapor, and morphologies thereof are observed with a projective electron microscope (H-9000NAR). An image processing software is used to measure the average particle diameter of the acryl modified polyorganosiloxane dispersed in a matrix phase of polycarbonate. Results are shown in Table 11.

TABLE 11

| | Acryl modified polyorganosiloxane | |
|---|---|---|
| | Average particle diameter (μm) | Ratio of particles 1.0 μm or larger |
| Ex. E-15 | 0.38 | 0 |
| Ex. E-16 | 0.58 | 0 |
| Ex. E-17 | 0.52 | 0 |
| Ex. E-18 | 0.39 | 0 |
| Ex. E-19 | 0.42 | 0 |

What is claimed is:

1. An electrophotographic photoconductor comprising:

an electroconductive support and a photoconductive layer thereon; and an outermost layer of the photoconductive layer comprising particles;

wherein a surface of the particles comprises:

a) a poly organosiloxane-containing phase which contains polyorganosiloxane; and b) an organic polymer-containing phase which contains organic polymer without silicone or having polyorganosiloxane content less than the polyorganosiloxane-containing phase.

2. An electrophotographic photoconductor according to claim 1, wherein a ratio of the polyorganosiloxane to the organic polymer (mass ratio of the polyorganosiloxane/organic polymer) is in a range of 30:70 to 90:10.

3. An electrophotographic photoconductor according to claim 1, wherein the particles have a cross sectional shape of circle or oval and are dispersed in the outermost surface layer of the photoconductive layer.

4. An electrophotographic photoconductor according to claim 1, wherein the organic polymer comprises one member selected from the group consisting of:

1) a copolymer of a (meth) acrylic acid ester; and 2) a copolymer of a monomer copolymerizable with the (meth) acrylic acid ester.

5. The electrophotographic photoconductor according to claim 1, wherein the photoconductive layer comprises an inorganic filler.

6. The electrophotographic photoconductor according to claim 1, wherein the photoconductive layer comprises a high molecular charge transport material.

7. The electrophotographic photoconductor according to claim 6, wherein the high molecular charge transport material comprises a unit represented by the following formula (A) and a unit represented by the following formula (B), in which the compositional ratio (k) of the unit represented by the formula (A) and the compositional ratio (j) of the unit represented by the formula (B) satisfy $0<k/(k+j)\leqq 1$;

Formula (A)

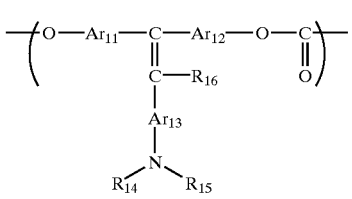

in the formula (A):

$R_{16}$ is a hydrogen atom, a substituted or unsubstituted alkyl group having 1 to 6 carbon atoms or a substituted or unsubstituted aryl group; $Ar_{11}$, $Ar_{12}$ and $Ar_{13}$ are a substituted or unsubstituted arylene group; and $R_{14}$ and $R_{15}$ are a substituted or unsubstituted aryl group;

Formula (B)

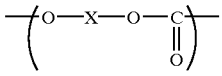

in the formula (B):

X is a substituted or unsubstituted divalent aliphatic hydrocarbon group having 2 to 20 carbon atoms; a substituted or unsubstituted divalent cycloaliphatic hydrocarbon group; a substituted or unsubstituted divalent aromatic hydrocarbon group having 6 to 20 carbon atoms; a divalent group combined with the forgoing groups; or a divalent group expressed by at least any one compound represented by the formulae (a) to (c);

Formula (a)

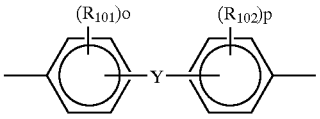

Formula (b)

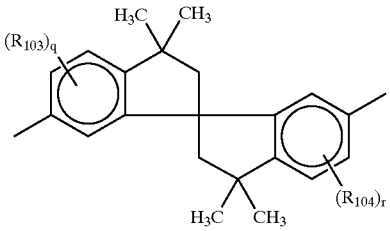

Formula (c)

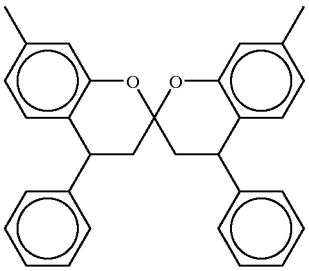

in the formulae (a) to (c):

$R_{101}$, $R_{102}$, $R_{103}$ and $R_{104}$ are a halogen atom, a substituted or unsubstituted alkyl group having 1 to 6 carbon atoms or a substituted or unsubstituted aryl group, provided that $R_{101}$, $R_{102}$, $R_{103}$ and $R_{104}$ may be identical or may be different when they are each present in plurality;

o and p are independently an integer of 0 to 4;

q and r are independently an integer of 0 to 3; and

Y is a single bond, a straight-chained alkylene group having 2 to 12 carbon atoms, a branched substituted or unsubstituted alkylene group having 3 to 12 carbon atoms, at least one alkylene group having 1 to 10 carbon atoms, a divalent group containing at least one oxygen atom and sulfur atom, —O—, —S—, —SO—, —$SO_2$—, —CO—, —COO— or a divalent group represented by at least any one of the following formulae (d) to (m):

Formula (d)

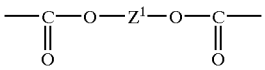

Formula (e)

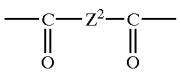

Formula (f)

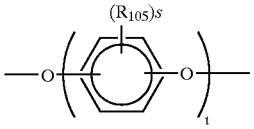

Formula (g)

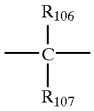

Formula (h)

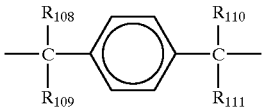

Formula (i)

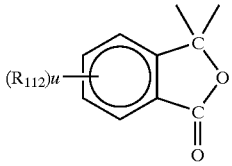

Formula (j)

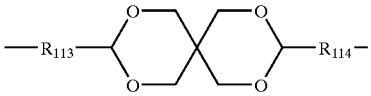

Formula (k)

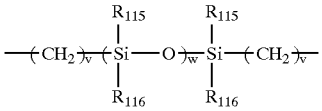

Formula (l)

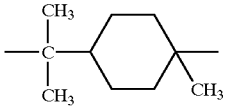

Formula (m)

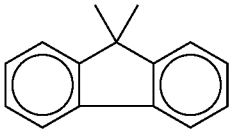

in the formulae (d) to (m)

$Z_1$ and $Z_2$ are a substituted or unsubstituted divalent aliphatic hydrocarbon group having 2 to 20 carbon atoms or a substituted or unsubstituted arylene group, provided that $Z_1$ and $Z_2$ may be identical or different;

$R_{105}$ is a halogen atom, a substituted or unsubstituted alkyl group having 1 to 6 carbon atoms, a substituted or unsubstituted alkoxyl group having 1 to 6 carbon atoms or a substituted or unsubstituted aryl group;

$R_{106}$ and $R_{107}$ are a hydrogen atom, a halogen atom, a substituted or unsubstituted alkyl group having 1 to 6 carbon atoms, a substituted or unsubstituted alkoxyl group having 1 to 6, carbon atoms or a substituted or unsubstituted aryl group, or $R_{106}$ and $R_{107}$ may bond together to form a cyclic carbon having 5 to 12 carbon atoms;

$R_{108}$, $R_{109}$, $R_{110}$ and $R_{111}$ are a hydrogen atom, a halogen atom, a substituted or unsubstituted alkyl group having 1 to 6 carbon atoms, a substituted or unsubstituted alkoxyl group having 1 to 6 carbon atoms or a substituted or unsubstituted aryl group;

$R_{112}$ is a halogen atom, a substituted or unsubstituted alkyl group having 1 to 6 carbon atoms, a substituted or unsubstituted alkoxyl group having 1 to 6 carbon atoms or a substituted or unsubstituted aryl group;

$R_{113}$ and $R_{114}$ are a single bond or an alkylene group having 1 to 4 carbon atoms;

$R_{115}$ and $R_{116}$ are independently, a substituted or unsubstituted alkyl group having 1 to 6 carbon atoms or a substituted or unsubstituted aryl group;

s is an integer of 0 to 4;

t is an integer of 1 or 2;

u is an integer of 0 to 4;

v is an integer of 0 to 20; and w is an integer of 0 to 2000.

8. The electrophotographic photoconductor according to claim 6, wherein the high molecular charge transport material comprises a unit represented by the following formula (C) and a unit represented by the following formula (B), in which the compositional ratio (k) of the unit represented by the formula (C) and the compositional ratio (j) (of the unit represented by the formula (B) satisfy $0<k/(k+j)\leqq 1$;

Formula (B)

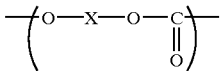

in the formula (B):

X is a substituted or unsubstituted divalent aliphatic hydrocarbon group having 2 to 20 carbon atoms; a substituted or unsubstituted divalent cycloaliphatic hydrocarbon group; a substituted or unsubstituted divalent aromatic hydrocarbon group having 6 to 20 carbon atoms; a divalent group combined with the forgoing groups; or at least any one represented by the formulae (a) to (c), Formula (a)

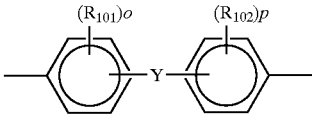

Formula (b)

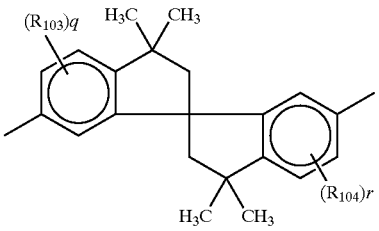

-continued

Formula (c)

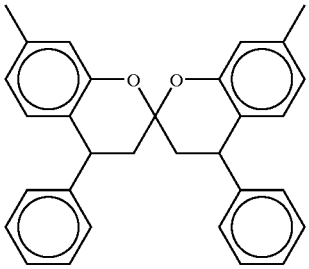

in the formulae (a) to (c):

$R_{101}$, $R_{102}$, $R_{103}$ and $R_{104}$ are a halogen atom, a substituted or unsubstituted alkyl group having 1 to 6 carbon atoms or a substituted or unsubstituted aryl group, provided that $R_{101}$, $R_{102}$, $R_{103}$ and $R_{104}$ may be identical or different when they are each present in plurality;

o and p are independently an integer of 0 to 4;

q and r are independently an integer of 0 to 3; and

Y is a single bond, a straight-chained alkylene group having 2 to 12 carbon atoms, a branched substituted or unsubstituted alkylene group having 3 to 12 carbon atoms, at least one alkylene group having 1 to 10 carbon atoms, a divalent group containing at least one oxygen atom and sulfur atom, —O—, —S—, —SO—, —$SO_2$—, —CO—, —COO— or a divalent group represented by at least any one of the following formulae (d) to (m);

Formula (d)

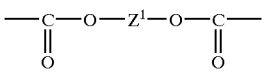

Formula (e)

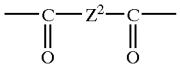

Formula (f)

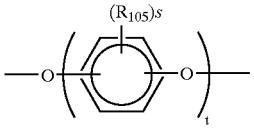

Formula (g)

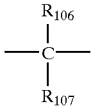

Formula (h)

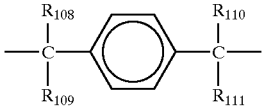

Formula (i)

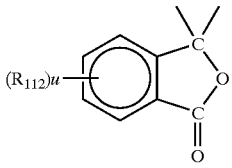

-continued

Formula (j)

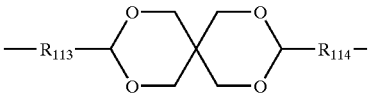

Formula (k)

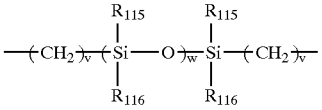

Formula (l)

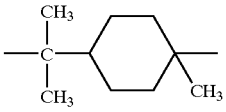

Formula (m)

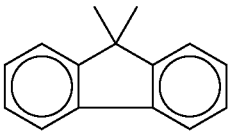

in the formulae (d) to (m), $Z_1$ and $Z_2$ are a substituted or unsubstituted divalent aliphatic hydrocarbon group having 2 to 20 carbon atoms or a substituted or unsubstituted arylene group, provided that $Z_1$ and $Z_2$ may be identical or different;

$R_{105}$ is a halogen atom, a substituted or unsubstituted alkyl group having 1 to 6 carbon atoms, a substituted or unsubstituted alkoxyl group having 1 to 6 carbon atoms or a substituted or unsubstituted aryl group;

$R_{106}$ and $R_{107}$ are a hydrogen atom, a halogen atom, a substituted or unsubstituted alkyl group having 1 to 6 carbon atoms, a substituted or unsubstituted alkoxyl group having 1 to 6 carbon atoms or a substituted or unsubstituted aryl group, or $R_{106}$ and $R_{107}$ may bond together to form a cyclic carbon having 5 to 12 carbon atoms;

$R_{108}$, $R_{109}$, $R_{110}$ and $R_{111}$ are a hydrogen atom, a halogen atom, a substituted or unsubstituted alkyl group having 1 to 6 carton atoms, a substituted or unsubstituted alkoxyl group having 1 to 6 carbon atoms or a substituted or unsubstituted aryl group;

$R_{112}$ is a halogen atom, a substituted or unsubstituted alkyl group having 1 to 6 carbon atoms, a substituted or unsubstituted alkoxyl group having 1 to 6 carbon atoms or a substituted or unsubstituted aryl group;

$R_{113}$ and $R_{114}$ are a single bond or an alkylene group having 1 to 4 carbon atoms;

$R_{115}$ and $R_{116}$ are independently, a substituted or unsubstituted alkyl group having 1 to 6 carbon atoms or a substituted or unsubstituted aryl group;

s is an integer of 0 to 4;

t is an integer of 1 or 2;

u is an integer of 0 to 4;

v is an integer of 0 to 20; and w is an integer of 0 to 2000;

Formula (C)

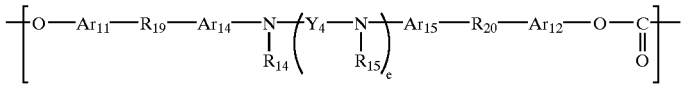

in the formula (C):

$R_{19}$ and $R_{20}$ are a straight chain or branched alkylene group, $Y_4$ is a substituted or unsubstituted arylene group or —$Ar_{25}$—$Y_5$—$Ar_{25}$—, in which $Ar_{14}$, $Ar_{15}$ and $Ar_{25}$ are a substituted or unsubstituted arylene group and $Y_5$ is O, S or a substituted or unsubstituted arylene group, e is 0 or 1, $Ar_{11}$ and $Ar_{12}$ are a substituted or unsubstituted arylene group, and $R_{14}$ and $R_{15}$ are a substituted or unsubstituted aryl group.

9. An electrophotographic photoconductor comprising:

an electroconductive support and a photoconductive layer thereon;

wherein an outermost layer of the photoconductor comprises an acryl-modified polyorganosiloxane comprising a) main chain of a polyorganosiloxane; and b) a graft chain of an acryl polymer without containing silicon;

wherein the acryl-modified polyorganosiloxane is prepared by emulsion graft copolymerizing of a polyorganosiloxane compound represented by the following formula (I) and a (meth)acrylic acid ester represented by the following formula (II) or a mixture of the (meth)acrylic acid ester and a monomer copolymerizable with the (meth)acrylic acid ester via emulsion graft copolymerization;

Formula (I)

(I)

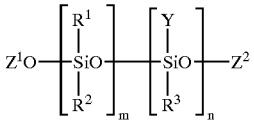

in the formula (I), each of $R_1$, $R_2$ and $R_3$ is a hydrocarbon group having 1 to 20 carbon atoms and $R_1$, $R_2$ and $R_3$ may be identical or different, or be halogenated;

Y is an organic group containing either a radical reactive group or SH group or both of them;

each of $Z_1$ and $Z_2$ is a hydrogen atom, lower alkyl group or one represented by the following formula (n), and $Z_1$ and $Z_2$ may be identical or different;

m is a plus integer of 10,000 or less; and n is an integer of 1 or more;

Formula (n)

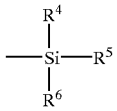

in the formula (n)

each of $R_4$ and $R_5$ is a hydrocarbon group or a halogenated hydrocarbon group having 1 to 20 carbon atoms and $R_4$ and $R_5$ may be identical or different; and $R_6$ is a hydrocarbon group having 1 to 20 carbon atoms, a halogenated hydrocarbon group, an organic group containing either a radical reactive group or SH group or both of them;

Formula (II)

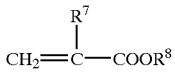

in the formula (II):

$R_7$ is a hydrogen atom or a methyl group; and $R_8$ is at least any one member selected from the group consisting of an alkyl group, alkoxy-substituted alkyl group, cyclo alkyl group and aryl group.

10. The electrophotographic photoconductor according to claim 9, wherein the acryl-modified polyorganosiloxane is cleaned with alcohol.

11. The electrophotographic photoconductor according to claim 9, wherein a sodium content to the acryl-modified polyorganosiloxane in the outermost surface layer of the photoconductive layer is 500 ppm or less.

12. The electrophotographic photoconductor according to claim 9, wherein a content of sulfur containing ion to the acryl-modified polyorganosiloxane in the outermost surface layer of the photoconductive layer is 800 ppm or less.

13. The electrophotographic photoconductor according to claim 9, wherein the acryl-modified polyorganosiloxane is dispersed as a particle phase and the average particle diameter of the acryl-modified polyorganosiloxane particles (volume average particle diameter($D_{50}$)) is in the range of 0.1 to 0.6 $\mu$m.

14. The electrophotographic photoconductor according to claim 9, wherein the acryl-modified polyorganosiloxane is subjected to a high pressure with at least one of a solvent and a binder and crushed and dispersed by liquid impact under elevated pressure, so as to be dispersed as a particle phase and the average particle diameter of the acryl-modified polyorganosiloxane particles (volume average particle diameter($D_{50}$)) is in the range of 0.1 to 0.6 $\mu$m.

15. The electrophotographic photoconductor according to claim 9, wherein the photoconductive layer comprises an inorganic filler.

16. The electrophotographic photoconductor according to claim 9, wherein the photoconductive layer comprises a high molecular charge transport material.

17. The electrophotographic photoconductor according to claim 16, wherein the high molecular charge transport material comprises a unit represented by the following formula (A) and a unit represented by the following formula (B), in which the compositional ratio (k) of the unit represented by the formula (A) and the compositional ratio (j) of the unit represented by the formula (B) satisfy $0<k/(k+j)\leqq 1$;

Formula (A)

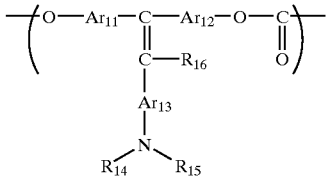

in the formula (A):

$R_{16}$ is a hydrogen atom, a substituted or unsubstituted alkyl group having 1 to 6 carbon atoms or a substituted or unsubstituted aryl group;

$Ar_{11}$, $Ar_{12}$ and $Ar_{13}$ are a substituted or unsubstituted arylene group; and $R_{14}$ and $R_{15}$ are a substituted or unsubstituted aryl group;

Formula (B)

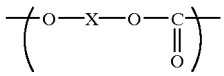

in the formula (B):

X is a substituted or unsubstituted divalent aliphatic hydrocarbon group having 2 to 20 carbon atoms; a substituted or unsubstituted divalent cycloaliphatic hydrocarbon group; a substituted or unsubstituted divalent aromatic hydrocarbon group having 6 to 20 carbon atoms; a divalent group combined with the forgoing groups; or at least any one represented by the formulae (a) to (c);

Formula (a)

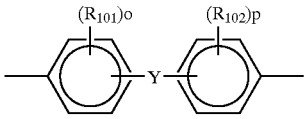

Formula (b)

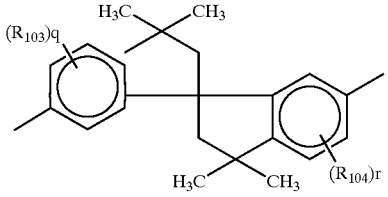

Formula (c)

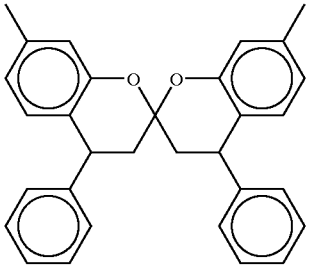

in the formulae (a) to (c):

$R_{101}$, $R_{102}$, $R_{103}$ and $R_{104}$ are a halogen atom, a substituted or unsubstituted alkyl group having 1 to 6 carbon atoms or a substituted or unsubstituted aryl group, provided that $R_{101}$, $R_{102}$, $R_{103}$ and $R_{104}$ may be identical or different when they are each present in plurality;

o and p are independently an integer or 0 to 4;

q and r are independently an integer of 0 to 3; and

Y is a single bond, a straight-chained alkylene group having 2 to 12 carbon atoms, a branched substituted or unsubstituted alkylene group having 3 to 12 carbon atoms, at least one alkylene group having 1 to 10 carbon atoms, a divalent group containing at least one oxygen atom and sulfur atom, —O—, —S—, —SO—, —$SO_2$—, —CO—, —COO— or a divalent group represented by at least any one of the following formulae (d) to (m);

Formula (d)

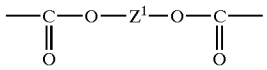

Formula (e)

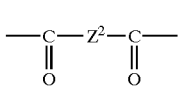

Formula (f)

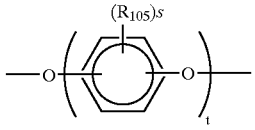

Formula (g)

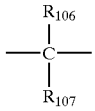

Formula (h)

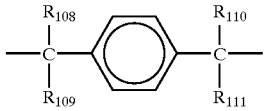

Formula (i)

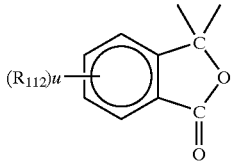

Formula (j)

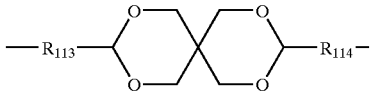

Formula (k)

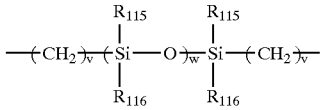

Formula (l)

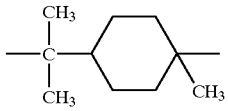

Formula (m)

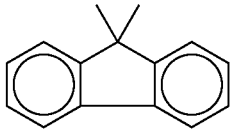

in the formulae (d) to (m):

$Z_1$ and $Z_2$ are a substituted or unsubstituted divalent aliphatic hydrocarbon group having 2 to 20 carbon atoms or a substituted or unsubstituted arylene group, provided that $Z_1$ and $Z_2$ may be identical or different;

$R_{105}$ is a halogen atom, a substituted or unsubstituted alkyl group having 1 to 6 carbon atoms, a substituted or unsubstituted alkoxyl group having 1 to 6 carbon atoms or a substituted or unsubstituted aryl group;

$R_{106}$ and $R_{107}$ are a hydrogen atom, a halogen atom, a substituted or unsubstituted alkyl group having 1 to 6 carbon atoms, a substituted or unsubstituted alkoxyl group having 1 to 6 carbon atoms or a substituted or unsubstituted aryl group, or $R_{106}$ and $R_{107}$ may bond together to form a cyclic carbon having 5 to 12 carbon atoms;

$R_{108}$, $R_{109}$, $R_{110}$ and $R_{111}$ are a hydrogen atom, a halogen atom, a substituted or unsubstituted alkyl group having 1 to 6 carton atoms, a substituted or unsubstituted alkoxyl group having 1 to 6 carbon atoms or a substituted or unsubstituted aryl group;

$R_{112}$ is a halogen atom, a substituted or unsubstituted alkyl group having 1 to 6 carbon atoms, a substituted or unsubstituted alkoxyl group having 1 to 6 carbon atoms or a substituted or unsubstituted aryl group;

$R_{113}$ and $R_{114}$ are a single bond or an alkylene group having 1 to 4 carbon atoms;

$R_{115}$ and $R_{116}$ are independently, a substituted or unsubstituted alkyl group having 1 to 6 carbon atoms or a substituted or unsubstituted aryl group;

s is an integer of 0 to 4;

t is an integer of 1 or 2;

u is an integer of 0 to 4;

v is an integer of 0 to 20; and w is an integer of 0 to 2000.

18. The electrophotographic photoconductor according to claim 16, wherein the high molecular charge transport material comprises a unit represented by the following formula (C) and a unit represented by the following formula (B), in which the compositional ratio (k) of the unit represented by the formula (C) and the compositional ratio (j) of the unit represented by the formula (B) satisfy $0<k/(k+j)\leqq 1$;

Formula (B)

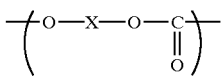

in the formula (B):

X is a substituted or unsubstituted divalent aliphatic hydrocarbon group having 2 to 20 carbon atoms; a substituted or unsubstituted divalent cycloaliphatic hydrocarbon group; a substituted or unsubstituted divalent aromatic hydrocarbon group having 6 to 20 carbon atoms; a divalent group combined with the forgoing groups; or at least any one represented by the formulae (a) to (c);

Formula (a)

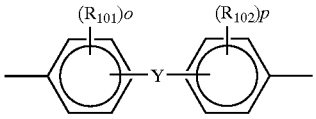

-continued

Formula (b)

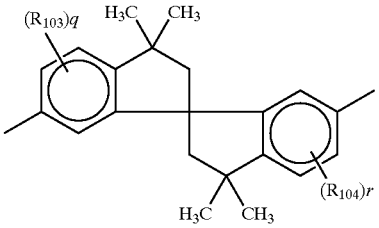

Formula (c)

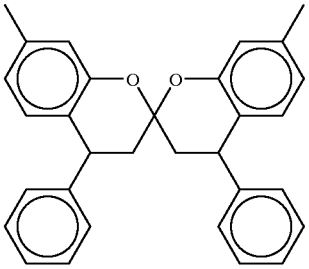

in the formulae (a) to (c):

$R_{101}$, $R_{102}$, $R_{103}$ and $R_{104}$ are a halogen atom, a substituted or unsubstituted alkyl group having 1 to 6 carbon atoms or a substituted or unsubstituted aryl group, provided that $R_{101}$, $R_{102}$, $R_{103}$ and $R_{104}$ may be identical or different when they are each present in plurality;

o and p are independently an integer of 0 to 4;

q and r are independently an integer of 0 to 3; and

Y is a single bond, a straight-chained alkylene group having 2 to 12 carbon atoms, a branched substituted or unsubstituted alkylene group having 3 to 12 carbon atoms, at least one alkylene group having 1 to 10 carbon atoms, a divalent group containing at least one oxygen atom and sulfur atom, —O—, —S—, —SO—, —$SO_2$—, —CO—, —COO— or a divalent group represented by at least any one of the following formulae (d) to (m);

Formula (d)

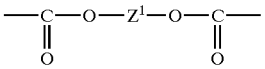

Formula (e)

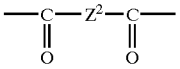

Formula (f)

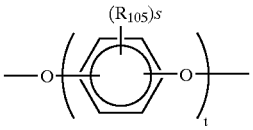

Formula (g)

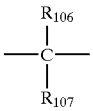

Formula (h)

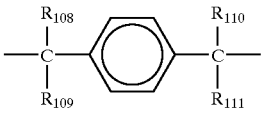

-continued

Formula (i)

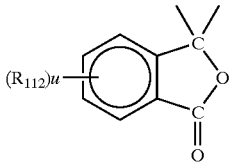

Formula (j)

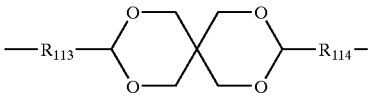

Formula (k)

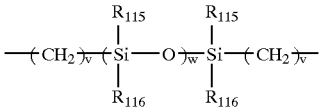

Formula (l)

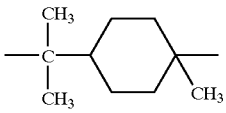

Formula (m)

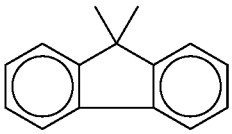

in the formulae (d) to (m):

$Z_1$ and $Z_2$ are a substituted or unsubstituted divalent aliphatic hydrocarbon group having 2 to 20 carbon atoms or a substituted or unsubstituted arylene group, provided that $Z_1$ and $Z_2$ may be identical or different;

$R_{105}$ is a halogen atom, a substituted or unsubstituted alkyl group having 1 to 6 carbon atoms, a substituted or unsubstituted alkoxyl group having 1 to 6 carbon atoms or a substituted or unsubstituted aryl group;

$R_{106}$ and $R_{107}$ are a hydrogen atom, a halogen atom, a substituted or unsubstituted alkyl group having 1 to 6 carbon atoms, a substituted or unsubstituted alkoxyl group having 1 to 6 carbon atoms or a substituted or unsubstituted aryl group, or $R_{106}$ and $R_{107}$ may bond together to form a cyclic carbon having 5 to 12 carbon atoms;

$R_{108}$, $R_{109}$, $R_{110}$ and $R_{111}$ are a hydrogen atom, a halogen atom, a substituted or unsubstituted alkyl group having 1 to 6 carbon atoms, a substituted or unsubstituted alkoxyl group having 1 to 6 carbon atoms or a substituted or unsubstituted aryl group;

$R_{112}$ is a halogen atom, a substituted or unsubstituted alkyl group having 1 to 6 carbon atoms, a substituted or unsubstituted alkoxyl group having 1 to 6 carbon atoms or a substituted or unsubstituted aryl group;

$R_{113}$ and $R_{114}$ are a single bond or an alkylene group having 1 to 4 carbon atoms;

$R_{115}$ and $R_{116}$ are independently, a substituted or unsubstituted alkyl group having 1 to 6 carbon atoms or a substituted or unsubstituted aryl group;

s is an integer of 0 to 4;

t is an integer of 1 or 2;

u is an integer of 0 to 4;

v is an integer of 0 to 20; and w is an integer of 0 to 2000;

Formula (C)

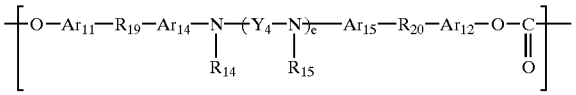

in the formula (C):

$R_{19}$ and $R_{20}$ are a straight-chained or branched alkylene group, $Y_4$ is a substituted or unsubstituted arylene group or $—Ar_{25}—Y_5—Ar_{25}—$, in which $Ar_{14}$, $Ar_{15}$ and $Ar_{25}$ are a substituted or unsubstituted arylene group and $Y_5$ is O, S or a substituted or unsubstituted arylene group, e is 0 or 1, $Ar_{11}$ and $Ar_{12}$ are a substituted or unsubstituted arylene group, and $R_{14}$ and $R_{15}$ are a substituted or unsubstituted aryl group.

19. A process cartridge comprising an electrophotographic photoconductor which comprises:

an electroconductive support and a photoconductive layer thereon; and an outermost layer of the photoconductive layer comprising particles;

wherein a surface of the particles comprises:

a) a polyorganosiloxane-containing phase which contains polyorganosiloxane; and b) an organic polymer-containing phase which contains organic polymer without silicone or having polyorganosiloxane content less than the polyorganosiloxane-containing phase.

20. An electrophotographic device comprising:

an electrophotographic photoconductor;

a charging unit configured to charge a latent image carrier;

a light irradiating unit configured to irradiate light image-wisely onto the latent image carrier so as to form a latent electrostatic image thereon;

an image developing unit configured to develop the latent electrostatic image to a developed image; and a transfer charger configured to transfer the developed image to a recording medium;

wherein the electrophotographic photoconductor comprises:

an electroconductive support and a photoconductive layer thereon; and an outermost layer of the photoconductive layer comprising particles;

wherein a surface of the particles comprises:

a) a polyorganosiloxane-containing phase which contains polyorganosiloxane; and b) an organic polymer-containing phase which contains organic polymer without silicone or having polyorganosiloxane content less than the polyorganosiloxane-containing phase.

21. An electrophotographic device comprising:

an electrophotographic photoconductor;

a charging unit configured to charge a latent image carrier;

a light irradiating unit configured to irradiate light image-wisely onto the latent image carrier so as to form a latent electrostatic image thereon;

an image developing unit configured to develop the latent electrostatic image to a developed image; and a transfer charger configured to transfer the developed image to a recording medium;

wherein the electrophotographic photoconductor comprises:

an electroconductive support; and a photoconductive layer formed on the electroconductive support;

wherein an outermost layer of the photoconductor comprises an acryl-modified polyorganosiloxane comprising a) a main chain of a polyorganosiloxane; and b) a graft chain of an acryl polymer without containing silicon;

wherein the acryl-modified polyorganosiloxane is prepared by emulsion graft copolymerizing of a polyorganosiloxane compound represented by the following formula (I) and a (meth)acrylic acid ester represented by the following formula (II) or a mixture of the (meth)acrylic acid ester and a monomer copolymerizable with the (meth)acrylic acid ester via emulsion graft copolymerization;

Formula (I)

(I)

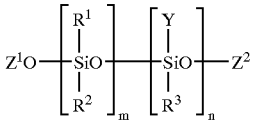

in the Formula (I), each of $R_1$, $R_2$ and $R_3$ is a hydrocarbon group having 1 to 20 carbon atoms and $R_1$, $R_2$ and $R_3$ may be identical or different, or be halogenated;

Y is an organic group containing either a radical reactive group or SH group or both of them;

each of $Z_1$ and $Z_2$ is a hydrogen atom, lower alkyl group or one represented by the following formula (n), and $Z_1$ and $Z_2$ may be identical or different;

m is a plus integer of 10,000 or less; and n is an integer of 1 or more;

Formula (n)

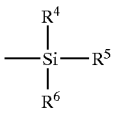

in the Formula (n)

each of $R_4$ and $R_5$ is a hydrocarbon group or a halogenated hydrocarbon group having 1 to 20 carbon atoms and $R_4$ and $R_5$ may be identical or different; and $R_6$ is a hydrocarbon group having 1 to 20 carbon atoms, a halogenated hydrocarbon group, an organic group containing either a radical reactive group or SH group or both of them;

Formula (II)

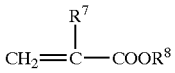

in the Formula (II):

$R_7$ is a hydrogen atom or a methyl group; and $R_8$ is at least any one member selected from the group consisting of an alkyl group, alkoxy-substituted alkyl group, cyclo alkyl group and aryl group.

22. A process cartridge comprising an electrophotographic photoconductor which comprises:

an electroconductive support and a photoconductive layer thereon, the outermost layer of the photoconductive layer comprises an acryl-modified polyorganosiloxane comprising a) a main chain of a polyorganosiloxane; and b) a graft chain of an acryl polymer without containing silicon;

wherein the acryl-modified polyorganosiloxane is prepared by emulsion graft copolymerizing of a polyorganosiloxane compound represented by the following formula (I) and a (meth) acrylic acid ester represented by the following formula (II) or a mixture of the (meth)acrylic acid ester and a monomer copolymerizable with the (meth)acrylic acid ester via emulsion graft copolymerization;

Formula (I)

(I)

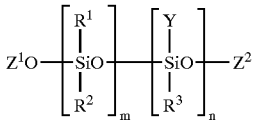

in the Formula (I), each of $R_1$, $R_2$ and $R_3$ is a hydrocarbon group having 1 to 20 carbon atoms and $R_1$, $R_2$ and $R_3$ may be identical or different, or be halogenated;

Y is an organic group containing either a radical reactive group or SH group or both of them;

each of $Z_1$ and $Z_2$ is a hydrogen atom, lower alkyl group or one represented by the following formula (n), and $Z_1$ and $Z_2$ may be identical or different;

m is a plus integer of 10,000 or less; and n is an integer of 1 or more;

Formula (n)

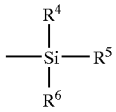

in the Formula (n)

each of $R_4$ and $R_5$ is a hydrocarbon group or a halogenated hydrocarbon group having 1 to 20 carbon atoms and $R_4$ and $R_5$ may be identical or different; and $R_6$ is a hydrocarbon group having 1 to 20 carbon atoms, a halogenated hydrocarbon group, an organic group containing either a radical reactive group or SH group or both of them;

Formula (II)

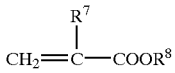

in the Formula (II):

$R_7$ is a hydrogen atom or a methyl group; and $R_8$ is at least any one of an alkyl group, alkoxy-substituted alkyl group, cyclo alkyl group and aryl group.

* * * * *

UNITED STATES PATENT AND TRADEMARK OFFICE

CERTIFICATE OF CORRECTION

PATENT NO. : 6,939,651 B2
DATED : September 6, 2005
INVENTOR(S) : Li et al.

It is certified that error appears in the above-identified patent and that said Letters Patent is hereby corrected as shown below:

Title page,
Item [45] should read as follows:
-- [45] **Date of Patent: *Sep. 6, 2005** --.
Item [*] should read as follows:
-- [*] Notice: Subject to any disclaimer, the term of this patent is extended or adjusted under 35 U.S.C. 154(b) by 56 days.

This patent is subject to a terminal disclaimer. --.

Signed and Sealed this

Fifteenth Day of November, 2005

JON W. DUDAS
*Director of the United States Patent and Trademark Office*